US007358019B2

(12) United States Patent
Toyama et al.

(10) Patent No.: US 7,358,019 B2
(45) **Date of Patent: *Apr. 15, 2008**

(54) DEVELOPING PROCESS AND IMAGE FORMING PROCESS

(75) Inventors: Hiroshi Toyama, Nagano-ken (JP); Ken Ikuma, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 393 days.

This patent is subject to a terminal disclaimer.

(21) Appl. No.: 10/919,805

(22) Filed: Aug. 17, 2004

(65) Prior Publication Data

US 2005/0058928 A1 Mar. 17, 2005

(30) Foreign Application Priority Data

| | | |
|---|---|---|
| Aug. 20, 2003 | (JP) | P.2003-207987 |
| Aug. 20, 2003 | (JP) | P.2003-207989 |
| Oct. 6, 2003 | (JP) | P.2003-346613 |
| Oct. 6, 2003 | (JP) | P.2003-346619 |

(51) Int. Cl.
*G03G 9/08* (2006.01)

(52) U.S. Cl. ..... 430/123.5; 430/123.56; 430/111.4; 430/111.41

(58) Field of Classification Search ..... 430/120, 430/111.4, 111.41, 123.5, 123.56
See application file for complete search history.

(56) References Cited

U.S. PATENT DOCUMENTS 7,041,423 B2 * 5/2006 Kunugi et al. ..... 430/120

FOREIGN PATENT DOCUMENTS

| | | |
|---|---|---|
| JP | 63-276064 | 11/1988 |
| JP | 05-188757 | 7/1993 |
| JP | 05-297631 | 11/1993 |
| JP | 10-254167 | 9/1998 |
| JP | 2001-027822 | 1/2001 |
| JP | 2001-149850 | 6/2001 |

* cited by examiner

*Primary Examiner*—Mark A. Chapman
(74) *Attorney, Agent, or Firm*—Hogan & Hartson LLP

(57) ABSTRACT

The present invention provides a developing process including the steps of charging toner particles supported on a developer carrier; and providing the charged toner particles to an electrostatic latent image formed on an image carrier, wherein, the charged toner particles satisfy formulas (1) and (2) shown below, when being measured by the laser doppler method in an oscillation field in an acoustic alleviation cell to determine individual particle size and charged amount thereof:

$$k1=(B2-B1)/(A1-A2)<2/3 \quad (1)$$

$$B2<0 \quad (2)$$

wherein A1 [μm] and B1 [fC] represent the particle size and the charged amount of the charged toner particle in the division that has the largest number proportion in the distribution divided by the measured particle size and the measured charged amount, respectively; A2 [μm] represents the particle size in the division that has the smallest particle size in the particle size distribution, provided that the number proportion of the division is 1% or more; and B2 [fC] represents the charged amount in the division that has the largest number proportion along the particle size divisions of A2.

4 Claims, 27 Drawing Sheets
(20 of 27 Drawing Sheet(s) Filed in Color)

DEVELOPING PROCESS AND IMAGE FORMING PROCESS

FIELD OF THE INVENTION

The present invention relates to a developing process and an image forming process, more particularly to a developing process and an image forming process that are effected in image formation by an electrostatic latent image developing process for use in, e.g., printer and copying machine.

BACKGROUND OF THE INVENTION

In the electrostatic latent image process, an image is completed by forming an image on a photoreceptor by a charge property of individual toner particle, and then transferring the image onto a transfer material. It is thus known that the properties of the toner have a great effect on the image formation. However, the presence of defective toner particles that cannot be completely controlled in charge property cause disadvantages such as scattering, fogging and background stain. The occurrence of defective toner particles is attributed to insufficient charging and uneven charging caused by the variation of particle size or shape of toner particles.

As an image forming process involving the control over the particle size of the toner particles, there has been proposed an image forming process involving the use of a toner having: a weight-average particle size of from 4 to 11 μm; and a particle size distribution of from 3 to 15% by number of toner particles having a particle size of from 2.00 to 4.00 μm, from 8 to 19% by number of toner particles having a particle size of from 4.00 to 5.04 μm and 10% or less by volume of toner particles having a particle size of 12.7 μm or more (see, e.g., Reference 1). However, this proposal for image forming process merely defines the particle size of the toner particles to be used and has neither disclosure nor suggestion of charge property of each particle.

Since the sum of charged amount on the basis of the weight of the aggregation of toner particles has merely considered as the charged amount thereof, it has not been made possible to control the charged amount of individual toner particles. Therefore, the toner particles are attached to the edge (end portion) of the latent image more than to the center of the latent image, causing an edge effect that the development density rises more at the edge of the latent image than at the center of the latent image.

Also, there is a tendency in toner design that the particle size of individual toner particles are uniform as much as possible to have a sharp particle size distribution and control is made such that when the toner particle are charged, the charged amount of individual toner particles is uniform. For example, Reference 2 proposes a toner arranged such that the ratio of the volume-average particle size [μm] to the number-average particle size [μm] of toner particles is from 1.0 to 1.2 as determined by a coulter counter and the volume-average particle size of toner particles is from 3 to 25 μm. A toner having a relatively sharp particle size distribution shows a good uniformity in charge property and contains less particles having an opposite polarity, making it possible to eliminate the occurrence of fogging or scattering.

However, since the sum of charged amount on the basis of the weight of the aggregation of toner particles has merely considered as the charged amount thereof, it has not been made possible to control the charged amount of individual toner particles. As a result, during the reproduction of dot, toner particles which have been charged somewhat uniformly (i.e., toner particles having almost the same charged amount) can repel each other, causing "scattering" and hence causing uneven dot reproducibility.

Further, for controlling the charged amount of toner particles, there has been proposed a developing process which comprises friction-charging a developer at the contact area of a developer feeding member and a developer carrier which are moving on the surface thereof in the same direction, supporting the toner particles thus charged on the developer carrier, bringing the surface of the developer carrier on which the friction-charged developer is supported into sliding contact with a developer layer-forming member by which a developer has been retained by a minute electric field on the surface thereof to form a development layer free of unevenness, and then conveying the developer layer on the developer carrier to the position opposing an electrostatic latent image carrier (see Reference 3). It is proposed that this developing process can eliminate the amount of uncharged toner particles to provide a sharp distribution of charged amount (see, e.g., FIG. 5 of Reference 3).

[Reference 1]
JP-A-5-297631

[Reference 2]
JP-A-63-276064

[Reference 3]
JP-A-5-188757

In the related art, since the sum of charged amount on the basis of the weight of the aggregation of toner particles has merely considered as the charged amount thereof, the charged amount of the individual toner particles cannot be controlled. Accordingly, it has been made difficult to make an effective countermeasure against disadvantages of uneven image quality such as white blanks and edge effect. The term "white blanks" as used herein is meant to indicate a phenomenon that the central part of an image such as line image becomes white. This phenomenon occurs when a high pressure is applied to the central part to which a greater amount of toner particles are attached during transfer from the photoreceptor, causing the aggregation of the toner particles at the central part and hence making it impossible to transfer the toner particles. The term "edge effect" as used herein is meant to indicate a phenomenon that when a greater amount of toner particles having a relatively great particle size are attached to the edge (end portion) subject to stronger electric field than the center of the latent image in a patch pattern (in the case where a square is formed by a solid image or halftone image) or the like, the development density is higher at the edge than at the center of the latent image. Both the "white blanks" and "edge effect" occur when there occurs uneven development density in the latent image region.

In the related art, since the sum of charged amount on the basis of the weight of the aggregation of toner particles has merely considered as the charged amount thereof as described in Reference 3, the charged amount of the individual toner particles cannot be controlled. Accordingly, it has been made difficult to make an effective countermeasure against disadvantages of defective image quality called starvation. "Starvation" is a phenomenon that no toner particles are supplied into the area adjacent to e.g., solid image, line image or letters during the printing of a halftone image, causing the reduction of density at this area. This phenomenon occurs remarkably in a gradation priority mode in particular. This phenomenon occurs when toner particles are swept into areas having a high printing duty such as line during development step, making it impossible to develop the adjacent sites.

It is theoretically possible that development and image formation should be fairly conducted by the use of a toner having a constant ratio of charged amount to weight of the toner, that is, ideal charge property as in the related art. In actuality, however, the occurrence of defective toner particles that cannot be completely controlled in their charged amount unavoidably causes disadvantages such as starvation.

The invention has been worked out in view of these disadvantages. An object of the invention is to provide a developing process capable of providing a uniform development density free of unevenness over the entire latent image and an image forming process.

Also, other object of the invention is to provide a developing process and an image forming process capable of controlling disadvantages such as eliminating defective dot formation, scattering, fogging and background stain.

Further, other object of the invention is to provide a developing process and an image forming process capable of providing a high quality image without causing starvation in the formation of a halftone image or the like.

SUMMARY OF THE INVENTION

In order to accomplish the objects, the first embodiment of the first aspect of the invention (hereinafter referred to as "first invention") concerns a developing process comprising the steps of: charging toner particles supported on a developer carrier by regulating with a regulating member under pressure so as to obtain charged toner particles; and providing the charged toner particles to an electrostatic latent image formed on an image carrier so as to visualize the latent image as a toner image, wherein, the charged toner particles satisfy formulas (1) and (2) shown below, when being measured by the laser doppler method in an oscillation field in an acoustic alleviation cell to determine individual particle size and charged amount thereof:

$$k1=(B2-B1)/(A1-A2)<2/3 \quad (1)$$

$$B2<0 \quad (2)$$

wherein A1 [μm] and B1 [fC] represent the particle size and the charged amount of the charged toner particle in the division (herein after referred to as "particle size divisional value" and "electrostatic charge divisional value", respectively) that has the largest number proportion in the distribution divided by the measured particle size and the measured charged amount, respectively; A2 [μm] represents the particle size in the division that has the smallest particle size in the particle size distribution, provided that the number proportion of the division is 1% or more; and B2 [fC] represents the charged amount in the division that has the largest number proportion along the particle size divisions of A2.

In order to inhibit the edge effect in the developing process which comprises regulating a toner under pressure with a regulating member, and then providing the toner to an electrostatic latent image formed on an image carrier so as to visualize the latent image as a toner image, it is important that toner particles having a smaller particle size than the particle size divisional value A1 [μm] are certainly charged.

In the developing process of the first invention, since toner particles having a small particle size are also certainly charged, the edge effect can be inhibited by using these small particle size toner particles in the development of the edge (end portion) having a strong electric field. In other words, in the first invention, since small particle size toner particles can be selectively used, even if the charged amount at the edge that compensates the potential difference of latent image is the same, the same charge can be compensated by a less amount of toner. As a result, the amount of the toner required for the edge can be reduced, making it possible to perform development with a uniform density free of unevenness from edge to central area. Further, the occurrence of oppositely charged toner particles can be minimized, making it possible to eliminate disadvantages such as fogging.

The second embodiment of the first invention concerns the developing process according to the first embodiment, wherein the charged toner particles further satisfy that the sum (k2) of the number proportions of particle size divisions smaller than A1 is 35% or more. In accordance with the aforementioned feature, small particle size toner particles can be certainly supplied to the edge (end portion) of the electrostatic latent image, making it possible to inhibit the edge effect more certainly and effectively.

The third embodiment of the first invention concerns an image forming process comprising the step of transferring the toner image visualized on the image carrier by the developing process according to first or second embodiment.

In accordance with the aforementioned feature, image formation can be effected under the conditions that the edge effect is inhibited as much as possible by the developing process of the aforementioned first and second embodiments, making it possible to certainly inhibit the rise of the temperature of the edge and hence obtain an image having a uniform development density free of unevenness. Further, disadvantages such as fogging can be eliminated, making it possible to form a good image.

In order to accomplish the object, the first embodiment of the second aspect of the invention (hereinafter referred to as "second invention") concerns a developing process comprising the steps of: negatively charging toner particles supported on a developer carrier by regulating with a regulating member under pressure so as to obtain negatively charged toner particles; and providing the negatively charged toner particles to an electrostatic latent image formed on an image carrier so as to visualize the latent image as a toner image, wherein, the negatively charged toner particles satisfy formulas (3), (4) and (5) shown below, when being measured by the laser doppler method in an oscillation field in an acoustic alleviation cell to determine individual particle size and charged amount thereof:

$$B>1/2\times A \quad (3)$$

$$|B\max|<2/3\times A \quad (4)$$

$$B\min\leqq 0.25 \quad (5)$$

wherein A [mm] represents the center value in the particle size distribution; B [fC] represents the width of the charged amount distribution therein; Bmax [fC] represents the maximum value of the charged amount therein; and Bmin [fC] represents the minimum value of the charged amount therein.

In the developing process mentioned above, it is important to know the relationship between the distribution of charged amount and the distribution of particle size of an aggregate of toner particles, the relationship between the maximum charged amount and the distribution of particle size of the aggregate of toner particles and the minimum charged amount of the aggregate of toner particles. As can be seen in the examples described later, when control is made such that the formulas 3 to 5 are satisfied, the toner which has been regulated under pressure by the regulating member has some dispersion in the charged amount, making it possible to solve disadvantages such as defective formation of dots, scattering, fogging and background stain. Since the toner particles are "negatively" charged in this embodiment, the "maximum value Bmax of charged amount" is meant to indicate the value of the electrostatic charge of the most negatively charged particle and the "minimum value Bmin of charged amount" is meant to indicate the value of the electrostatic charge of the least negatively charged particle or the value of the electrostatic charge of the most positively charged particle, if there are included oppositely charged toner particles (positively charged toner particles in this case).

The second embodiment of the second invention concerns A developing process comprising the steps of: positively charging toner particles supported on a developer carrier by regulating with a regulating member under pressure so as to obtain positively charged toner particles; and providing the positively charged toner particles to an electrostatic latent image formed on an image carrier so as to visualize the latent image as a toner image, wherein, the positively charged toner particles satisfy formulas (6), (7) and (8) shown below, when being measured by the laser doppler method in an oscillation field in an acoustic alleviation cell to determine individual particle size and charged amount thereof:

$$B > \tfrac{1}{2} \times A \quad (6)$$

$$B\max < \tfrac{2}{3} \times A \quad (7)$$

$$|B\min| \leqq 0.25 \quad (8)$$

wherein A [mm] represents the center value in the particle size distribution; B [fC] represents the width of the charged amount distribution; Bmax [fC] represents the maximum value of the charged amount therein; and Bmin [fC] represents the minimum value of the charged amount therein.

In the developing process mentioned above, it is important to known the relationship between the distribution of charged amount and the distribution of particle size of an aggregate of toner particles, the relationship between the maximum charged amount and the distribution of particle size of the aggregate of toner particles and the minimum charged amount of the aggregate of toner particles. As can be seen in the examples described later, when control is made such that the formulas 6 to 8 are satisfied, the toner which has been regulated under pressure by the regulating member has some dispersion in the charged amount, making it possible to solve disadvantages such as defective formation of dots, scattering, fogging and background stain. Since the toner particles are "positively" charged, the "maximum value Bmax of charged amount" is meant to indicate the value of the electrostatic charge of the most positively charged particle and the "minimum value Bmin of charged amount" is meant to indicate the value of the electrostatic charge of the least positively charged particle or the value of the electrostatic charge of the most negatively charged particle, if there are included oppositely charged toner particles (negatively charged toner particles in this case).

The third embodiment of the second invention concerns the developing process according to first or second embodiment, wherein the charged toner particles further satisfy the following formula (9):

$$A\max - A\min < A \quad (9)$$

wherein Amax [mm] represents the maximum value of particle size therein; and Amin [mm] represents the minimum value of particle size therein.

In the related art process which cannot control the charged amount of individual toner particles, when the particle size of the toner particles is uniform, the individual toner particles are similarly charged, making the charged amount uniform. As a result, "scattering" due to repulsion of the toner particles by each other can easily occur. However, even when the particle size of the toner particles is so uniform that the formula 9 is satisfied, the developing process of the second invention can make the charged amount of the toner particles dispersed, making it possible to exert the same effect as in the first and second embodiments.

The fourth embodiment of the second invention concerns an image forming process comprising the step of transferring a toner image visualized on an image carrier by the developing process according to first to third embodiments.

In accordance with the feature of the fourth embodiment, image formation can be effected with a toner having some dispersion in the charged amount by a developing process according to any one of the first to third embodiments, making it possible to solve disadvantages such as defective formation of dots, scattering, fogging and background stain and hence form a good quality image.

The first embodiment of the third aspect of the invention (hereinafter referred to as "third invention") concerns a developing process comprising the steps of: charging toner particles supported on a developer carrier by regulating with a regulating member under pressure so as to obtain charged toner particles; and providing the charged toner particles to an electrostatic latent image formed on an image carrier so as to visualize the latent image as a toner image, wherein, the charged toner particles satisfy formulas (10) and (11) shown below, when being measured by the laser doppler method in an oscillation field in an acoustic alleviation cell to determine individual particle size and charged amount thereof:

$$(B3 - B1)/(A3 - A1) > -1 \quad (10)$$

$$B3 < 0 \quad (11)$$

wherein A1 [μm] and B1 [fC] represent the particle size and the charged amount of the charged toner particle in the division that has the largest number proportion in the distribution divided by the measured particle size and the measured charged amount, respectively; A3 [mm] represents the particle size in the division that has the largest particle size in the particle size distribution, provided that the number proportion of the division is 1% or more; and B3 [fC] represents the charged amount in the division that has the largest number proportion along the particle size divisions of A3.

In accordance with the developing process of the first embodiment, when control is made such that the aforementioned formulas 10 and 11 are satisfied, development can be conducted without causing disadvantages such as white blanks and fogging.

Individual toner particles having different particle sizes or amounts of electrostatic charge receive different forces from electric field and move at different velocities during development. In general, the greater the charged amount is, the greater is the force the toner particles receive from electric field. On the other hand the greater the particle size of the toner particles is, the lower is the moving velocity of the toner particles. The developing process of the third invention is arranged such that toner particles having a relatively small charged amount and a relatively great particle size are selectively concentrated at areas that receive a weak electric field (e.g., edge of latent image corresponding to line image or center of patch pattern). In other words, by satisfying the formula 10, toner particles having a great particle size can be selectively concentrated at the edge of a line image for example, making it possible to inhibit the concentration of toner particles to the center of the latent image and the rise of the toner thickness which cause white blanks and hence allowing uniform development over the entire region of the latent image. Further, when the formula 11 is satisfied, the amount of oppositely charged toner particles can be minimized, making it possible to solve disadvantages such as fogging and toner scattering.

The second embodiment of the third invention concerns the developing process according to the first embodiment, wherein the charged toner particles further satisfy the following formula (12):

$$(B2-B1)/(A2-A1)>-2/3 \quad (12)$$

wherein A2 [μm] represents the particle size in the division that has the smallest particle size in the particle size distribution; provided that the number proportion of the division is 1% or more; and B2 [fC] represents the charged amount in the division that has the largest number proportion along the particle size divisions of A2.

In accordance with the developing process of the second embodiment, when the formula 12 is satisfied, small particle size toner particles can be certainly charged. Accordingly, when these small particle size toner particles are used to develop the areas that receive a strong electric field (center of latent image corresponding to line image or edge of latent image corresponding to patch pattern image), the edge effect can be inhibited. In some detail, during the development of the latent image corresponding to the patch pattern image, even when the charged amount at the edge which compensates the potential difference of latent image is the same, the same charged amount can be compensated by less amount of toner by positively attaching sufficiently charged small particle size toner particles to the edge. As a result, the rise of the toner thickness at the edge can be inhibited, allowing development with a uniform density free of unevenness from edge to center. In the second embodiment, when both the formulas 10 and 12 are satisfied, uniform development can be conducted with less unevenness over the entire region of the latent image.

The third embodiment of the third invention concerns an image forming process comprising the step of transferring a toner image visualized on an image carrier by the developing process according to first or second embodiment.

In accordance with the third embodiment, toner particles are uniformly attached to the entire region of the latent by the developing process of the first or second embodiment. As a result, unevenness in the image density due to white blanks or edge effect can be inhibited, making it possible to form an image with a uniform density free of unevenness. Further, fogging can be inhibited, making it possible to realize good image formation.

The first embodiment of the fourth aspect of the invention (hereinafter referred to as "fourth invention") concerns a developing process comprising the steps of: charging toner particles supported on a developer carrier by regulating with a regulating member under pressure so as to obtain charged toner particles; and providing the charged toner particles to an electrostatic latent image formed on an image carrier so as to visualize the latent image as a toner image, wherein, the charged toner particles satisfy formula (13) shown below, when being measured by the laser doppler method in an oscillation field in an acoustic alleviation cell to determine individual particle size and charged amount thereof:

$$(B2-B1)/(A2-A1)<1 \quad (13)$$

wherein A1 [μm] and B1 [fC] represent the particle size and the charged amount of the charged toner particle in the division that has the largest number proportion in the distribution divided by the measured particle size and the measured charged amount, respectively; A2 [μm] represents the particle size in the division that has the smallest particle size in the particle size distribution, provided that the number proportion of the division is 1% or more; and B2 [fC] represents the charged amount in the division that has the largest number proportion along the particle size divisions of A2.

In accordance with the developing process of the first embodiment, when control is made such that the aforementioned formula 13 is satisfied, development can be conducted without causing disadvantages such as starvation.

In other words, in accordance with the developing process of the fourth invention, the aforementioned disadvantage can be solved by positively increasing the charged amount of toner particles having a greater particle size than those in the division (peak) where there is the largest number proportion of the toner particles in the distribution defined by particle size and charged amount. Individual toner particles having different particle sizes or amounts of electrostatic charge receive different forces from electric field and move at different velocities during development. In general, the greater the charged amount is, the greater is the force the toner particles receive from electric field. On the other hand, the greater the particle size of the toner particles is, the lower is the moving velocity of the toner particles. When the charged amount of toner particles having a great particle size (=toner particles having a great weight) is raised to increase the flying speed thereof, both the momentum and kinetic energy thereof are raised, making themselves little subject to the effect of sweeping. Thus, starvation can be prevented.

The second embodiment of the fourth invention concerns an image forming comprising the step of transferring the toner image visualized on the image carrier by the developing process according to first embodiment.

In accordance with the second embodiment of the fourth invention, starvation can be inhibited by the developing process of the first embodiment. As a result, the formation of an image such as halftone image can be fairly conducted.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF THE INVENTION

Figure 1:
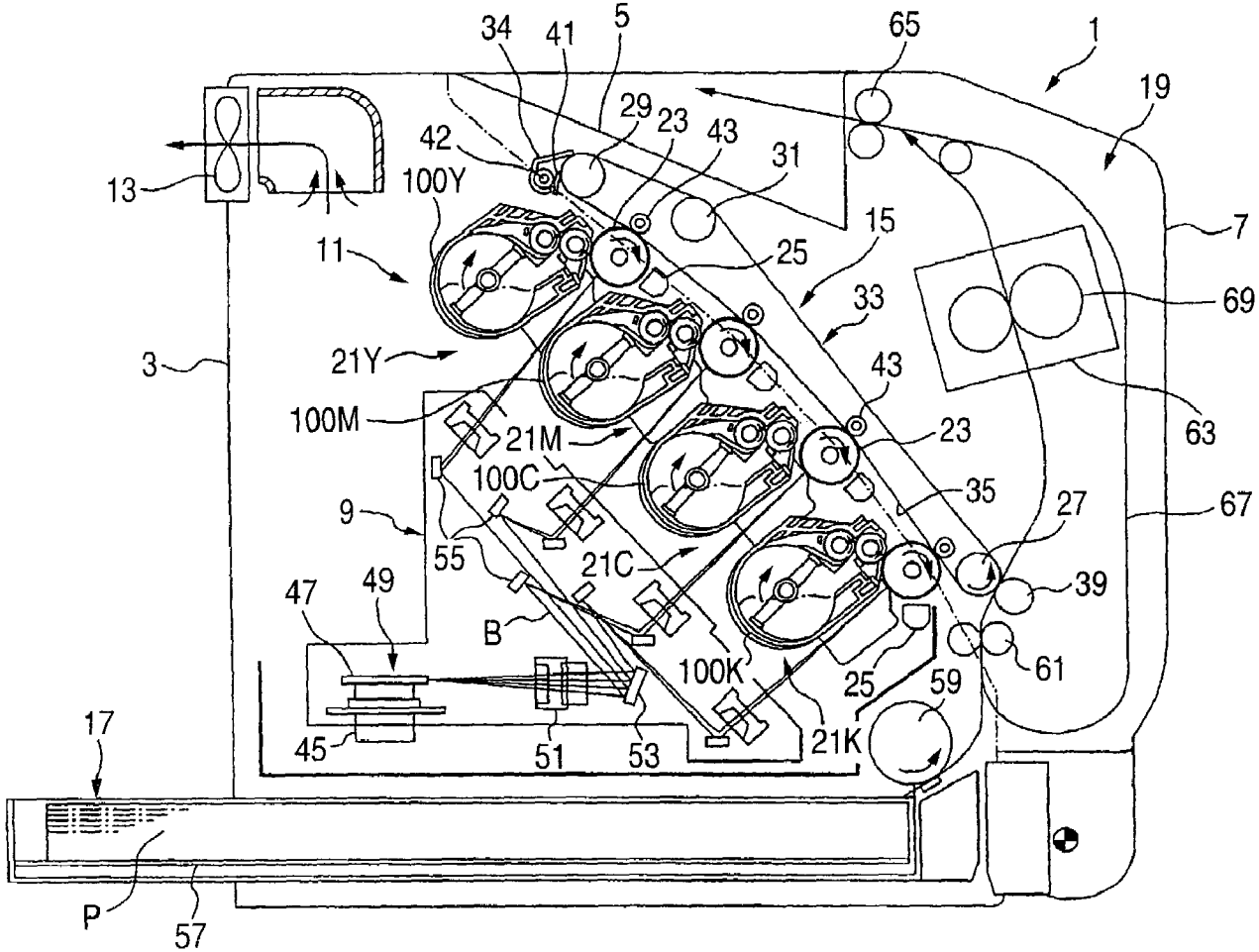
FIG. 1 is drawing illustrating an example of an image forming device which can be used in the developing process of the invention.

The developing process of the first invention is performed as a developing process comprising the steps of: charging toner particles supported on a developer carrier by regulating with a regulating member under pressure so as to obtain charged toner particles; and an electrostatic latent image formed on an image carrier so as to visualize the latent image as a toner image, wherein, the charged toner particles satisfy formulas (1) and (2) shown below, when being measured by the laser doppler method in an oscillation field in an acoustic alleviation cell to determine individual particle size and charged amount thereof:

$$k1=(B2-B1)/(A1-A2)<2/3 \quad (1)$$

$$B2<0 \quad (2)$$

wherein A1 [μm] and B1 [fC] represent the particle size and the charged amount of the charged toner particle in the division that has the largest number proportion in the distribution divided by the measured particle size and the measured charged amount, respectively; A2 [μm] represents the particle size in the division that has the smallest particle size in the particle size distribution, provided that the number proportion of the division is 1% or more; and B2 [fC] represents the charged amount in the division that has the largest number proportion along the particle size divisions of A2.

In addition, it is preferable that the sum (k2) of the number proportions of particle size divisions smaller than the particle size visional value A1 is more than 0%, more preferably 35% or more.

Further, an image forming process comprising the step of transferring the toner image visualized on the image carrier by the developing process according the embodiments mentioned above is preferable.

The developing process of the second invention is performed as a developing process comprising the steps of: negatively charging toner particles supported on a developer carrier by regulating with a regulating member under pressure so as to obtain negatively charged toner particles; and providing the negatively charged toner particles to an electrostatic latent image formed on an image carrier so as to visualize the latent image as a toner image, wherein, the negatively charged toner particles satisfy formulas (3), (4) and (5) shown below, when being measured by the laser doppler method in an oscillation field in an acoustic alleviation cell to determine individual particle size and charged amount thereof:

$$B>1/2\times A \quad (3)$$

$$|B\mathrm{max}|<2/3\times A \quad (4)$$

$$\mathrm{Bmin}\leqq 0.25 \quad (5)$$

wherein A [mm] represents the center value in the particle size distribution; B [fC] represents the width of the charged amount distribution therein; Bmax [fC] represents the maximum value of the charged amount therein; and Bmin [fC] represents the minimum value of the charged amount therein.

In addition, it is preferable that the charged toner particles further satisfy the following formula (9):

$$A\mathrm{max}-A\mathrm{min}<A \quad (9)$$

wherein Amax [mm] represents the maximum value of particle size therein; and Amin [mm] represents the minimum value of particle size therein.

The second invention can be implemented also in a developing process including the process of positively charging toner particles. In this case, the developing process of the second invention is performed as a developing process comprising the steps of: positively charging toner particles supported on a developer carrier by regulating with a regulating member under pressure so as to obtain positively charged toner particles; and providing the positively charged toner particles to an electrostatic latent image formed on an image carrier so as to visualize the latent image as a toner image, wherein, the positively charged toner particles satisfy formulas (6), (7) and (8) shown below, when being measured by the laser doppler method in an oscillation field in an acoustic alleviation cell to determine individual particle size and charged amount thereof:

$$B > \frac{1}{2} \times A \quad (6)$$

$$B\max < \frac{2}{3} \times A \quad (7)$$

$$|B\min| \leqq 0.25 \quad (8)$$

wherein A [mm] represents the center value in the particle size distribution; B [fC] represents the width of the charged amount distribution; Bmax [fC] represents the maximum value of the charged amount therein; and Bmin [fC] represents the minimum value of the charged amount therein.

In addition, in the developing process containing the process of positively charging toner particles, it is also preferable that the charged toner particles further satisfy the aforementioned formula (9).

Further, an image forming process comprising the step of transferring the toner image visualized on the image carrier by the developing process according the embodiments mentioned above is preferable.

The developing process of the invention is performed as a developing process comprising the steps of: charging toner particles supported on a developer carrier by regulating with a regulating member under pressure so as to obtain charged toner particles; and providing the charged toner particles to an electrostatic latent image formed on an image carrier so as to visualize the latent image as a toner image, wherein the charged toner particles satisfy formulas (10) and (11) shown below, when being measured by the laser doppler method in an oscillation field in an acoustic alleviation cell to determine individual particle size and charged amount thereof:

$$(B3-B1)/(A3-A1) > -1 \quad (10)$$

$$B3 < 0 \quad (11)$$

wherein A1 [μm] and B1 [fC] represent the particle size and the charged amount of the charged toner particle in the division that has the largest number proportion in the distribution divided by the measured particle size and the measured charged amount, respectively; A3 [mm] represents the particle size in the division that has the largest particle size in the particle size distribution, provided that the number proportion of the division is 1% or more; and B3 [fC] represents the charged amount in the division that has the largest number proportion along the particle size divisions of A3.

In accordance with the developing process and image forming process of the third invention, when control is made during development such that the relationship between the particle size and the charged amount measured by the aforementioned measurement method satisfies the aforementioned formula 10, a good quality image can be formed without causing white blanks. Further, when the formula 11, is also satisfied, the occurrence of fogging due to the presence of toner particles having an opposite polarity can be inhibited.

In addition, it is preferable that the charged toner particles further satisfy the following formula (12):

$$(B2-B1)/(A2-A1) > -\frac{2}{3} \quad (12)$$

wherein A2 [μm] represents the particle size in the division that has the smallest particle size in the particle size distribution; provided that the number proportion of the division is 1% or more; and B2 [fC] represents the charged amount in the division that has the largest number proportion along the particle size divisions of A2. In this case, the rise of density at the end portion due to edge effect can be inhibited. Accordingly, under the conditions that all the formulas 10 to 12 are satisfied, development and image formation can be conducted with little fogging without causing density unevenness.

Further, an image forming process comprising the step of transferring a toner image visualized on an image carrier by the developing process according to the above embodiment is preferable.

The developing process of the fourth invention is performed as a developing process comprising the steps of: charging toner particles supported on a developer carrier by regulating with a regulating member under pressure so as to obtain charged toner particles; and providing the charged toner particles to an electrostatic latent image formed on an image carrier so as to visualize the latent image as a toner image, wherein the charged toner particles satisfy formulas (13) shown below, when being measured by the laser doppler method in an oscillation field in an acoustic alleviation cell to determine individual particle size and charged amount thereof:

$$(B2-B1)/(A2-A1) < -1 \quad (13)$$

wherein A1 [μm] and B1 [fC] represent the particle size and the charged amount of the charged toner particle in the division that has the largest number proportion in the distribution divided by the measured particle size and the measured charged amount, respectively; A2 [μm] represents the particle size in the division that has the smallest particle size in the particle size distribution, provided that the number proportion of the division is 1% or more; and B2 [fC] represents the charged amount in the division that has the largest number proportion along the particle size divisions of A2.

Further, an image forming process which comprising the step of transferring the toner image visualized on the image carrier by the developing process according to the above embodiment is preferable.

In accordance with the developing process and image forming process of the fourth invention, when control is made during development such that the relationship between the particle size and the charged amount measured by the aforementioned measurement method satisfies the aforementioned formula 13, a good quality image can be formed without causing starvation.

The particle size and charged amount of the toner are measured by a laser doppler method in an oscillation field in an acoustic alleviation cell. A laser doppler method is a known method which measures the velocity of a moving body by the use of a phenomenon that the frequency of light beam reflected by the moving body when it is irradiated with laser beam changes in proportion to the velocity of the moving body (doppler effect). In the invention, by using the laser doppler method to measure the velocity of particles in an acoustic field or the angle of phase lag of movement of particles relative to movement of base, the aerodynamic particle size (particle size of sphere having the same sedimentation rate as particle per unit density) and the charged amount of particle are determined. The measurement of the particle size and charged amount by the laser doppler method can be carried out by the use of any commercially available measuring instrument. Preferred examples of the measuring instrument include a Type EST-3 E-Spart Analyzer (trade name) model (produced by HOSOKAWA MICRON CORPORATION). In the measurement using E-Spart Analyzer, a particulate toner as a sample is dropped across two sheets of electrodes having opposite polarities. The particulate toner that has thus been charged moves toward one of the electrodes under the action of electric field developed by the electrodes. When these electrodes are acoustically oscillated, the toner particles, too, are oscillated while being attracted by the electrode. By measuring the movement of the toner particles toward the electrode and the oscillation of the toner particles at the same time by the laser doppler method, the particle size and the charged amount of the particulate toner are calculated.

In some detail, the toner particles that have entered the measuring instrument from its inlet receive air oscillation developed by acoustic effect to undergo oscillation with a phase lag due to its inertia. The greater the size of the particle is, the greater is the phase lag. Therefore, by measuring this phase lag, the particle size of the particle can be determined. Further, the charged amount possessed by the particle can be calculated from the velocity of movement of the particle to the electrode and the particle size of the particle.

In the case where this E-Spart Analyzer is used to measure the toner particles, the conditions of measurement and operation are preferably fixed during measurement because the results can be varied with the conditions of measurement, operation, etc.

In the developing process of the first invention, control is made such that when the individual toner particles are measured for particle size and charged amount by the aforementioned measuring method, the formula (k1) among the particle size divisional value A1 [μm] and the charged amount divisional value B1 [fC] in the division where there is the largest number proportion of the toner particles, the particle size divisional value A2 [μm] where the particulate toner has the smallest particle size in the particle size distribution indicating that the number proportion of the toner particles is 1% or more and the charged amount divisional value B2 [fC] where there is the largest number proportion of the toner particles when the particle size division is A2 defined above satisfies the aforementioned formula 1 and the charged amount divisional value B2 satisfies the aforementioned formula 2.

When control is made such that the charged toner particles satisfy the aforementioned formulas 1 and 2, it is presumed that not only large particle size toner particles but also small particle size toner particles have been certainly charged. Thus, the individual toner particles can be controlled for charged amount with a higher precision compared with the related art method involving the control over the charged amount of toner particles as an aggregate [considered to be (total charged amount/total weight of toner particles)]. Accordingly, by selectively concentrating small particle size toner particles onto the edge having a strong electric field, problems such as edge effect and fogging can be eliminated.

In addition to the aforementioned requirements represented by the formulas 1 and 2, it is preferable that the sum (k2) of the number proportions of particle size divisions smaller than the particle size visional value A1 where there is the largest number proportion of the toner particles is more than 0%, more preferably 35% or more. In this case, it is presumed that toner particles having a smaller particle size than that of the division where there is the largest number proportion of the toner particles have been electrostatically charged. Accordingly, these small particle size toner particles can be sufficiently supplied to the edge (end portion) of the latent image, making it possible to inhibit the edge effect more effectively.

In the developing process of the second invention, when the individual toner particles which have been negatively charged are measured by the aforementioned measurement method, control is made such that the center value A [μm] in the particle size distribution, the width B [fC] of the charged amount distribution, the maximum value Bmax [fC] of the charged amount and the minimum value Bmin [fC] of the charged amount satisfy the aforementioned formulas 3 to 5.

It is presumed that when control is made such that the charged toner particles satisfy the aforementioned formulas 3 to 5, there occurs some dispersion in the charged amount with respect to particle size (coexistence of particles having a great charged amount and particles having a small charged amount). Accordingly, as compared with the related art process involving the control over the charged amount of aggregate of toner particles as a whole [considered to be (sum of charged amount)/(weight of aggregate of toner particles)], the developing process of the second invention allows high precision control over the charged amount of individual toner particles. By arranging such that toner particles having a great charged amount are selectively disposed at the center of dot and toner particles having a small charged amount are disposed surrounding them during the reproduction of dot, problems such as scattering can be solved, making it possible to clearly reproduce the dot.

In addition to the aforementioned formulas 3 to 5, it is preferable that control is made such that the relationship between the maximum value Amax [μm] of particle size and the minimum value Amin [μm] of particle size satisfies the aforementioned formula 9. In accordance with the related art developing process involving the control over the charged amount of aggregate of toner particles as a whole [considered to be (sum of charged amount)/(weight of aggregate of toner particles)], the more uniform the particle size of the toner particles is to satisfy the aforementioned formula 9, the more difficult can be controlled the charged amount. However, in accordance with the developing process of the second invention, even when the particle size of the toner particles is so uniform that the aforementioned formula 9 is satisfied, the charged amount of the individual toner particles can be somewhat dispersed, making it possible to clearly reproduce the dot.

In accordance with the developing process and image forming process of the third invention, when control is made during development such that the relationship between the particle size and the charged amount measured by the aforementioned measurement method satisfies the aforementioned formula 10, a good quality image can be formed without causing white blanks. Further, when the formula 11, too, is satisfied, the occurrence of fogging due to the presence of toner particles having an opposite polarity can be inhibited.

In addition to the aforementioned formulas 1 and 2, when development is effected in such a manner that the relationship between the particle size divisional value A2 [μm] where the particulate toner has the smallest particle size in the particle size distribution indicating that the number proportion of the toner particles is 1% or more and the charged amount divisional value B2 [fC] where there is the largest number proportion of the toner particles when the particle size division is A2 defined above satisfies the following formula 12:

$$(B2-B1)/(A2-A1)>-2/3 \qquad 12$$

the rise of density at the end portion due to edge effect can be inhibited. Accordingly, under the conditions that all the formulas 10 to 12 are satisfied, development and image formation can be conducted with little fogging without causing density unevenness.

In accordance with the developing process and image forming process of the fourth invention, when control is made during development such that the relationship between the particle size and the charged amount measured by the aforementioned measurement method satisfies the aforementioned formula 13, a good quality image can be formed without causing starvation.

In the invention, "particle size distribution" and "charged amount distribution" are evaluated by data in the particle size division and the charged amount division containing a predetermined number of toner particles as a ratio to the total number of toner particles. This is because it is impossible to completely control all the large number of toner particles. Further, it is unavoidable that uncontrollable toner particles are included in the aggregate of toner particles. Thus, it is improper to grasp the particle size distribution and the charged amount distribution without taking into account the charge property of these uncontrollable toner particles. Accordingly, in the invention, "particle size distribution" and "charged amount distribution" are determined by particle size-charged amount division defined by particle size division every 0.5 μm and charged amount division every 0.5 fC (see, e.g., FIG. 1).

In the process of the invention, by properly adjusting various factors that are normally taken into account in the design of toner or the design of developing apparatus, control can be made such that the charged amount and the particle size of the toner that has been regulated under pressure by a regulating member satisfy the aforementioned formulas. Examples of the factors in the design of toner include (1) kind, resin composition and shape of toner mother particles, and (2) kind and amount of external additives. Examples of the factors in the design of developing machine include (3) material and hardness of the surface of the development roller as developer carrier, and (4) material of regulating blade as liming member and regulating conditions (pressure), and amount of toner to be carried during the passage of regulating blade. However, it is generally difficult to unequivocally determine the relationship of the aforementioned conditions by any of the factors exemplified in Clauses (1) to (4). In other words, even when one factor is predetermined, the conditions can vary due to other factors. As a result thereof, the relationship of the aforementioned conditions may be realized. Accordingly, it is preferable to determine the various factors on an experimental basis. For this experimental procedure, it is very helpful to refer the examples of the invention described later.

Representative examples of the factors for controlling the particle size and charged amount of the toner that is an example of the "developer" to be used in the invention will be illustrated hereinafter. The particle size and charged amount can be controlled by selecting the property of the factors described below, but it should be understood that the way to control the particle size and charged amount is not to be construed as being limited thereto. The control thereof can be also made by adjusting other factors. The toner to be used in the process of the invention is not specifically limited. For example, any well-known one-component non-magnetic toner may be used.

<Toner Mother Particles>

The kind of the binder resin in the toner mother particles, particularly the polar functional group in the resin, has an effect on the charge property of the toner mother particles. Examples of the binder resin employable herein include polyester resins, styrene-acryl-based copolymers, polystyrenes, poly-α-methylstyrenes, chloropolystyrenes, styrene-chlorostyrene copolymers, styrene-propylene copolymers, styrene-butadiene copolymers, styrene-vinyl chloride copolymers, styrene-vinyl acetate copolymers, epoxy resins, urethane-modified epoxy resins, silicone-modified epoxy resins, vinyl chloride resins, rosin-modified maleic resins, phenyl resins, polyethylenes, polypropylenes, ionomer resins, silicone resins, ketone resins, ethylene-ethyl acrylate copolymers, xylene resins, polyvinyl butyral resins, terpene resins, phenol resins, urethane-urea resins, aliphatic hydrocarbon resins, and alicyclic hydrocarbon resins. In the process of the invention, one or more of these known representative binder resins may be selectively used.

The toner mother particles preferably are substantially in the form of sphere having a uniform surface structure. The dispersion of size and shape among the host particles is preferably small. The sphericity (sphericity coefficient) of the toner mother particles is preferably 0.91 or more to enhance the transferring efficiency. Further, in order to enhance the transfer efficiency and to prevent the occurrence of toner particles having opposite polarity at the same time, the sphericity is preferably controlled to be 0.95 or more. Further, the particle size of the toner mother particles is preferably from 4.0 to 7.5 μm.

The toner mother particles can be produced by a pulverization method or polymerization method. In the case where the pulverization method is used, the toner is produced by uniformly mixing a binder resin with a pigment, a releasing agent and a charge control agent using a Henschel mixer, melt-kneading the mixture through a twin-screw extruder, cooling the material, subjecting the material to coarse pulverization and fine pulverization, classifying the particles, and then adding a fluidity improver to the particles thus selected. In order to adjust the sphericity of the toner obtained by the pulverization method, conglobe treatment may be affected. When the pulverization process is affected by the use of a device capable of pulverizating the material to relatively round spheres, e.g., Turbomill (produced by Kawasaki Heavy Industries, Ltd.) known as a mechanical grinder, the resulting particles can be provided with a sphericity of up to 0.93. When the toner thus ground is subjected to processing by a commercially available hot air spherizer, such as a Type SFS-3 Therfusing System (manufactured by Nippon Pneumatic Mfg. Co., Ltd.), the resulting particles can be provided with a sphericity of up to 1.00.

Examples of the method of preparing the toner produced by polymerization method include suspension polymerization method and emulsion polymerization method. In the suspension polymerization method, a mixture of a polymerizable monomer, a coloring pigment and a release agent that are added as necessary are used. To the mixture were then added a dye, a polymerization initiator, a crosslinking agent, a charge controller, and other additives. A monomer composition having this mixture dissolved or dispersed therein is then added dropwise to an aqueous phase containing a suspension stabilizer (water-soluble polymer, difficultly water-soluble inorganic material) to cause granulation and polymerization. As a result, colored polymerized toner particles having a desired particle size can be formed.

In regard to the control of the sphericity of the polymerization toner particles in the case of emulsion polymerization method, the temperature and time at the step of aggregating secondary particles are adjusted, thereby the sphericity can freely controlled. The range of the sphericity is from 0.94 to 1.00. On the other hand, the suspension polymerization method can produce completely round toner particles and thus attains a sphericity of from 0.98 to 1.00. Further, in the suspension polymerization method, perfect spherical toner particles are obtainable, so that the sphericity ranges from 0.98 to 1.00. However, the sphericity can be freely controlled from 0.94 to 0.98 by deforming the toner particles by heating them at a temperature higher than the glass transition temperature (Tg) of the toner.

In both of the pulverization method toner and the polymerization method, it is preferable that a toner has a glass transition temperature of from 50° C. to 100° C., more preferably from 55° C. to 90° C., and a flow softening temperature of preferably from 70° C. to 140° C., more preferably from 75° C. to 130° C.

To the toner mother particles may be added a known colorant and charge controller besides the binder resin. The charge controller is not specifically limited so far as it can provide a positive or negative charge by friction. Various inorganic or organic materials may be used.

Examples of the positive charge controller employable herein include Nigrosine Base EX, quaternary ammonium salt P-51 and Nigrosine Bontron N-01 (produced by Orient Chemical Industries, Ltd.), Sudan Chief Schwarz BB (Solvent Black 3: C. I. No. 26150), Fet Schwarz HBN (C. I. No. 26150), Brilliant Spirit Schwarz TN (trade name, produced by Farben Fabrikken Bayer Inc.), Zavon Scwarz X (trade name, produced by Farberke Hoechst Inc.), alkoxylated amine, alkylamide, and molybdic acid chelate pigment.

Examples of the negative charge controller employable herein include Oil Black (C. I. No. 26150), Oil Black BY (trade name, produced by Orient Chemical Industries, Ltd.), Bontron S-22 (trade name, produced by Orient Chemical Industries, Ltd.), salicylic acid metal complex E-81 (trade name, produced by Orient Chemical Industries, Ltd.), thioindigo-based pigments, sulfonylamino derivatives of copper phthalocyanine, Spiron Black T R H (trade name, produced by HODOGAYA CHEMICAL CO., LTD.), Bontron S-34 (trade name, produced by Orient Chemical Industries, Ltd.), Nigrosine SO (trade name, produced by Orient Chemical Industries, Ltd.), Seles Scwarz (R) G (trade name, produced by Farben Fabrikken Bayer Inc.), Chromogene Scwarz ET00 (C. I. No. 14645), and Azo Oil (R) (trade name, produced by National Aniline Co., Ltd.). These charge controllers may be used singly or in combination. The amount of the charge controllers to be incorporated in the binder resin may be adjusted to a range of preferably from 0.001 to 5 parts by weight (more preferably from 0.001 to 3 parts by weight) based on 100 parts by weight of the binder resin.

<External Additives>

The external additives are also important factors for controlling the charge property of the toner. As the external additives, there may be used organic or inorganic fine powders. Examples of the organic fine powders employable herein include fluororesin powders (e.g., vinylidene fluoride powder, polytetrafluoroethylene powder), acrylic resin powders, and metal salts of fatty acid (e.g., zinc stearate, calcium stearate, lead stearate). Examples of the inorganic fine powders employable herein include metal oxides (e.g., iron oxide, aluminum oxide, titanium oxide, zinc oxide), titanium, finely divided silica powders (e.g., a silica produced by a wet process or a dry process silica), and surface-treated silicas obtained by subjecting these silicas to surface treatment with silane coupling agent, titanium coupling agent, silicon oil, etc. These external additives may be used singly or in mixture of two or more thereof. Further, it is preferable to use the mixture of a large particle size silica, a small particle size silica and a titanium as external additives. The amount of the large particle size silica, the small particle size silica and the titanium is preferably 0.1 to 2.0 wt %, 0.2 to 3.0 wt % and 0.1 to 2.0 wt % based on the weight of the toner mother particle, respectively.

<Development Roller>

As the development roller which is an example of the "developer carrier", there may be used a roller obtained by subjecting the surface of a metal pipe having a diameter of from about 16 to 24 mm to plating or blasting or a roller having an electrically-conductive elastic material layer made of NBR, SBR, EPDM, urethane rubber, silicon rubber or the like having a volume resistivity of from $10^4$ to $10^8$ Ω·cm and a hardness of from 40° to 70° (Asker A hardness) formed on the periphery of the central axis thereof. The development roller is arrangement such that a development bias voltage can be applied thereto via the shaft of the pipe or the central axis thereof. By properly selecting the material and treatment method of the development roller and the volume resistivity, hardness and other properties of the elastic material layer, the charged amount of the toner particles can be adjusted.

<Regulating Blade, Regulating Conditions, Etc.>

As the regulating blade which is an example of the "regulating member", there may be used one obtained by laminating an SUS sheet, phosphor bronze sheet, rubber plate or thin metal sheet with a rubber chip or the like. The work function on the surface of the regulating blade in contact with the toner is preferably predetermined to be from 4.8 to 5.4 eV, more preferably smaller than the work function on the surface of the toner.

Though depending also on other conditions, the pressure that is one of the regulating conditions is preferably predetermined such that thin layer regulating is conducted. In some detail, by effecting thin layer regulating involving regulation under a pressure such that the toner forms substantially one layer on the surface of the development roller under regulating conditions, the individual particle can be properly charged regardless of particle size, thereby it easy to control the charged amount. Accordingly, the regulating blade preferably presses the development, as a developer carrier, by an energizing unit such as spring or by the use of a repulsive force generated by itself as an elastic material at a linear pressure of from 25 to 50 gf/cm.

Though depending also on other conditions, the amount of the toner to be carried during the passage of the regulating blade is preferably predetermined to be from about 0.2 mg/cm$^2$ to 0.4 mg/cm$^2$. The amount of the toner to be carried is preferably predetermined depending on the particle size of the particulate toner. For example, when the particle size of the particulate toner is 5 μm, the amount of the toner to be carried is preferably adjusted to about 0.25 mg/cm$^2$. When the particle size of the particulate toner is 7 μm, the amount of the toner to be carried is preferably adjusted to about 0.35 mg/cm$^2$. Further, the conveying speed of the toner is preferably from 150 to 400 mm/sec.

The aforementioned formulas 1 to 13 can be satisfied by thus properly adjusting the various factors.

The developing devices and image forming devices that can be used in the developing process and image forming process of the invention will be described in connection with the attached drawings. The developing process of the invention can be effected either in a contact development mode or in a non-contact development mode. Firstly, the development device and image forming device employing a non-contact development mode will be described.

FIG. 1 is a typical sectional view illustrating the general configuration of an image forming device 1 of tandem type. The image forming device 1 comprises a housing 3, a paper discharge tray 5 formed above the housing 3 and a fan-shaped body 7 provided in the from the housing in such an arrangement that it can be opened and closed. Inside the housing 3 are provided an exposure unit 9, an image forming unit 11, a blowing fan 13, a transferring belt unit 15 and a paper feeding unit 17. Inside the fan-shaped body 7 is provided a paper conveying unit 19. The image forming device 1 is a so-called cleanerless image forming device free of cleaner mechanism for removing waster toner (untransferred toner) from the surface of a photosensitive drum 23.

The image forming unit 11 comprises four image forming stations 21 which can have four development devices receiving different color toners mounted therein, respectively. The four image forming stations 21 are adapted for yellow, magenta, cyan and black development devices, respectively, and are distinguished by 21Y, 21M, 21C and 21K, respectively, in the drawing. The image forming stations 21Y, 21M, 21C and 21K are each provided with a photosensitive drum 23 as an image carrier and a corona charging unit 25 and a development device 100 provided on the periphery of the photosensitive drum 23.

The transferring belt unit 15 comprises a driving roller 27 which is rotationally driven by a driving source (not shown), a follower roller 29 provided above the driving roller 27 off to the side of the driving roller 27, tension rollers 31, a middle transferring belt 33 extending between the tension rollers 31 which is driven in cycles in the counterclockwise direction as viewed on FIG. 1 and a cleaning unit 34 provided in contact with the surface of the middle transferring belt 33.

The photosensitive drum 23 is rotationally driven in the direction represented by the arrow in FIG. 1 while being pressed against the belt surface 35 along an arch line. By properly adjusting the position of the tension roller 31, the tension of the middle transferring belt 33, the curvature of the arch, etc. can be controlled.

The driving roller 27 also acts as a backup roller for a secondary transferring roller 39. On the periphery of the driving roller 27 is formed a rubber layer having a thickness of about 3 mm and a volume resistivity of $10^5$ Ω·cm or less. By grounding the rubber layer through a metallic shaft, a circuit for passing a secondary transfer bias supplied through the secondary transferring roller 39 is formed. The diameter of the driving roller 27 is smaller than that of the follower roller 29 and the tension roller 31. In this arrangement, after the secondary transferring, the recording medium can be easily peeled off the roller by its elastic force. The follower roller 29 also acts as a backup roller for the cleaning unit 34.

The cleaning unit 34 is disposed on the belt 35 which runs downward and comprises a cleaning blade 41 for removing the toner left on the surface of the middle transferring belt 33 after the secondary transferring and a toner conveying path 42 through which the toner thus recovered is conveyed. The cleaning blade 41 is disposed in contact with the area of the middle transferring belt 33 which is wound on the follower roller 29. On the back side of the middle transferring belt 33 are provided primary transferring members 43 in contact with the positions opposing the photosensitive drum 23 for the image forming stations 21Y, 21M, 21C and 21K, respectively. To the primary transferring members 43 is applied a transfer bias.

The exposure unit 9 is disposed in a space provided below the image forming unit 11 off to the side of the image forming unit 11. A blowing fan 13 is provided above the exposure unit 9 off to the side of the exposure unit 9. The paper feeding unit 17 is disposed below the exposure unit 9. The exposure unit 9 has a scanner unit 49 composed of a polygon mirror motor 45 and a polygon mirror 47 provided vertically on the bottom thereof. On the light path B are provided a single f-θ lens and a reflective mirror 53. Above the reflective mirror 53 are provided a plurality of turning mirrors 55 for turning the various color scanning light paths in nonparallel to the photosensitive drum 23.

In the exposure unit 9, image signals corresponding to various colors are emitted as laser beams that are modulated based on a common data clock frequency reflected from the polygon mirror 47. The laser beam thus emitted is passed through the f-θ lens 51, the reflective mirror 53 and the turning mirrors 55, then incident on the photosensitive drum 23 for the image forming stations 21Y, 21M, 21C and 21K, respectively, to from a latent image thereon.

The blowing fan 13 acts as a cooling unit that introduces air in the direction of arrow in FIG. 1 to release heat from the exposure unit 9 and other heat-generating portions.

The paper feeding unit 17 comprises a paper feeding cassette 57 for stacking sheets of recording medium P therein and a pickup roller 59 for feeding sheets of recording medium P from the paper feeding cassette 57 one by one. The paper conveying unit 19 comprises a pair of gate rollers 61 for limiting the timing of feeding of the recording medium P into the secondary transferring zone, a secondary transferring roller 39 which is disposed in contact with the driving roller 27 and the middle transferring belt 33 under pressure, a fixing unit 63, a pair of paper discharge rollers 65 and a double-sided printing conveying path 67.

The fixing unit 63 comprises a pair of rotatable fixing rollers 69 at least one of which has a heating element such as halogen heater incorporated therein and a pressing unit for pressure-energizing at least one of the fixing rollers 69 toward the other to press the secondary image which has been secondarily transferred to a sheet material against the recording medium P. The secondary image that has been secondarily transferred onto the recording medium P is then fixed to the recording medium P at a predetermined temperature in the nip formed by the fixing rollers 69.

The schematic configuration of the tandem type of image forming device 1 which can be used in the process of the invention has been described above. The development device 100 is mounted on the image forming stations 21Y, 21M, 21C and 21K for use. In FIG. 1, the various color development devices are distinguished by the signs 100Y, 100M 100C and 100K corresponding to the color of the toners to be used therefor similarly to the image forming stations. Since these development devices are essentially the same in their configuration, the configuration of an ordinary development device 100 will be described hereinafter in connection with FIG. 2.

Figure 2:
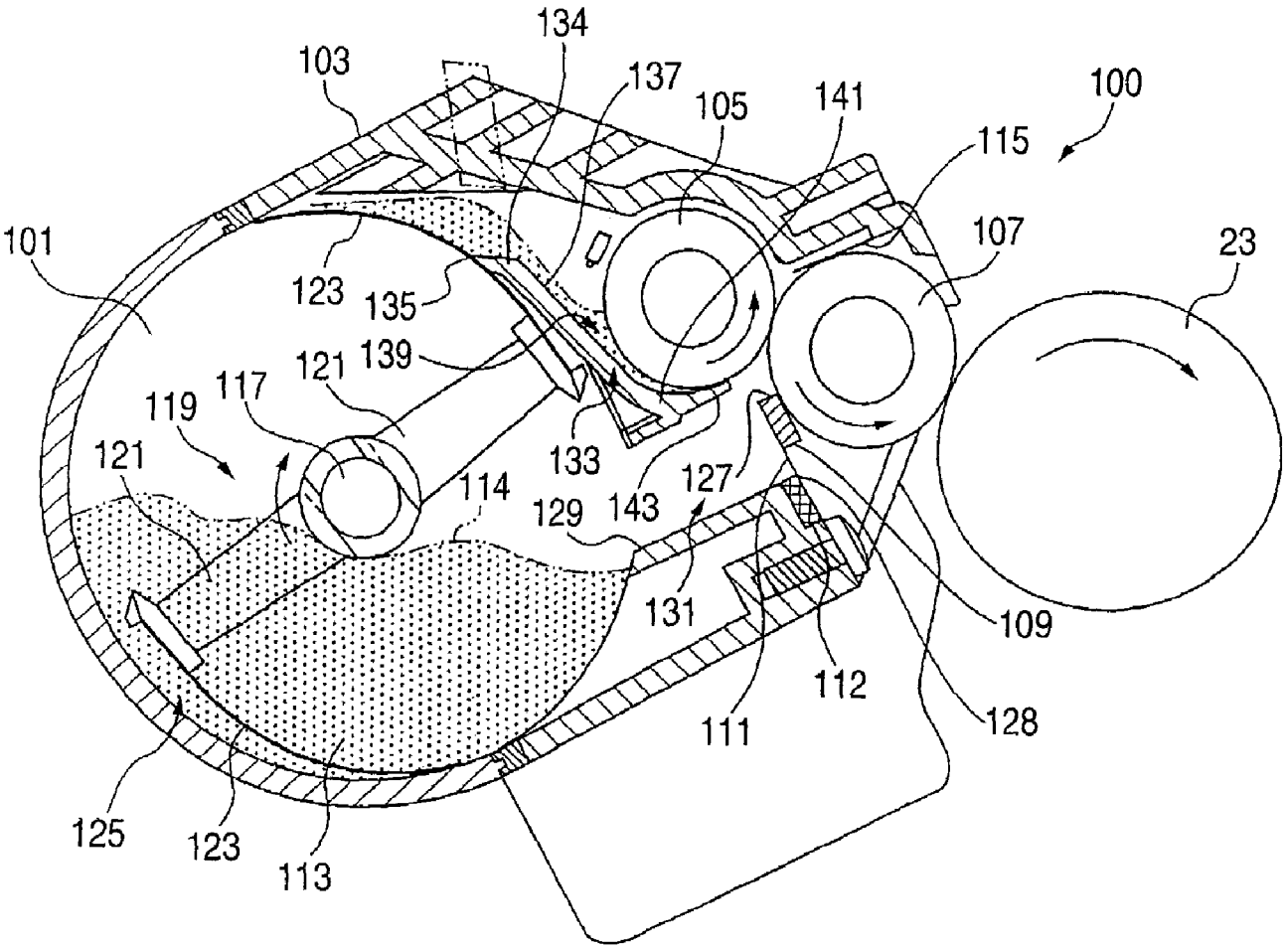
FIG. 2 is a drawing illustrating an example of a development device that can be used in the developing process of the invention.

FIG. 2 is a sectional view of the development device 100. The development device 100 comprises a housing 103 having a substantially cylindrical toner receiving portion 101 formed therein. For the housing 103, a feed roller 105 and a development roller 107 as a developer carrier are provided. As shown in FIG. 1, while the development device 100 is mounted on the image forming station, the development roller 107 is disposed adjacent to the photosensitive drum 23 with a slight gap (e.g., 100 to 300 μm). Under these conditions, the development roller 107 acts to develop the latent image formed on the photosensitive drum 23 with the toner which has been supplied onto the periphery of the development roller 107 while being rotationally driven in the direction (see arrow in the drawing) opposite the direction of rotation of the photosensitive drum 23. The development is carried out by applying a development bias having an AC voltage superimposed on a DC voltage from a development bias source (not shown) to allow an oscillating voltage to act across the development roller 107 and the photosensitive drum 2 so that the toner is supplied into the electrostatic latent image formed on the photosensitive drum 23 from the development roller 107.

The surface of the feed roller 105 is made of a urethane sponge. The feed roller 105 can rotate in the same direction as that of the development roller 107 (counterclockwise direction as viewed on FIG. 2) while being in contact with the development roller 107 on the periphery thereof. A voltage having the same level as that of the development bias voltage applied to the development roller 107 is applied to the feed roller 105.

The regulating blade 109 as a regulating member comes in contact with the development roller 107 under pressure always uniformly in the longitudinal direction over the periphery of the development roller 107 by the action of a leaf spring member 111 and an elastic member 112 provided on the lower side thereof. In this arrangement, extra portion of the toner attached to the periphery of the development roller 107 is scraped off, making it possible to support a constant amount of the toner on the periphery of the development roller 107. The regulating blade 109 also acts to properly charge the toner 113. Accordingly, by properly changing the pressure of the regulating blade 109 or the material of the development roller 107 and the regulating blade 109, the charged amount of the toner can be controlled.

The toner thus scraped off then spontaneously drops to enter the toner receiving portion 101 where it is then mixed with the toner 113. A seal member 115 fixed to the housing 103 at one end thereof comes in contact with the upper side of the periphery of the development roller 107 at the other end thereof under pressure. In this arrangement, the toner 113 in the housing 103 is prevented from being scattered to the exterior.

Inside the toner receiving portion 101 is provided an agitator 119 which rotates on the rotary shaft 117 in the clockwise direction as viewed on FIG. 2. The agitator 119 comprises two arm members 121 extending from the rotary shaft 117 in the opposite directions. The arm members 121 each are predetermined to have a slightly shorter dimension than the diameter of the sectional circle of the toner receiving portion 101. From the forward end of the arm members 121 are extending a stirring fin 123 in the direction opposite the direction of rotation of the agitator 119. The stirring fin 123 is formed by a flexible seal member and comes in contact with the inner surface of the cylindrical toner receiving portion 107 at the forward end thereof under pressure by the elastic force caused by flexibility. When the agitator 119 rotates in this arrangement, the toner 113 in the region 125 between the inner surface of the toner receiving portion 101 and the stirring fin 123 can be scooped up by the stirring fin 123 and then conveyed onto a toner guide member 133 described later.

The upper surface 114 of the toner 113 received in the toner receiving portion 101 is predetermined to be positioned lower the site 127 at which the regulating blade 109 comes in contact with the periphery of the development roller 107. This is because when the amount of the toner is so great that the regulating blade 109 is embedded, the toner scraped off by the regulating blade 109 is present close to the regulating blade, obstructing the circulation path through which the toner is returned to the toner receiving portion 101 and impairing the capability of limiting the amount of the toner to be scraped off the development roller 107 by the regulating blade 109 and then conveyed to the development zone and the capability of properly charging the toner.

In the development device 100, the position of the upper surface 114 of the toner 113 received in the toner receiving portion 101 is predetermined to be below the lower end of the regulating blade 109 and not lower the point 128 of intersection of the leaf spring member 111 with the elastic member 112. When the position of the upper surface 114 of the toner 113 in the toner receiving portion 101 is above the point 128 of intersection, it is likely that the toner 113 can restrict the movement of the leaf spring member 111, occasionally making it impossible to obtain a proper regulating pressure. As a result, it is likely that the "capability of supporting a constant amount of the toner on the periphery of the development roller 107" and the "capability of properly charging the toner" can be impaired. However, by predetermining the upper limit of the position of the upper surface 114 of the toner 113 to be the position of the aforementioned point 128 of intersection as mentioned above, the aforementioned capabilities cannot be impaired. Thus, also by making the structural adjustment of the development device 100 (particularly in the vicinity of the regulating blade 109), it is made possible to deliver a toner having a desired distribution of particle size and charged amount.

Between the site 127 at which the regulating blade 109 comes in contact with the periphery of the development roller 107 and the upper surface 114 of the toner 113 received in the toner receiving portion 101 is formed a toner guide surface 129 which is inclined obliquely to the upper surface 114 at an angle of not lower than the repose angle of the toner 113 as a part of the housing 103. The toner guide surface 129 acts to guide the toner 113 scraped off the periphery of the development roller 107 by the regulating blade 109 to the toner receiving portion 101.

Below the site 127 at which the regulating blade 109 comes in contact with the periphery of the development roller 107 is formed a toner guide space 131 through which the toner 113 scraped off the periphery of the development roller 107 by the regulating blade 109 is introduced into the toner receiving portion 101.

Above the toner receiving portion 101 is provided a toner guide member 133. The toner guide member 133 comprises a sharpened scraper 135 provided at the end 134 farer from the feed roller 105 for scraping the toner 113 which has been conveyed by the stirring fin 123, a flat conveyance portion 137 the upper surface of which is inclined at an angle of not lower than the angle of repose of the toner 113 and formed flat on the side thereof closer to the feed roller 105 than the scraper 135, a curved portion 141 formed downstream from the flat conveyance portion 137 the upper surface of which is curved to form a concave and a contact portion 143 provided downstream from the curved portion 141 which comes in contact with the periphery of the feed roller 105 at a predetermined proper linear pressure. The surface roughness of the toner guide member 133 comprising the flat conveyance portion 137, the curved portion 141 and the contact portion 143 is predetermined to be less than the average toner particle size.

The presence of the aforementioned contact portion 143 makes it possible to prevent the toner 113 attached to the lower surface of the feed roller 105 from dropping by its gravity to cause the reduction of the amount of the toner which can be fed to the development roller 107 that leads to the drop of the image density. Between the curved portion 141 and the periphery of the feed roller 105 is formed a toner temporary reservoir 139 having a wedge section.

In operation of the toner guide member 133 having the aforementioned arrangement, the toner 113 that has been conveyed by the stirring fin 123 is scraped off by the scraper 135. The toner 113 drops by its gravity at a uniform velocity along the flat conveyance portion 137 over the crosswise range at an arbitrary position in the slope thereof and is once stored in the toner temporary reserve 139. In the wedge toner temporary reserve 139, as the toner 113 proceeds into the narrow region, the contact pressure against the periphery of the feed roller 105 gradually increases, pressing the toner 113 against the periphery of the feed roller 105 and thus making it easy for the toner 113 to be supported on the periphery of the feed roller 105. When the toner 113 is pushed out beyond the contact portion 143, the toner 113 drops through the toner guide space 131 from which it is then returned to the toner receiving portion 101 directly or guided by the toner guide surface 129.

The formation of image in the image forming device 1 and the development device 100 will be described hereinafter. The formation of image is conducted in the following manner.

In some detail, when an image formation signal is inputted from a computer which is not shown or the like, the photosensitive drum 23, the development roller 107 for the image forming stations 21Y, 21M, 21C and 21K and the middle transferring belt 33 are then rotationally driven. Subsequently, the outer surface of the photosensitive drum 23 is uniformly charged by the corona charging unit 25. The outer surface of the photosensitive drum 23 is then selectively exposed to light according to a first color image data by the exposure unit 9 to form a yellow electrostatic latent image thereon for example. In the toner receiving portion 101, the rotation of the agitator 119 causes the toner 113 present in the region 125 between the inner surface of the toner receiving portion 101 and the stirring fin 123 to be scooped up by the stirring fin 123. The toner 113 that has thus been scooped up is then scraped off by the scraper 135. The toner 113 then slides down along the flat conveyance portion 137 into the toner reservoir 139. The toner 113 which has been stored in the toner reservoir 139 is then successively supported on the periphery of the feed roller 105. Thereafter, the toner is moved to the development roller 107. Extra toner is scraped off the development roller 107 by the regulating blade 109 while the toner supported on the development roller 107 is charged by the regulating blade 109. The toner thus charged then develops the electrostatic latent image formed on the photosensitive drum 23. At this point, the photosensitive drum 23 is supplied with a toner from the development roller 107 for the image forming station 21Y. In this manner, a toner image of yellow electrostatic latent image is then formed on the photosensitive drum 23. Further, the toner image is then transferred onto the middle transferring belt 33 to which a temporary transfer voltage having the polarity opposite the polarity of charge of the toner has been applied. Thereafter, the outer surface of the photosensitive drum 23 is uncharged by an uncharging means.

The similar operation of forming latent image and developing latent image with one rotation of the photosensitive drum 23 and the middle transferring belt 33 is then repeated for the second, third and fourth color image formation signals to transfer four color toner images corresponding to the contents of image formation signals onto the middle transferring belt 33 in such a manner that they are superposed on each other. Subsequently, the resulting full-color image is transferred to the recording medium.

Figure 3:
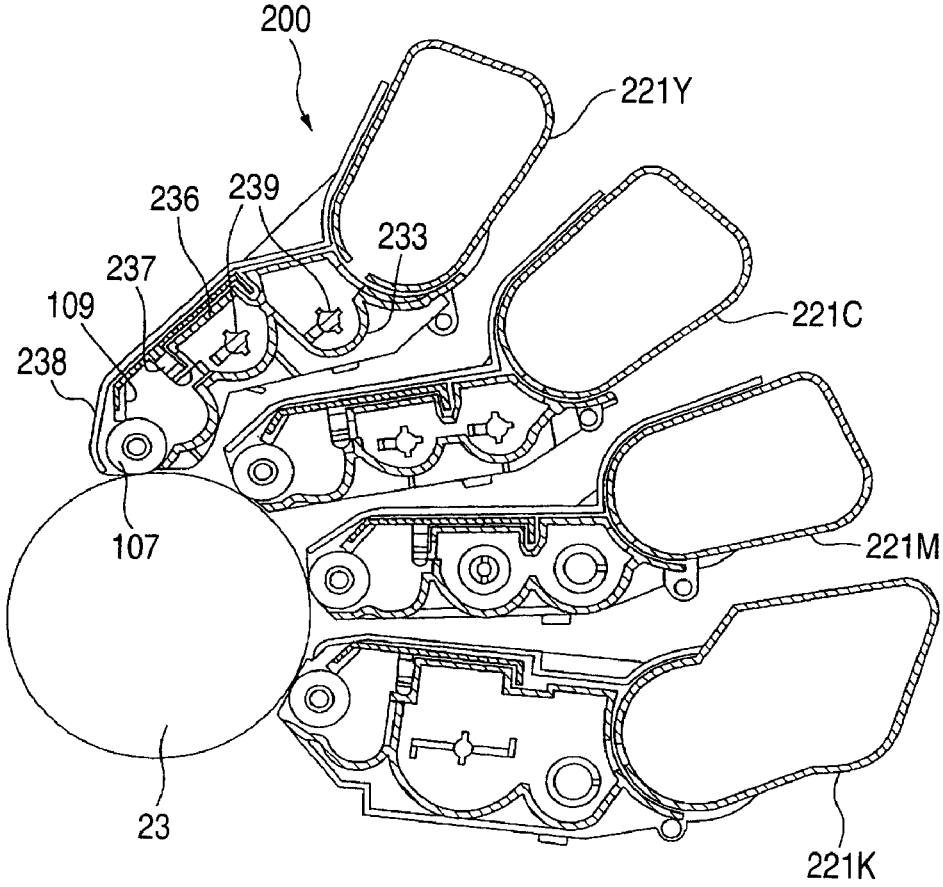
FIG. 3 is a drawing illustrating another example of an image forming device which can be used in the developing process of the invention.

An example of a full-color image forming device 200 comprising a development device employing the contact developing process will be described hereinafter in connection with FIG. 3. The full-color image forming device 200 comprises development device units 221Y, 221C, 221M and 221K composed of four color development devices for yellow Y, cyan C, magenta M and black K, respectively, provided on the periphery of the photosensitive drum 23 for developing the electrostatic latent image along the direction of rotation. In FIG. 3, the reference numeral 107 indicates a development roller, the reference numeral 109 indicates a regulating blade, the reference numeral 233 indicates a housing, the reference numeral 236 indicates a blade support member, the reference numeral 237 indicates a blade press spring, the reference numeral 238 indicates a development cover and the reference numeral 239 indicates a stirring shaft. Though not shown, there are also provided a charging roller as a charging unit, an exposure unit for forming an electrostatic latent image on the photosensitive drum 23 and a middle transferring unit for transferring a toner image formed on the photosensitive drum 23 onto the middle transferring belt as in FIG. 1. Unlike the image forming unit 1 of FIG. 1, the image forming device 200 comprises a cleaning unit (not shown) for removing the toner left on the photosensitive drum 23.

The photosensitive drum 23 comprises a cylindrical electrically-conductive substrate having a thin wall and a photosensitive layer formed thereon and is rotationally driven by a driving unit which is not shown. The development device units 221Y, 221C, 221M and 221K are each disposed in such an arrangement that they can rock relative to the photosensitive drum 23. It is arranged such that only the development roller 107 of one of the development devices can come in contact with the photosensitive drum 23 every one rotation of the photosensitive drum 23.

Explaining the operation of image formation, when an image formation signal is inputted from a computer which is not shown or the like, the photosensitive drum 23, the development roller of the development device units 221Y, 221C, 221M and 221K and the middle transferring belt are then rotationally driven. Firstly, the outer surface of the photosensitive drum 23 is uniformly charged by a charging roller. The outer surface of the photosensitive drum 23 is then selectively exposed to light according to a first color image data by the exposure unit to form a yellow electrostatic latent image thereon for example. At this point, only the development roller 107 of the yellow development device unit 221Y comes in contact with the photosensitive drum 23. In this manner, a toner image of yellow electrostatic latent image is formed on the photosensitive drum 23. The toner image is then transferred onto the middle transferring belt to which a temporary transfer voltage having the polarity opposite the polarity of charge of the toner has been applied. The toner left on the photosensitive drum 23 is removed by the cleaning unit. Thereafter, the outer surface of the photosensitive drum 23 is uncharged by a uncharging means.

The similar operation of forming latent image and developing latent image with one rotation of the photosensitive drum 23 and the middle transferring belt is then repeated for the second, third and fourth color image formation signals to transfer four color toner images corresponding to the contents of image formation signals onto the middle transferring belt in such a manner that they are superposed on each other. Subsequently, the resulting full-color image is transferred to the recording medium.

In the aforementioned image forming device 200 employing the contact developing process of FIG. 3, too, the charged amount can be structurally controlled on the part of the development device by adjusting the configuration of the regulating blade 109, etc. as in the case of the image forming device 1 of FIG. 1.

EXAMPLES

The present invention is now illustrated in greater detail with reference to Examples and Comparative Examples, but it should be understood that the present invention is not to be construed as being limited thereto.

The measurement of the particle size and the charged amount of the particulate toner in the following examples and comparative examples was carried out using a Type EST-3 E-Spart Analyzer® model (produced by HOSOKAWA MICRON CORPORATION) in the following manner.

Procedure of Measurement by E-Spart Analyzer (1) Switch the main power of the device. Wait for about 30 minutes until the device is stabilized.

(2) Set the feed pressure of the nitrogen gas bomb at 0.3 MPa. Actuate a data processing personal computer (PC) and then start "ESTWIN902.exe". At this point, arrange such that particle sizes are classified into 60 channels. Conduct particle size calibration.

(3) Adjust the flow rate at fixed portion to 0.4 l/min.

(4) Adjust the dust collecting air flow to 0.4 l/min.

(5) Put 150 ml of purified water and three droplets of PSL dispersion in a nebulizer bottle. Stir the mixture. Put the mixture in an ultrasonic cleaner. Subject the standard solution to dispersion for 2 minutes.

(6) Attach a silica gel-filled dryer and a nitrogen gas feed pipe to the nebulizer bottle.

(7) Switch the calibration operation ON. Wait for about 30 seconds until the supply of gas is stabilized.

(8) Adjust the gas pressure to 0.08 MPa.

(9) Click the start icon on the measurement picture on PC to start measurement.

(10) After the termination of measurement, confirm that the value of D5 count, D50 volume is 3.16±0.1 μm (measurements are determined as calculated in terms of particle size of PSL standard solution).

(11) Set a feed hood and a one-component supplier nozzle to make charge calibration.

(12) Set a development roller having a toner layer formed thereon on the one-component supplier.

(13) Adjust the distance between the development roller and the nozzle to 4 mm.

(14) Set the conditions of measurement of charge calibration such that the intake flow rate is 0.4 l/min, the dust collecting air flow rate is 0.4 l/min, the interval is 1 second, the blowing time is 1 second, the gas pressure is 0.08 MPa, the delivery speed along X axis is 0.1 mm/second and no electric field voltage is applied.

(15) Confirm that "Q/m" on the measurement picture is 0±0.5 μC/g.

(16) Measurement of sample:

Set a development roller having a toner layer formed thereon on the one-component supplier. The measurement conditions are as follows:

Distance between the development roller and the nozzle: 4 mm; intake flow rate: 0.2 l/min; dust collecting air flow rate: 0.6 l/min; interval: 3 seconds; blowing time: 1 second; gas pressure: 0.02 MPa; electric field voltage: 0.1 KV The total counted number is not limited but is preferably from 300 to 3,000. It is important that the toner is peeled off the development roller before measurement so that the background of the development roller can be seen after measurement.

(17) Data processing:

The data of particle size and charged amount obtained by the aforementioned measurement method were each process as follows.

Using a commercially available software [EXCEL®, produced by Microsoft Inc., was used], the particle size of from 0 μm to 10 μm was divided into divisions having a width of 0.5 μm, i.e., from 0 μm to less than 0.5 μm, from 0.5 μm to less than 1.0 μm, and so forth. These divisions are represented by 0.25 μm for the division of from 0 μm to less than 0.5 μm, 0.75 μm for the division of from 0.5 μm to less than 1.0 μm, and so forth.

Similarly, the charged amount was divided into divisions, i.e., from 0 fC to less than 0.5 fC, from 0.5 fC to less than 1.0 fC, . . . , from −0.5 fC to less than 0 fC, from −1.0 fC to less than −0.5 fC, and so forth. These divisions are represented by 0.25 for the division of from 0 fC to less than 0.5 fC, 0.75 for the division of from 0.5 fC to less than 1.0 fC, . . . −0.25 for the division of from −0.5 to less than 0 fC, −0.75 for the division of from −1.0 fC to less than −0.5 fC, and so forth.

Figure 4:
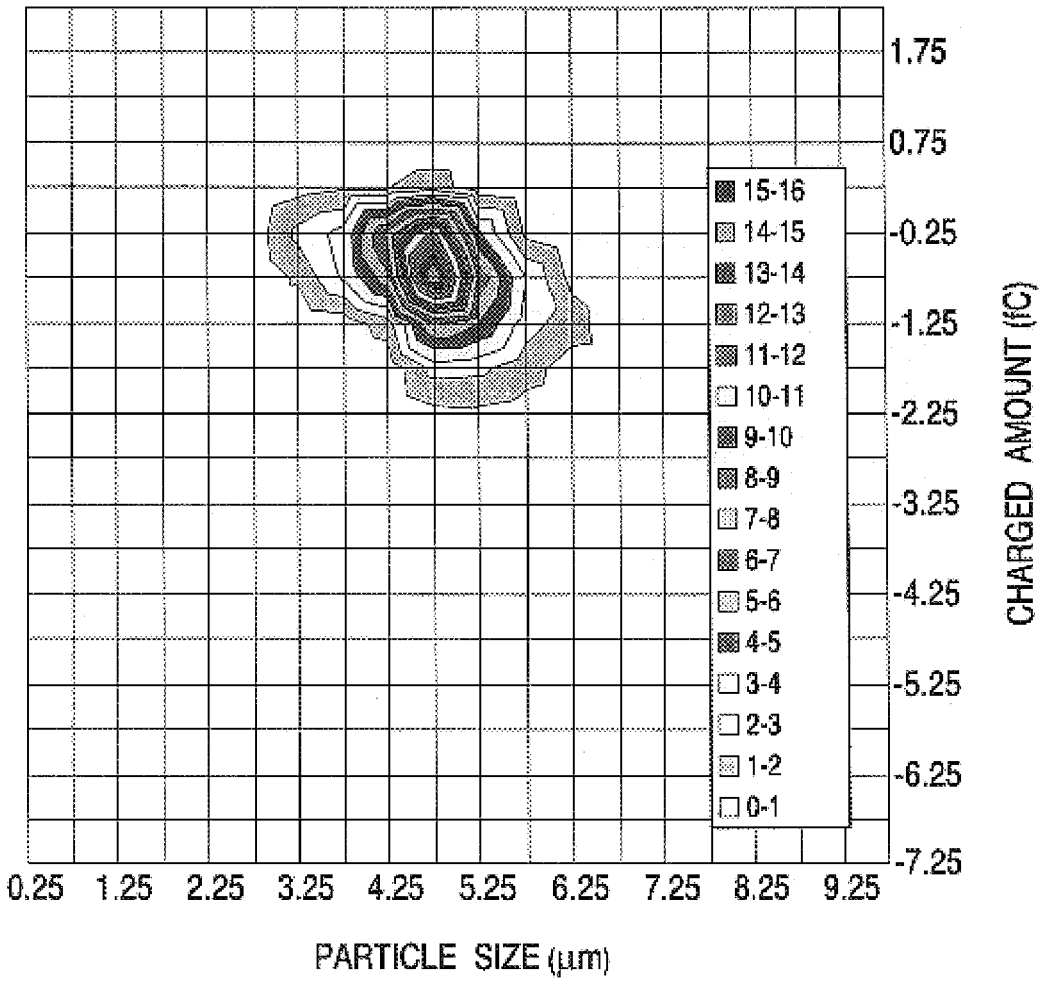
FIG. 4 is a drawing illustrating the particle size-charged amount distribution of Example 1-1.

The measurement data were thus readjusted. The number of particles in the various channels were divided by the total number of particles so as to determine ratio of number of particles. Thereby, a three-dimensional graph was then prepared (see FIG. 4, etc.). The divisions having a ratio of less than 1% are excluded from the graph.

Evaluation of Dot Formation and Background Stain

In the following examples and comparative examples, dot formation and background stain were evaluated.

For the evaluation of dot formation, the density of the middle point of two dots was measured. Those showing a density value of 0.25 or less were judged good, those showing a density value of 0.25 or more were judged poor.

For the evaluation of background stain, OD value of the non-image area on the transfer material (e.g., printing paper) was measured using a reflection densitometer (X-rite). Those showing an OD value of 0.14 or more were judged poor.

Evaluation of White Blanks

A line image having a width of 500 μm was printed. The printed matter was then visually observed for occurrence of white blanks. Those showing no white blanks were judged good and those showing some white blanks were judged poor.

Evaluation of Edge Effect

A square patch pattern having side length of about 3 cm was measured for OD value at four sides as edge and the center thereof, totaling five points, using a Type X-Rite 404 reflection densitometer. From the measurements was then calculated he difference between the averaged OD value of the four edges and the OD value of the central portion. The greater the difference of OD value is, the greater is the density unevenness from edge to center, i.e., the greater is the edge effect. Those showing an OD value difference of 0.1 or less were judged good and those showing an OD value difference of more than 0.1 were judged poor.

Evaluation of Fogging

The toner particles present on the non-image area of the photosensitive drum which had been stopped during development were transferred to a tape by which they were they collected for visual observation. Those showing no fogging were judged good and those showing some fogging were judged poor.

Evaluation of Starvation

As a print pattern, a solid line having a width of 1 mm was drawn on a halftone image which had been drawn with a screen line ratio of 200 lpi. The print pattern was then visually observed for the occurrence of starvation. Those showing starvation were judged poor and those showing no starvation were judged good.

Example 1-1

A monomer mixture comprising 80 parts by weight of a styrene monomer, 20 parts by weight of butyl acrylate and 5 parts by weight of acrylic acid was added to a water-soluble mixture comprising 105 parts by weight of water, 1 part by weight of a nonionic emulsifier, 1.5 parts by weight of an anionic emulsifier and 0.55 parts by weight of potassium persulfate to obtain a lacteous resin emulsion having a particle size of 0.25 μm.

Subsequently, 200 parts by weight of the resin emulsion thus obtained, 20 parts by weight of a polyethylene wax emulsion (produced by Sanyo Chemical Industries, Ltd.) and 7 parts by weight of a phthalocyanine blue were dispersed in water containing 0.2 parts by weight of sodium dodecylbenzenesulfonate as a surface active agent. To the mixture was then added diethylamine to adjust the pH value thereof to 5.5. To the mixture was then added 0.3 parts by weight of aluminum sulfate as an electrolyte with stirring. Subsequently, the mixture was subjected to high speed stirring using a TK homomixer to undergo dispersion. To the mixture were then added 40 parts by weight of a styrene monomer, 10 parts by weight of butyl acrylate and 5 parts by weight of zinc salicylate together with 40 parts by weight of water. The mixture was then heated to 90° C. with stirring in a nitrogen stream. To the mixture was then added aqueous hydrogen peroxide. The mixture was then allowed to undergo polymerization for 4 hours to cause the growth of particles. After the termination of polymerization, with the pH value being adjusted to not lower than 5, the mixture was then heated to 95° C. where it was then allowed to stand for 5 hours to enhance the bonding strength of associated particles. Thereafter, the particulate material thus obtained was washed with water, and then vacuum-dried at 45° C. for 10 hours. Thus, toner mother particles having an average particle size of 7 μm were obtained.

To the toner mother particles having an average particle size of 7 μm were then added 0.2 wt % of a large particle size silica (Type RX50; produced by NIPPON AEROSIL CO., LTD.), 0.5 wt % of a small particle size silica (Type RX300; produced by NIPPON AEROSIL CO., LTD.) and 1.0 wt % of titanium (STT-30S, produced by TITAN KOGYO KABUSHIKI KAISHA) as external additives. The mixture was then processed at a rotary speed of 2,000 rpm for 2 minutes using a small-sized stirrer.

The toner thus obtained was then negatively charged in a non-contact process development device similar to that of FIG. 2. The regulating pressure of the regulating blade was 29 gf/cm and the amount of the toner to be conveyed was 0.347 mg/cm$^2$. The conveying speed was adjusted to 310 mm/sec.

About 3,000 particles of the toner thus charged were then measured for particle size and charged amount. The measurements are set forth in detail in Table 1-1 and shown in the form of three-dimensional graph in FIG. 4. As can be seen in Table 1-1, the particle size divisional value A1 [μm] and the charged amount divisional value B1 [fC] in the division where there is the largest number proportion of the toner particles, the particle size divisional value A2 [μm] where the particulate toner has the smallest particle size in the particle size distribution indicating that the number proportion of the toner particles is 1% or more and the charged amount divisional value B2 [fC] where there is the largest number proportion of the toner particles when the particle size division is A2 defined above are 4.75, −0.75, 3.25 and −0.25, respectively, as set forth in Table 1-7. The formula (k1) among these divisional values is 0.33, which satisfies the aforementioned formulas 1 and 2. The sum (k2) of the number proportions of the toner particles having a smaller particle size divisional value than A1 as defined above was 29%. As can be seen in the results of evaluation set forth in Table 1-8, the edge effect was effectively inhibited, making it possible to form an image having a uniform development density which varies little from edge to center. No fogging occurred.

TABLE 1-1

| Particle size | Charged amount [fC] | | | | | | | | | | |
|---|---|---|---|---|---|---|---|---|---|---|---|
| [μm] | −7.25 | −6.75 | −6.25 | −5.75 | −5.25 | −4.75 | −4.25 | −3.75 | −3.25 | −2.75 | −2.25 |
| 0.25 | 0 | 0 | 0 | 0 | 0 | 0 | 0 | 0 | 0 | 0 | 0 |
| 0.75 | 0 | 0 | 0 | 0 | 0 | 0 | 0 | 0 | 0 | 0 | 0 |
| 1.25 | 0 | 0 | 0 | 0 | 0 | 0 | 0 | 0 | 0 | 0 | 0 |
| 1.75 | 0 | 0 | 0 | 0 | 0 | 0 | 0 | 0 | 0 | 0 | 0 |
| 2.25 | 0 | 0 | 0 | 0 | 0 | 0 | 0 | 0 | 0 | 0 | 0 |
| 2.75 | 0 | 0 | 0 | 0 | 0 | 0 | 0 | 0 | 0 | 0 | 0 |
| (A2) 3.25 | 0 | 0 | 0 | 0 | 0 | 0 | 0 | 0 | 0 | 0 | 0 |
| 3.75 | 0 | 0 | 0 | 0 | 0 | 0 | 0 | 0 | 0 | 0 | 0 |
| 4.25 | 0 | 0 | 0 | 0 | 0 | 0 | 0 | 0 | 0 | 0 | 0 |
| (A1) | 0 | 0 | 0 | 0 | 0 | 0 | 0 | 0 | 0 | 0.133 | 0.667 |

TABLE 1-1-continued

| | | | | | | | | | | | |
|---|---|---|---|---|---|---|---|---|---|---|---|
| 4.75 | | | | | | | | | | | |
| 5.25 | 0 | 0 | 0 | 0 | 0 | 0.033 | 0 | 0.067 | 0.067 | 0.333 | 0.8 |
| 5.75 | 0 | 0 | 0 | 0 | 0 | 0.067 | 0 | 0.033 | 0.233 | 0.2 | 0.533 |
| 6.25 | 0 | 0.067 | 0 | 0 | 0 | 0.033 | 0.033 | 0.133 | 0.067 | 0.3 | 0.333 |
| 6.75 | 0 | 0 | 0 | 0 | 0 | 0 | 0 | 0.067 | 0.1 | 0.1 | 0.067 |
| 7.25 | 0 | 0 | 0 | 0 | 0 | 0 | 0 | 0 | 0 | 0 | 0 |
| 7.75 | 0 | 0 | 0 | 0 | 0 | 0 | 0 | 0 | 0 | 0 | 0 |
| 8.25 | 0 | 0 | 0 | 0 | 0 | 0 | 0 | 0 | 0 | 0 | 0 |
| 8.75 | 0 | 0 | 0 | 0 | 0 | 0 | 0 | 0 | 0 | 0 | 0 |
| 9.25 | 0 | 0 | 0 | 0 | 0 | 0 | 0 | 0 | 0 | 0 | 0 |
| 9.75 | 0 | 0 | 0 | 0 | 0 | 0 | 0 | 0 | 0 | 0 | 0 |

| | Charged amount [fC] | | | | | | | | | |
|---|---|---|---|---|---|---|---|---|---|---|
| Particle size [μm] | −1.75 | −1.25 | (B1) −0.75 | (B2) −0.25 | 0.25 | 0.75 | 1.25 | 1.75 | 2.25 | |
| 0.25 | 0 | 0 | 0 | 0 | 0 | 0 | 0 | 0 | 0 | 0 |
| 0.75 | 0 | 0 | 0 | 0 | 0 | 0 | 0 | 0 | 0 | 0 |
| 1.25 | 0 | 0 | 0 | 0 | 0 | 0 | 0 | 0 | 0 | 0 |
| 1.75 | 0 | 0 | 0 | 0.067 | 0 | 0 | 0 | 0 | 0 | 0.067 |
| 2.25 | 0 | 0 | 0.133 | 0.333 | 0.033 | 0 | 0 | 0 | 0 | 0.5 |
| 2.75 | 0 | 0.067 | 0.2 | 0.467 | 0.1 | 0 | 0 | 0 | 0 | 0.833 |
| (A2) | 0 | 0.1 | 1.2 | 2.267 | 0.633 | 0 | 0 | 0 | 0 | 4.2 |
| 3.25 | | | | | | | | | | |
| 3.75 | 0 | 0.367 | 3.067 | 3.367 | 0.993 | 0.033 | 0 | 0 | 0 | 7.767 |
| 4.25 | 0.233 | 1.5 | 5.767 | 7.233 | 0.933 | 0.033 | 0.033 | 0.067 | 0 | 15.8 |
| (A1) | 2.4 | 6.133 | 15.17 | 11.33 | 1.567 | 0 | 0 | 0 | 0 | 37.4 |
| 4.75 | | | | | | | | | | |
| 5.25 | 2.233 | 4.967 | 6.767 | 4.2 | 0.333 | 0.033 | 0 | 0 | 0 | 19.83 |
| 5.75 | 1.367 | 2.433 | 3.033 | 0.767 | 0.133 | 0 | 0 | 0 | 0 | 8.8 |
| 6.25 | 0.533 | 1.467 | 0.733 | 0.1 | 0.067 | 0 | 0 | 0 | 0 | 3.867 |
| 6.75 | 0.333 | 0.1 | 0.033 | 0.033 | 0 | 0 | 0 | 0 | 0 | 0.833 |
| 7.25 | 0 | 0 | 0 | 0 | 0 | 0 | 0 | 0 | 0 | 0 |
| 7.75 | 0 | 0 | 0 | 0 | 0 | 0 | 0 | 0 | 0 | 0 |
| 8.25 | 0 | 0 | 0 | 0 | 0 | 0 | 0 | 0 | 0 | 0 |
| 8.75 | 0 | 0 | 0 | 0 | 0 | 0.033 | 0 | 0 | 0 | 0.033 |
| 9.25 | 0 | 0 | 0 | 0 | 0 | 0 | 0 | 0 | 0 | 0 |
| 9.75 | 0 | 0 | 0 | 0 | 0 | 0 | 0 | 0 | 0 | 0 |

Example 1-2

A monomer mixture comprising 80 parts by weight of a styrene monomer, 20 parts by weight of butyl acrylate and 5 parts by weight of acrylic acid was added toga water-soluble mixture comprising 105 parts by weight of water, 1 part by weight of a nonionic emulsifier, 1.5 parts by weight of an anionic emulsifier and 0.55 parts by weight of potassium persulfate to obtain a lacteous resin emulsion having a particle size of 0.25 μm.

Subsequently, 200 parts by weight of the resin emulsion thus obtained, 20 parts by weight of a polyethylene wax emulsion (produced by Sanyo Chemical Industries, Ltd.) and 7 parts by weight of a phthalocyanine blue were dispersed in water containing 0.2 parts by weight of sodium dodecylbenzenesulfonate as a surface active agent. To the mixture was then added diethylamine to adjust the pH value thereof to 5.5. To the mixture was then added 0.3 parts by weight of aluminum sulfate as an electrolyte with stirring. Subsequently, the mixture was subjected to high speed stirring using a TK homomixer to undergo dispersion. To the mixture were then added 40 parts by weight of a styrene monomer, 10 parts by weight of butyl acrylate and 5 parts by weight of zinc salicylate together with 40 parts by weight of water. The mixture was then heated to 90° C. with stirring in a nitrogen stream. To the mixture was then added aqueous hydrogen peroxide. The mixture was then allowed to undergo polymerization for 5 hours to cause the growth of particles. After the termination of polymerization, with the pH value being adjusted to not lower than 5, the mixture was then heated to 95° C. where it was then allowed to stand for 5 hours to enhance the bonding strength of associated particles. Thereafter, the particulate material thus obtained was washed with water, and then vacuum-dried at 45° C. for 10 hours. Thus, toner mother particles having an average particle size of 7 μm were obtained.

To the toner mother particles having an average particle size of 7 μm were then added 0.2 wt % of a large particle size silica (Type RX50; produced by NIPPON AEROSIL CO., LTD.), 0.5 wt % of a small particle size silica (Type RX300; produced by NIPPON AEROSIL CO., LTD.) and 0.5 wt % of titanium (STT-30S, produced by TITAN KOGYO KABUSHIKI KAISHA) as external additives. The mixture was then processed at a rotary speed of 2,000 rpm for 2 minutes using a small-sized stirrer.

The toner thus obtained was then negatively charged in a non-contact process development device similar to that of FIG. 2. The regulating pressure of the regulating blade was 34 gf/cm and the amount of the toner to be conveyed was 0.355 mg/cm$^2$. The conveying speed was adjusted to 310 mm/sec.

Figure 5:
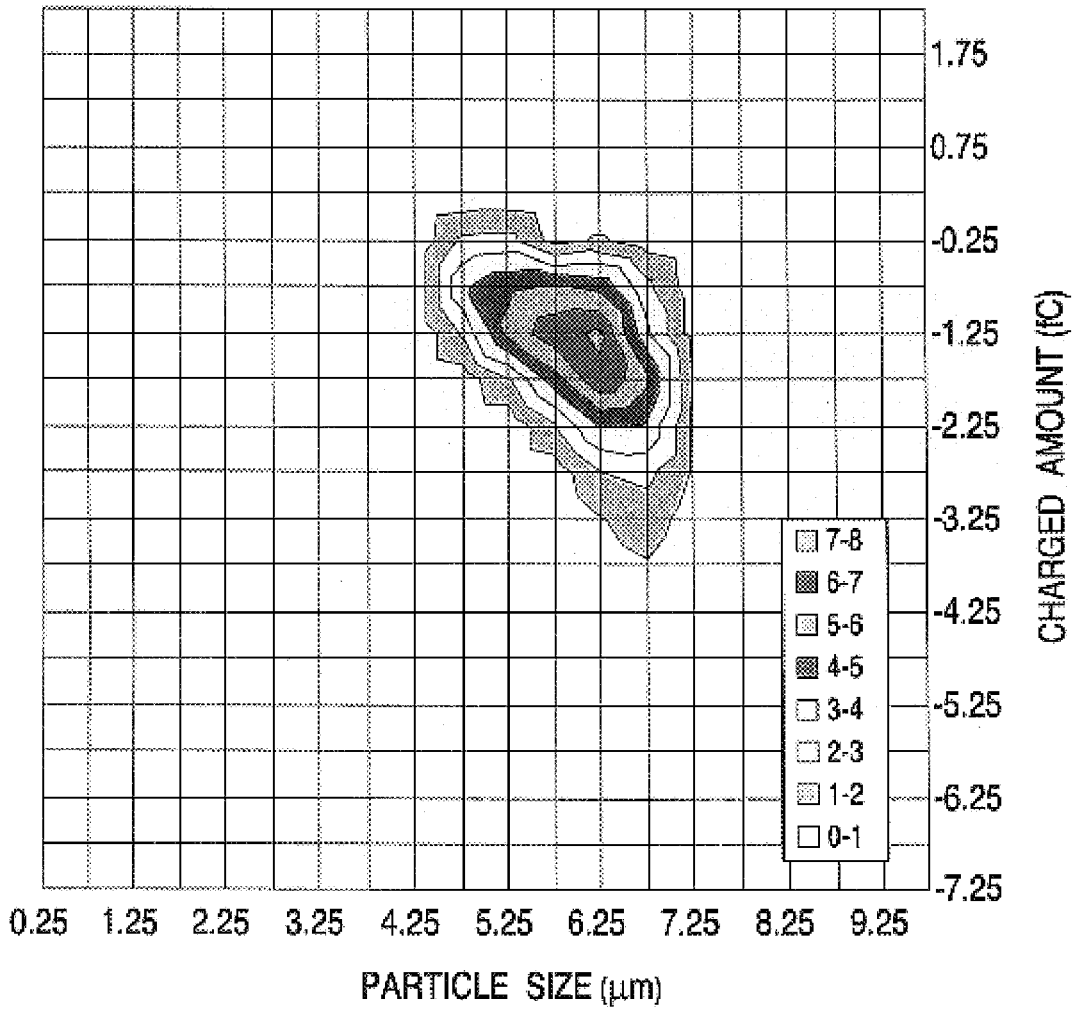
FIG. 5 is a drawing illustrating the particle size-charged amount distribution of Example 1-2.

About 3,000 particles of the toner thus charged were then measured for particle size and charged amount. The measurements are set forth in detail in Table 1-2and shown in the form of three-dimensional graph in FIG. 5. As can be seen in Table 1-2, the particle size divisional value A1 [μm] and the charged amount divisional value B1 [fC] in the division where there is the largest number proportion of the toner particles, the particle size divisional value A2 [μm] where the particulate toner has the smallest particle size in the particle size distribution indicating that the number proportion of the toner particles is 1% or more and the charged amount divisional value B2 [fC] where there is the largest number proportion of the toner particles when the particle size division is A2 defined above are 6.25, −1.25, 4.75 and −0.75, respectively, as set forth in Table 1-7. The formula (k1) among these divisional values is 0.33, which satisfies the aforementioned formulas 1 and 2. The sum (k2) of the number proportions of the toner particles having a smaller particle size divisional value than A1 as defined above was 41%. As can be seen in the results of evaluation set forth in Table 1-8, the edge effect was effectively inhibited, making it possible to form an image having a uniform development density which varies little from edge to center. No fogging occurred.

Example 1-3

To the same toner mother particles as used in Example 1-2 were then added 0.2 wt % of a large particle size silica (Type RX50; produced by NIPPON AEROSIL CO., LTD.), 0.3 wt % of a small particle size silica (Type RX300; produced by NIPPON AEROSIL CO., LTD.) and 0.5 wt % of titanium (STT-30S, produced by TITAN KOGYO KABUSHIKI KAISHA) as external additives. The mixture was then processed at a rotary speed of 2,000 rpm for 2 minutes using a small-sized stirrer.

The toner thus obtained was then negatively charged in a non-contact process development device similar to that of FIG. 2. The regulating pressure of the regulating blade was 35 gf/cm and the amount of the toner to be conveyed was 0.352 mg/cm$^2$. The conveying speed was adjusted to 310 mm/sec.

TABLE 1-2

| Particle size | Charged amount [fC] | | | | | | | | | | |
|---|---|---|---|---|---|---|---|---|---|---|---|
| [μm] | −7.25 | −6.75 | −6.25 | −5.75 | −5.25 | −4.75 | −4.25 | −3.75 | −3.25 | −2.75 | −2.25 |
| 0.25 | 0 | 0 | 0 | 0 | 0 | 0 | 0 | 0 | 0 | 0 | 0 |
| 0.75 | 0 | 0 | 0 | 0 | 0 | 0 | 0 | 0 | 0 | 0 | 0 |
| 1.25 | 0 | 0 | 0 | 0 | 0 | 0 | 0 | 0 | 0 | 0 | 0 |
| 1.75 | 0 | 0 | 0 | 0 | 0 | 0 | 0 | 0 | 0 | 0 | 0 |
| 2.25 | 0 | 0 | 0 | 0 | 0 | 0 | 0 | 0 | 0 | 0 | 0 |
| 2.75 | 0 | 0 | 0 | 0 | 0 | 0 | 0 | 0 | 0 | 0 | 0 |
| 3.25 | 0 | 0 | 0 | 0 | 0 | 0 | 0 | 0 | 0 | 0 | 0 |
| 3.75 | 0 | 0 | 0 | 0 | 0 | 0 | 0 | 0 | 0 | 0 | 0 |
| 4.25 | 0 | 0 | 0 | 0 | 0 | 0 | 0 | 0 | 0 | 0 | 0 |
| (A2) | 0 | 0 | 0 | 0 | 0 | 0 | 0 | 0 | 0 | 0.033 | 0.133 |
| 4.75 | | | | | | | | | | | |
| 5.25 | 0 | 0 | 0 | 0 | 0 | 0 | 0 | 0.067 | 0.033 | 0.133 | 0.233 |
| 5.75 | 0 | 0 | 0 | 0 | 0 | 0 | 0.033 | 0.1 | 0.033 | 0.4 | 1.9 |
| (A1) | 0 | 0 | 0 | 0.033 | 0 | 0 | 0.2 | 0.6 | 0.933 | 2 | 4.067 |
| 6.25 | | | | | | | | | | | |
| 6.75 | 0 | 0 | 0 | 0 | 0.067 | 0.133 | 0.567 | 0.933 | 1.467 | 2.267 | 3.833 |
| 7.25 | 0 | 0 | 0.033 | 0.133 | 0.067 | 0.267 | 0.267 | 0.333 | 0.5 | 0.867 | 0.767 |
| 7.75 | 0 | 0.033 | 0 | 0.067 | 0 | 0.067 | 0.033 | 0.2 | 0.033 | 0.2 | 0.2 |
| 8.25 | 0 | 0 | 0 | 0.033 | 0 | 0 | 0 | 0 | 0 | 0.067 | 0 |
| 8.75 | 0.033 | 0 | 0.033 | 0 | 0 | 0.033 | 0.033 | 0.033 | 0 | 0 | 0 |
| 9.25 | 0 | 0 | 0 | 0 | 0 | 0 | 0 | 0 | 0 | 0 | 0.033 |
| 9.75 | 0 | 0 | 0 | 0 | 0 | 0 | 0 | 0 | 0.033 | 0 | 0 |

| Particle size | Charged amount [fC] | | | | | | | | | |
|---|---|---|---|---|---|---|---|---|---|---|
| [μm] | −1.75 | (B1) −1.25 | (B2) −0.75 | −0.25 | 0.25 | 0.75 | 1.25 | 1.75 | 2.25 | |
| 0.25 | 0 | 0 | 0 | 0 | 0 | 0 | 0 | 0 | 0 | 0 |
| 0.75 | 0 | 0 | 0 | 0 | 0 | 0 | 0 | 0 | 0 | 0 |
| 1.25 | 0 | 0 | 0 | 0 | 0.033 | 0 | 0 | 0 | 0 | 0.033 |
| 1.75 | 0 | 0 | 0 | 0.033 | 0 | 0 | 0 | 0 | 0 | 0.033 |
| 2.25 | 0 | 0 | 0 | 0 | 0.033 | 0 | 0 | 0 | 0 | 0.033 |
| 2.75 | 0 | 0 | 0 | 0 | 0 | 0 | 0 | 0 | 0 | 0 |
| 3.25 | 0 | 0 | 0 | 0.033 | 0 | 0 | 0 | 0 | 0 | 0.033 |
| 3.75 | 0 | 0.033 | 0.033 | 0.167 | 0 | 0 | 0 | 0 | 0 | 0.233 |
| 4.25 | 0.033 | 0.1 | 0.167 | 0.2 | 0.067 | 0 | 0 | 0 | 0 | 0.567 |
| (A2) | 0.433 | 2.1 | 3.8 | 2.167 | 0.233 | 0 | 0 | 0 | 0 | 8.9 |
| 4.75 | | | | | | | | | | |
| 5.25 | 1.933 | 5.3 | 4.767 | 2.367 | 0.2 | 0 | 0 | 0 | 0 | 15.03 |
| 5.75 | 4.567 | 6.6 | 5.1 | 0.667 | 0.1 | 0 | 0 | 0 | 0 | 19.5 |
| (A1) | 6.8 | 7.167 | 4.733 | 1.133 | 0.167 | 0 | 0 | 0 | 0 | 27.83 |
| 6.25 | | | | | | | | | | |
| 6.75 | 5.267 | 3.3 | 2.3 | 0.567 | 0.1 | 0 | 0 | 0 | 0 | 20.8 |
| 7.25 | 0.9 | 0.533 | 0.4 | 0.133 | 0 | 0 | 0 | 0 | 0 | 5.2 |
| 7.75 | 0.3 | 0.067 | 0.067 | 0.033 | 0 | 0 | 0 | 0 | 0 | 1.3 |
| 8.25 | 0 | 0 | 0 | 0 | 0 | 0 | 0 | 0 | 0 | 0.1 |
| 8.75 | 0.033 | 0 | 0 | 0 | 0 | 0 | 0 | 0 | 0 | 0.233 |
| 9.25 | 0 | 0 | 0 | 0 | 0 | 0 | 0 | 0 | 0 | 0 |
| 9.75 | 0 | 0 | 0 | 0 | 0 | 0 | 0 | 0 | 0 | 0.033 |

Figure 6:
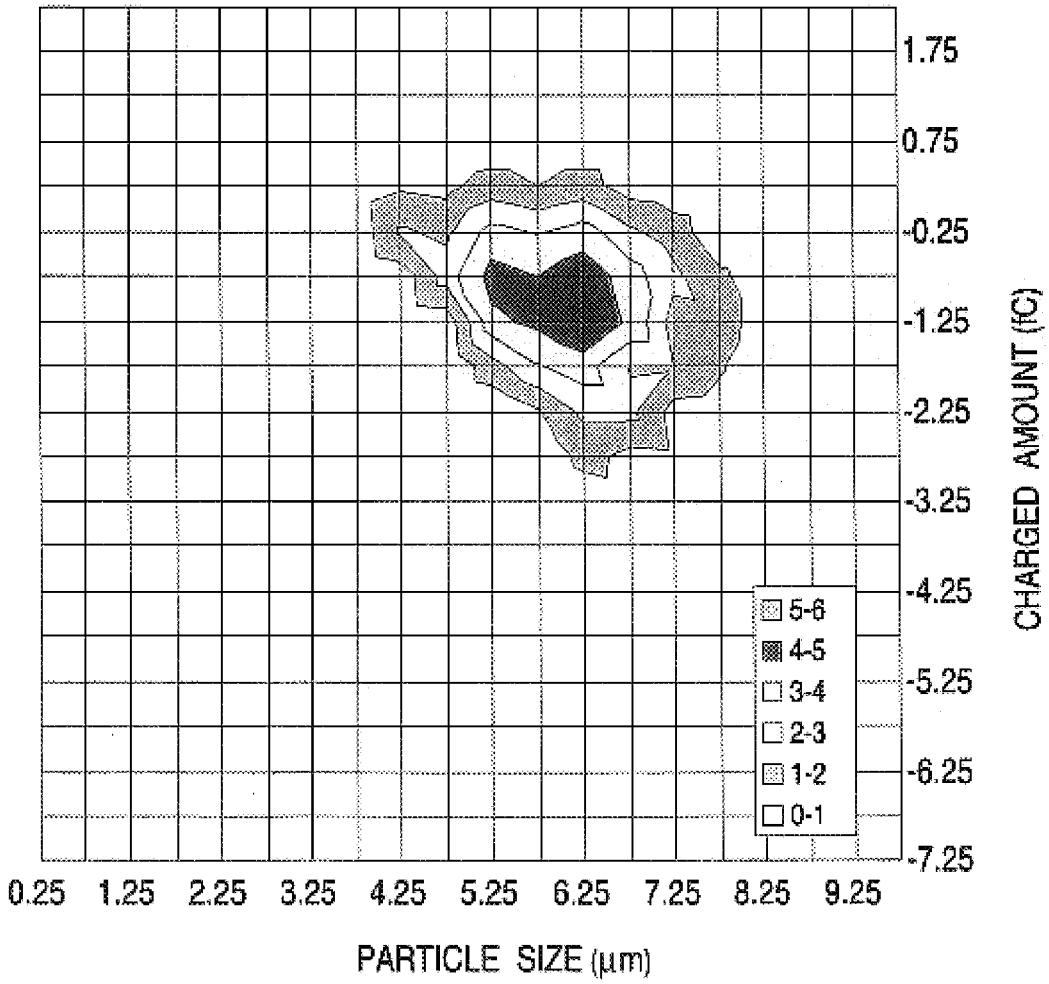
FIG. 6 is a drawing illustrating the particle size-charged amount distribution of Example 1-3.

About 3,000 particles of the toner thus charged were then measured for particle size and charged amount. The measurements are set forth in detail in Table 1-3 and shown in the form of three-dimensional graph in FIG. 6. As can be seen in Table 1-3, the particle size divisional value A1 [μm] and the charged amount divisional value B1 [fC] in the division where there is the largest number proportion of the toner particles, the particle size divisional value A2 [μm] where the particulate toner has the smallest particle size in the particle size distribution indicating that the number proportion of the toner particles is 1% or more and the charged amount divisional value B2 [fC] where there is the largest number proportion of the toner particles when the particle size division is A2 defined above are 6.25, −1.25, 4.25 and −0.25, respectively, as set forth in Table 1-7. The formula (k1) among these divisional values is 0.50, which satisfies the aforementioned formulas 1 and 2. The sum (k2) of the number proportions of the toner particles having a smaller particle size divisional value than A1 as defined above was 44%. As can be seen in the results of evaluation set forth in Table 1-8, the edge effect was effectively inhibited, making it possible to form an image having a uniform development density which varies little from edge to center. No fogging occurred.

TABLE 1-3

| Particle size | Charged amount [fC] | | | | | | | | | | |
|---|---|---|---|---|---|---|---|---|---|---|---|
| [μm] | −7.25 | −6.75 | −6.25 | −5.75 | −5.25 | −4.75 | −4.25 | −3.75 | −3.25 | −2.75 | −2.25 |
| 0.25 | 0 | 0 | 0 | 0 | 0 | 0 | 0 | 0 | 0 | 0 | 0 |
| 0.75 | 0 | 0 | 0 | 0 | 0 | 0 | 0 | 0 | 0 | 0 | 0 |
| 1.25 | 0 | 0 | 0 | 0 | 0 | 0 | 0 | 0 | 0 | 0 | 0 |
| 1.75 | 0 | 0 | 0 | 0 | 0 | 0 | 0 | 0 | 0 | 0 | 0 |
| 2.25 | 0 | 0 | 0 | 0 | 0 | 0 | 0 | 0 | 0 | 0 | 0 |
| 2.75 | 0 | 0 | 0 | 0 | 0 | 0 | 0 | 0 | 0 | 0 | 0 |
| 3.25 | 0 | 0 | 0 | 0 | 0 | 0 | 0 | 0 | 0 | 0 | 0 |
| 3.75 | 0 | 0 | 0 | 0 | 0 | 0 | 0 | 0 | 0 | 0 | 0 |
| (A2) | 0 | 0 | 0 | 0 | 0 | 0 | 0 | 0 | 0 | 0 | 0 |
| 4.25 | | | | | | | | | | | |
| 4.75 | 0 | 0 | 0 | 0 | 0 | 0 | 0 | 0 | 0.033 | 0 | 0 |
| 5.25 | 0 | 0 | 0 | 0 | 0 | 0 | 0.033 | 0 | 0 | 0.033 | 0.067 |
| 5.75 | 0 | 0 | 0 | 0 | 0 | 0 | 0.033 | 0 | 0.033 | 0.30 | 0.9 |
| (A1) | 0 | 0 | 0 | 0 | 0 | 0 | 0.2 | 0.2 | 0.433 | 1.3 | 2.267 |
| 6.25 | | | | | | | | | | | |
| 6.75 | 0 | 0.033 | 0.067 | 0.033 | 0.1 | 0.1 | 0.133 | 0.5 | 0.7 | 0.733 | 2.267 |
| 7.25 | 0 | 0 | 0.1 | 0.067 | 0 | 0.133 | 0.267 | 0.367 | 0.267 | 0.8 | 0.567 |
| 7.75 | 0.133 | 0 | 0.067 | 0.1 | 0.133 | 0.067 | 0.2 | 0.1 | 0.167 | 0.433 | 0.533 |
| 8.25 | 0 | 0 | 0 | 0 | 0 | 0 | 0 | 0.033 | 0 | 0 | 0.067 |
| 8.75 | 0 | 0 | 0 | 0 | 0 | 0 | 0 | 0 | 0.033 | 0 | 0.133 |
| 9.25 | 0 | 0 | 0 | 0 | 0 | 0 | 0 | 0 | 0.067 | 0.067 | 0 |
| 9.75 | 0 | 0 | 0 | 0 | 0 | 0 | 0 | 0 | 0.033 | 0 | 0 |

| Particle size | Charged amount [fC] | | | | | | | | | |
|---|---|---|---|---|---|---|---|---|---|---|
| | | (B1) | | (B2) | | | | | | |
| [μm] | −1.75 | −1.25 | −0.75 | −0.25 | 0.25 | 0.75 | 1.25 | 1.75 | 2.25 | |
| 0.25 | 0 | 0 | 0 | 0 | 0 | 0 | 0 | 0 | 0 | 0 |
| 0.75 | 0 | 0 | 0 | 0 | 0 | 0 | 0 | 0 | 0 | 0 |
| 1.25 | 0 | 0 | 0 | 0 | 0 | 0 | 0 | 0 | 0 | 0 |
| 1.75 | 0 | 0 | 0 | 0 | 0 | 0 | 0 | 0 | 0 | 0 |
| 2.25 | 0 | 0 | 0 | 0 | 0 | 0 | 0 | 0 | 0 | 0 |
| 2.75 | 0 | 0 | 0 | 0 | 0 | 0 | 0 | 0 | 0 | 0 |
| 3.25 | 0 | 0 | 0 | 0.033 | 0 | 0 | 0 | 0 | 0 | 0.033 |
| 3.75 | 0 | 0 | 0.067 | 0.367 | 0.4 | 0.033 | 0 | 0 | 0 | 0.867 |
| (A2) | 0 | 0.1 | 0.433 | 2.167 | 0.833 | 0.067 | 0 | 0 | 0 | 3.6 |
| 4.25 | | | | | | | | | | |
| 4.75 | 0.033 | 0.3 | 2.5 | 1.767 | 0.7 | 0.1 | 0 | 0 | 0.033 | 5.467 |
| 5.25 | 1.567 | 3.733 | 4.367 | 3.367 | 1.467 | 0.233 | 0 | 0.033 | 0 | 14.9 |
| 5.75 | 2.933 | 4.233 | 4.033 | 2.933 | 1.033 | 0.2 | 0.067 | 0 | 0.033 | 16.7 |
| (A1) | 3.467 | 5.033 | 4.733 | 3.5 | 1.467 | 0.233 | 0.033 | 0 | 0 | 22.87 |
| 6.25 | | | | | | | | | | |
| 6.75 | 1.933 | 3.8 | 3.5 | 2.2 | 0.467 | 0.2 | 0.33 | 0 | 0 | 16.8 |
| 7.25 | 1.967 | 1.633 | 2.267 | 1.533 | 0.3 | 0.067 | 0 | 0 | 0 | 10.33 |
| 7.75 | 1.133 | 1.733 | 1.233 | 0.2 | 0.1 | 0.133 | 0.133 | 0 | 0 | 6.467 |
| 8.25 | 0.1 | 0.3 | 0.333 | 0.1 | 0.1 | 0 | 0 | 0 | 0 | 1.033 |
| 8.75 | 0.1 | 0.033 | 0.067 | 0.067 | 0 | 0 | 0 | 0 | 0 | 0.433 |
| 9.25 | 0.133 | 0.067 | 0 | 0 | 0 | 0.033 | 0 | 0 | 0 | 0.367 |
| 9.75 | 0 | 0 | 0 | 0 | 0 | 0 | 0 | 0 | 0 | 0.033 |

Comparative Example 1-1

To the same toner mother particles as used in Example 1-2 were then added 0.2 wt % of a large particle size silica (Type RX50; produced by NIPPON AEROSIL CO., LTD.), 0.5 wt % of a small particle size silica (Type RX300; produced by NIPPON AEROSIL CO., LTD.) and 1.5 wt % of titanium (STT-30S, produced by TITAN KOGYO KABUSHIKI KAISHA) as external additives. The mixture was then processed at a rotary speed of 2,000 rpm for 2 minutes using a small-sized stirrer.

The toner thus obtained was then negatively charged in a non-contact process development device similar to that of FIG. 2. The regulating pressure of the regulating blade was 36 gf/cm and the amount of the toner to be conveyed was 0.355 mg/cm$^2$. The conveying speed was adjusted to 310 mm/sec.

Figure 7:
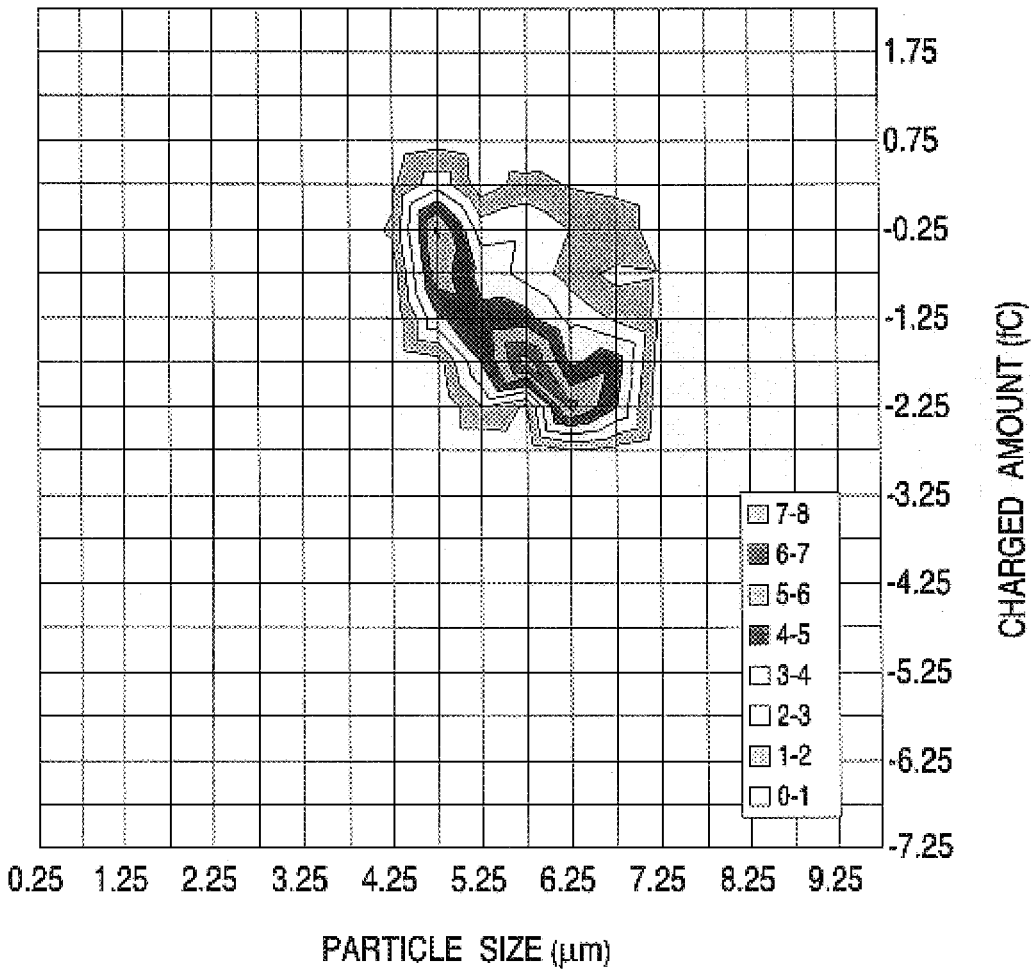
FIG. 7 is a drawing illustrating the particle size-charged amount distribution of Comparative Example 1-1.

About 3,000 particles of the toner thus charged were then measured for particle size and charged amount. The measurements are set forth in detail in Table 1-4 and shown in the form of three-dimensional graph in FIG. 7. As can be seen in Table 1-4, the particle size divisional value A1 ([μm] and the charged amount divisional value B1 [fC] in the division where there is the largest number proportion of the toner particles, the particle size divisional value A2 [μm] where the particulate toner has the smallest particle size in the particle size distribution indicating that the number proportion of the toner particles is 1% or more and the charged amount divisional value B2 [fC] where there is the largest number proportion of the toner particles when the particle size division is A2 defined above are 5.75, −1.75, 4.25 and −0.25, respectively, as set forth in Table 1-7. The formula (k1) among these divisional values is 1.00, which doesn't satisfy the aforementioned formula 1. Further, as can be seen in the results of evaluation set forth in Table 1-8, the edge effect was remarkably developed, giving a remarkable density difference between the edge and the central portion.

TABLE 1-4

| Particle size | Charged amount [fC] | | | | | | | | | | |
|---|---|---|---|---|---|---|---|---|---|---|---|
| [μm] | −7.25 | −6.75 | −6.25 | −5.75 | −5.25 | −4.75 | −4.25 | −3.75 | −3.25 | −2.75 | −2.25 |
| 0.25 | 0 | 0 | 0 | 0 | 0 | 0 | 0 | 0 | 0 | 0 | 0 |
| 0.75 | 0 | 0 | 0 | 0 | 0 | 0 | 0 | 0 | 0 | 0 | 0 |
| 1.25 | 0 | 0 | 0 | 0 | 0 | 0 | 0 | 0 | 0 | 0 | 0 |
| 1.75 | 0 | 0 | 0 | 0 | 0 | 0 | 0 | 0 | 0 | 0 | 0 |
| 2.25 | 0 | 0 | 0 | 0 | 0 | 0 | 0 | 0 | 0 | 0 | 0 |
| 2.75 | 0 | 0 | 0 | 0 | 0 | 0 | 0 | 0 | 0 | 0 | 0 |
| 3.25 | 0 | 0 | 0 | 0 | 0 | 0 | 0 | 0 | 0 | 0 | 0 |
| 3.75 | 0 | 0 | 0 | 0 | 0 | 0 | 0 | 0 | 0 | 0 | 0 |
| (A2) | 0 | 0 | 0 | 0 | 0 | 0 | 0 | 0 | 0 | 0 | 0 |
| 4.25 | | | | | | | | | | | |
| 4.75 | 0 | 0 | 0 | 0 | 0 | 0 | 0 | 0 | 0 | 0 | 0.067 |
| 5.25 | 0 | 0 | 0 | 0 | 0 | 0 | 0.033 | 0.033 | 0 | 0 | 2 |
| (A1) | 0 | 0 | 0 | 0 | 0 | 0 | 0 | 0 | 0.033 | 0.133 | 0.833 |
| 5.75 | | | | | | | | | | | |
| 6.25 | 0 | 0 | 0 | 0 | 0 | 0.033 | 0.1 | 0.133 | 0.533 | 0.833 | 6.267 |
| 6.75 | 0 | 0 | 0 | 0 | 0 | 0.1 | 0.133 | 0.233 | 0.367 | 0.6 | 4.033 |
| 7.25 | 0.033 | 0 | 0 | 0.067 | 0.1 | 0.1 | 0.033 | 0.067 | 0.067 | 0.067 | 0.167 |
| 7.75 | 0.033 | 0 | 0 | 0.033 | 0 | 0 | 0 | 0 | 0 | 0.067 | 0.033 |
| 8.25 | 0 | 0 | 0 | 0 | 0 | 0 | 0 | 0 | 0 | 0.033 | 0.033 |
| 8.75 | 0 | 0 | 0 | 0 | 0 | 0 | 0 | 0.033 | 0.1 | 0 | 0.033 |
| 9.25 | 0 | 0 | 0 | 0 | 0 | 0 | 0 | 0 | 0 | 0 | 0 |
| 9.75 | 0 | 0 | 0 | 0 | 0 | 0 | 0 | 0 | 0 | 0 | 0 |

| Particle size | Charged amount [fC] | | | | | | | | | |
|---|---|---|---|---|---|---|---|---|---|---|
| [μm] | (B1) −1.75 | −1.25 | −0.75 | (B2) −0.25 | 0.25 | 0.75 | 1.25 | 1.75 | 2.25 | |
| 0.25 | 0 | 0 | 0 | 0 | 0 | 0 | 0 | 0 | 0 | 0 |
| 0.75 | 0 | 0 | 0 | 0 | 0 | 0 | 0 | 0 | 0 | 0 |
| 1.25 | 0 | 0 | 0 | 0 | 0 | 0 | 0 | 0 | 0 | 0 |
| 1.75 | 0 | 0 | 0 | 0 | 0 | 0.033 | 0 | 0 | 0 | 0.033 |
| 2.25 | 0 | 0 | 0 | 0 | 0 | 0 | 0 | 0 | 0 | 0 |
| 2.75 | 0 | 0 | 0 | 0 | 0 | 0 | 0 | 0 | 0 | 0 |
| 3.25 | 0 | 0 | 0 | 0.1 | 0.267 | 0 | 0 | 0 | 0 | 0.367 |
| 3.75 | 0 | 0 | 0.067 | 0.4 | 0.1 | 0.033 | 0 | 0 | 0 | 0.6 |
| (A2) | 0.033 | 0.067 | 0.5 | 1.133 | 0.733 | 0.3 | 0.033 | 0 | 0 | 2.8 |
| 4.25 | | | | | | | | | | |
| 4.75 | 0.633 | 3.933 | 5.633 | 6.133 | 2.767 | 0.6 | 0 | 0 | 0 | 19.77 |
| 5.25 | 4.033 | 4.267 | 3.633 | 2.6 | 0.367 | 0.233 | 0 | 0 | 0 | 17.2 |
| (A1) | 7.433 | 4.367 | 2.633 | 2.8 | 1.4 | 0.033 | 0.033 | 0 | 0.033 | 19.7 |
| 5.75 | | | | | | | | | | |
| 6.25 | 3.733 | 2.733 | 1.6 | 2 | 0.9 | 0.133 | 0 | 0 | 0 | 19 |
| 6.75 | 4.633 | 1.833 | 0.7 | 2 | 0.633 | 0.067 | 0.033 | 0 | 0 | 15.37 |
| 7.25 | 0.6 | 0.767 | 0.9 | 0.2 | 0.167 | 0 | 0 | 0 | 0 | 3.333 |
| 7.75 | 0.167 | 0.233 | 0.167 | 0.033 | 0 | 0 | 0 | 0 | 0 | 0.767 |
| 8.25 | 0 | 0 | 0 | 0 | 0 | 0 | 0 | 0 | 0 | 0.067 |
| 8.75 | 0.067 | 0.033 | 0 | 0.067 | 0 | 0 | 0 | 0 | 0 | 0.333 |
| 9.25 | 0 | 0 | 0 | 0 | 0 | 0 | 0 | 0 | 0 | 0 |
| 9.75 | 0.033 | 0 | 0 | 0 | 0 | 0 | 0 | 0 | 0 | 0.033 |

Comparative Example 1-2

To the same toner mother particles as used in Example 1-2 were then added 0.3 wt % of a large particle size silica (Type RX50; produced by NIPPON AEROSIL CO., LTD.), 0.7 wt % of a small particle size silica (Type RX300; produced by NIPPON AEROSIL CO., LTD.) and 0.5 wt % of titanium (STT-30S, produced by TITAN KOGYO KABUSHIKI KAISHA) as external additives. The mixture was then processed at a rotary speed of 2,000 rpm for 2 minutes using a small-sized stirrer.

The toner thus obtained was then negatively charged in a non-contact process development device similar to that of FIG. 2. The regulating pressure of the regulating blade was 35 gf/cm and the amount of the toner to be conveyed was 0.351 mg/cm$^2$. The conveying speed was adjusted to 310 mm/sec.

Figure 8:
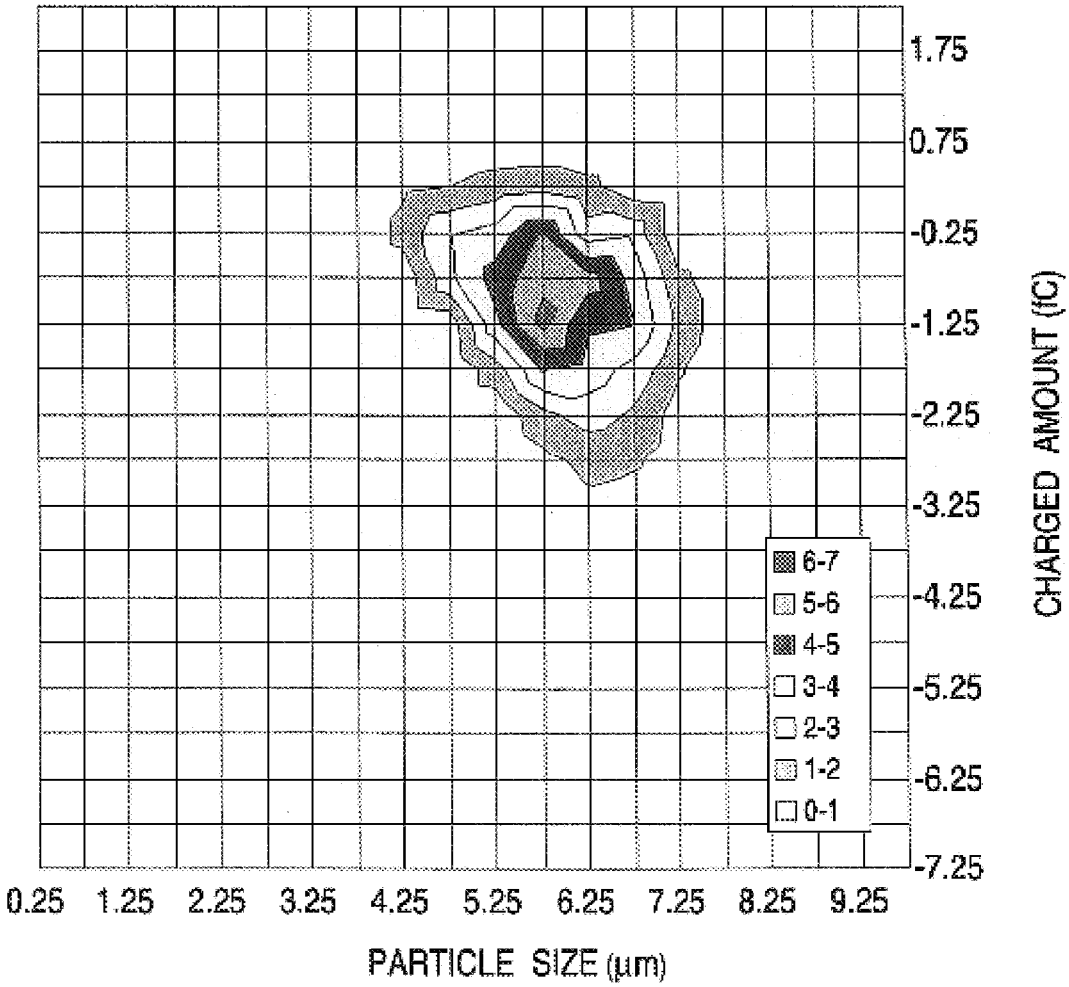
FIG. 8 is a drawing illustrating the particle size-charged amount distribution of Comparative Example 1-2.

About 3,000 particles of the toner thus charged were then measured for particle size and charged amount. The measurements are set forth in detail in Table 1-5 and shown in the form of three-dimensional graph in FIG. 8. As can be seen in Table 1-5, the particle size divisional value A1 [μm] and the charged amount divisional value B1 [fC] in the division where there is the largest number proportion of the toner particles, the particle size divisional value A2 [μm] where the particulate toner has the smallest particle size in the particle size distribution indicating that the number proportion of the toner particles is 1% or more and the charged amount divisional value B2 [fC] where there is the largest number proportion of the toner particles when the particle size division is A2 defined above are 5.75, −1.25, 4.25 and −0.25, respectively, as set forth in Table 1-7. The formula (k1) among these divisional values is 0.667, which doesn't satisfy the aforementioned formula 1. Further, as can be seen in the results of evaluation set forth in Table 1-8, the edge effect was remarkably developed, giving a remarkable density difference between the edge and the central portion.

TABLE 1-5

| Particle size | Charged amount [fC] | | | | | | | | | | |
|---|---|---|---|---|---|---|---|---|---|---|---|
| [μm] | −7.25 | −6.75 | −6.25 | −5.75 | −5.25 | −4.75 | −4.25 | −3.75 | −3.25 | −2.75 | −2.25 |
| 0.25 | 0 | 0 | 0 | 0 | 0 | 0 | 0 | 0 | 0 | 0 | 0 |
| 0.75 | 0 | 0 | 0 | 0 | 0 | 0 | 0 | 0 | 0 | 0 | 0 |
| 1.25 | 0 | 0 | 0 | 0 | 0 | 0 | 0 | 0 | 0 | 0 | 0 |
| 1.75 | 0 | 0 | 0 | 0 | 0 | 0 | 0 | 0 | 0 | 0 | 0 |
| 2.25 | 0 | 0 | 0 | 0 | 0 | 0 | 0 | 0 | 0 | 0 | 0 |
| 2.75 | 0 | 0 | 0 | 0 | 0 | 0 | 0 | 0 | 0 | 0 | 0 |
| 3.25 | 0 | 0 | 0 | 0 | 0 | 0 | 0 | 0 | o | 0 | 0 |
| 3.75 | 0 | 0 | 0 | 0 | 0 | 0 | 0 | 0 | 0 | 0 | 0 |
| (A2) | 0 | 0 | 0 | 0 | 0 | 0 | 0 | 0 | 0 | 0 | 0 |
| 4.25 | | | | | | | | | | | |
| 4.75 | 0 | 0 | 0 | 0 | 0 | 0 | 0 | 0 | 0.033 | 0 | 0 |
| 5.25 | 0 | 0 | 0 | 0 | 0 | 0 | 0.033 | 0 | 0 | 0.033 | 0.067 |
| (A1) | 0 | 0 | 0 | 0 | 0 | 0 | 0.1 | 0.033 | 0.1 | 0.733 | 1.733 |
| 5.75 | | | | | | | | | | | |
| 6.25 | 0 | 0 | 0.033 | 0.033 | 0.033 | 0.033 | 0.2 | 0.3 | 0.8 | 1.267 | 2.433 |
| 6.75 | 0 | 0.033 | 0.133 | 0.067 | 0.067 | 0.2 | 0.033 | 0.733 | 0.533 | 1.133 | 1.833 |
| 7.25 | 0.133 | 0 | 0.067 | 0.1 | 0.133 | 0.067 | 0.2 | 0.1 | 0.167 | 0.433 | 0.533 |
| 7.75 | 0 | 0 | 0 | 0 | 0 | 0 | 0 | 0.033 | 0.033 | 0 | 0.133 |
| 8.25 | 0 | 0 | 0 | 0 | 0 | 0 | 0 | 0 | 0.033 | 0.033 | 0.067 |
| 8.75 | 0 | 0 | 0 | 0 | 0 | 0 | 0 | 0 | 0.067 | 0.033 | 0 |
| 9.25 | 0 | 0 | 0 | 0 | 0 | 0 | 0 | 0 | 0 | 0 | 0.033 |
| 9.75 | 0 | 0 | 0 | 0 | 0 | 0 | 0 | 0 | 0 | 0 | 0 |

| Particle size | Charged amount [fC] | | | | | | | | | |
|---|---|---|---|---|---|---|---|---|---|---|
| [μm] | −1.75 | (B1) −1.25 | −0.75 | (B2) −0.25 | 0.25 | 0.75 | 1.25 | 1.75 | 2.25 | |
| 0.25 | 0 | 0 | 0 | 0 | 0 | 0 | 0 | 0 | 0 | 0 |
| 0.75 | 0 | 0 | 0 | 0 | 0 | 0 | 0 | 0 | 0 | 0 |
| 1.25 | 0 | 0 | 0 | 0 | 0 | 0 | 0 | 0 | 0 | 0 |
| 1.75 | 0 | 0 | 0 | 0 | 0 | 0 | 0 | 0 | 0 | 0 |
| 2.25 | 0 | 0 | 0 | 0 | 0 | 0 | 0 | 0 | 0 | 0 |
| 2.75 | 0 | 0 | 0 | 0 | 0 | 0 | 0 | 0 | 0 | 0 |
| 3.25 | 0 | 0 | 0 | 0 | 0 | 0 | 0 | 0 | 0 | 0 |
| 3.75 | 0 | 0 | 0 | 0.1 | 0.167 | 0 | 0 | 0 | 0 | 0.267 |
| (A2) | 0 | 0.033 | 0.233 | 1.333 | 0.767 | 0.1 | 0 | 0 | 0 | 2.467 |
| 4.25 | | | | | | | | | | |
| 4.75 | 0.033 | 0.367 | 2.767 | 2.9 | 1 | 0.1 | 0 | 0 | 0.033 | 7.233 |
| 5.25 | 1.567 | 3.733 | 4.367 | 3.367 | 1.467 | 0.233 | 0 | 0.033 | 0 | 14.9 |
| (A1) | 4.067 | 6.267 | 5.8 | 5.067 | 1.6 | 0.3 | 0.1 | 0 | 0 | 25.9 |
| 5.75 | | | | | | | | | | |
| 6.25 | 3.6 | 4.133 | 5.433 | 2.367 | 1.267 | 0.233 | 0 | 0 | 0 | 22.17 |
| 6.75 | 2.633 | 4 | 3.6 | 2.733 | 0.4 | 0.167 | 0.033 | 0 | 0 | 18.63 |
| 7.25 | 1.133 | 1.733 | 1.233 | 0.2 | 0.1 | 0.133 | 0 | 0 | 0 | 6.467 |
| 7.75 | 0.133 | 0.3 | 0.367 | 0.133 | 0.1 | 0 | 0 | 0 | 0 | 1.233 |
| 8.25 | 0.133 | 0.1 | 0.033 | 0.033 | 0 | 0.033 | 0 | 0 | 0 | 0.467 |
| 8.75 | 0.067 | 0 | 0 | 0 | 0 | 0 | 0 | 0 | 0 | 0.167 |
| 9.25 | 0 | 0 | 0 | 0 | 0 | 0 | 0 | 0 | 0 | 0.033 |
| 9.75 | 0 | 0 | 0 | 0 | 0 | 0 | 0 | 0 | 0 | 0 |

Comparative Example 1-3

To the same toner mother particles as used in Example 1-2 were then added 0.2 wt % of a large particle size silica (Type RX50; produced by NIPPON AEROSIL CO., LTD.), 0.5 wt % of a small particle size silica (Type RX300; produced by NIPPON AEROSIL CO., LTD.) and 2.0 wt % of titanium (STT-30S, produced by TITAN KOGYO KABUSHIKI KAISHA) as external additives. The mixture was then processed at a rotary speed of 2,000 rpm for 2 minutes using a small-sized stirrer.

The toner thus obtained was then negatively charged in a non-contact process development device similar to that of FIG. 2. The regulating pressure of the regulating blade was 31 gf/cm and the amount of the toner to be conveyed was 0.342 mg/cm$^2$. The conveying speed was adjusted to 310 mm/sec.

Figure 9:
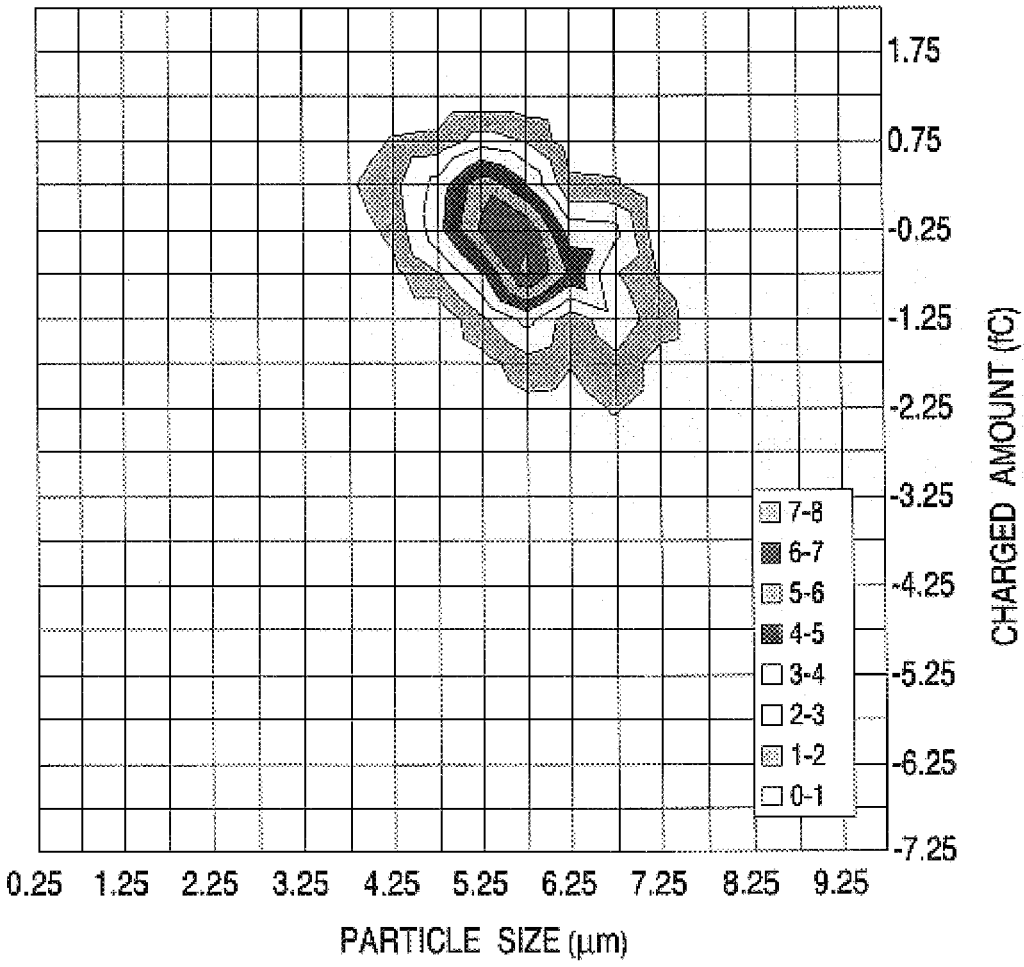
FIG. 9 is a drawing illustrating the particle size-charged amount distribution of Comparative Example 1-3.

About 3,000 particles of the toner thus charged were then measured for particle size and charged amount. The measurements are set forth in detail in Table 1-6 and shown in the form of three-dimensional graph in FIG. 9. As can be seen in Table 1-6, the particle size divisional value A1 [μm] and the charged amount divisional value B1 [fC] in the division where there is the largest number proportion of the toner particles, the particle size divisional value A2 [μm] where the particulate toner has the smallest particle size in the particle size distribution indicating that the number proportion of the toner particles is 1% or more and the charged amount divisional value B2 [fC] where there is the largest number proportion of the toner particles when the particle size division is A2 defined above are 5.75, −0.75, 3.75 and −0.25, respectively, as set forth in Table 1-7. The formula (k1) among these divisional values is 0.50, which doesn't satisfy the aforementioned formula 2. Further, as can be seen in the results of evaluation set forth in Table 1-8, an edge effect was developed. Further, much fogging occurred.

TABLE 1-6

| Particle size | Charged amount [fC] | | | | | | | | | | |
|---|---|---|---|---|---|---|---|---|---|---|---|
| [μm] | −7.25 | −6.75 | −6.25 | −5.75 | −5.25 | −4.75 | −4.25 | −3.75 | −3.25 | −2.75 | −2.25 |
| 0.25 | 0 | 0 | 0 | 0 | 0 | 0 | 0 | 0 | 0 | 0 | 0 |
| 0.75 | 0 | 0 | 0 | 0 | 0 | 0 | 0 | 0 | 0 | 0 | 0 |
| 1.25 | 0 | 0 | 0 | 0 | 0 | 0 | 0 | 0 | 0 | 0 | 0 |
| 1.75 | 0 | 0 | 0 | 0 | 0 | 0 | 0 | 0 | 0 | 0 | 0 |
| 2.25 | 0 | 0 | 0 | 0 | 0 | 0 | 0 | 0 | 0 | 0 | 0 |
| 2.75 | 0 | 0 | 0 | 0 | 0 | 0 | 0 | 0 | 0 | 0 | 0 |
| 3.25 | 0 | 0 | 0 | 0 | 0 | 0 | 0 | 0 | 0 | 0 | 0 |
| (A2) | 0 | 0 | 0 | 0 | 0 | 0 | 0 | 0 | 0 | 0 | 0 |
| 3.75 | | | | | | | | | | | |
| 4.25 | 0 | 0 | 0 | 0 | 0 | 0 | 0 | 0 | 0 | 0 | 0 |
| 4.75 | 0 | 0 | 0 | 0 | 0 | 0 | 0 | 0 | 0 | 0 | 0.033 |
| 5.25 | 0 | 0 | 0 | 0 | 0 | 0 | 0 | 0 | 0.033 | 0.033 | 0.1 |
| (A1) | 0 | 0 | 0 | 0 | 0 | 0 | 0 | 0.033 | 0.067 | 0.333 | 0.633 |
| 5.75 | | | | | | | | | | | |
| 6.25 | 0 | 0 | 0 | 0 | 0 | 0.033 | 0 | 0.033 | 0.067 | 0.2 | 0.567 |
| 6.75 | 0 | 0.033 | 0 | 0.033 | 0 | 0.067 | 0.1 | 0.133 | 0.433 | 0.467 | 1.1 |
| 7.25 | 0 | 0 | 0.033 | 0.033 | 0 | 0.1 | 0.1 | 0.033 | 0.267 | 0.133 | 0.5 |
| 7.75 | 0 | 0 | 0.033 | 0 | 0.033 | 0.033 | 0.033 | 0.067 | 0 | 0.067 | 0.033 |
| 8.25 | 0 | 0 | 0 | 0 | 0 | 0.033 | 0 | 0.1 | 0.033 | 0.033 | 0.1 |
| 8.75 | 0 | 0 | 0 | 0 | 0 | 0 | 0 | 0 | 0 | 0 | 0 |
| 9.25 | 0 | 0 | 0 | 0 | 0 | 0 | 0 | 0 | 0 | 0 | 0 |
| 9.75 | 0 | 0 | 0 | 0 | 0 | 0 | 0 | 0 | 0 | 0 | 0 |

| Particle size | Charged amount [fC] | | | | | | | | | |
|---|---|---|---|---|---|---|---|---|---|---|
| [μm] | −1.75 | −1.25 | (B1) −0.75 | −0.25 | (B2) 0.25 | 0.75 | 1.25 | 1.75 | 2.25 | |
| 0.25 | 0 | 0 | 0 | 0 | 0 | 0 | 0 | 0 | 0 | 0 |
| 0.75 | 0 | 0 | 0 | 0 | 0 | 0 | 0 | 0 | 0 | 0 |
| 1.25 | 0 | 0 | 0 | 0 | 0 | 0 | 0 | 0 | 0 | 0 |
| 1.75 | 0 | 0 | 0 | 0 | 0 | 0 | 0 | 0 | 0 | 0 |
| 2.25 | 0 | 0 | 0 | 0.033 | 0.033 | 0 | 0 | 0 | 0 | 0.067 |
| 2.75 | 0 | 0 | 0.033 | 0.167 | 0.233 | 0.067 | 0 | 0 | 0 | 0.5 |
| 3.25 | 0 | 0 | 0.1 | 0.233 | 0.367 | 0.1 | 0.033 | 0 | 0 | 0.833 |
| (A2) | 0 | 0 | 0.2 | 0.5 | 0.833 | 0.033 | 0 | 0 | 0 | 1.867 |
| 3.75 | | | | | | | | | | |
| 4.25 | 0 | 0.067 | 0.7 | 1.233 | 1.667 | 1.1 | 0.033 | 0 | 0 | 4.8 |
| 4.75 | 0 | 0.167 | 2 | 3.733 | 3.433 | 1.3 | 0.167 | 0 | 0 | 10.83 |
| 5.25 | 0.533 | 1.867 | 3.933 | 6.167 | 5.733 | 2.533 | 0.267 | 0 | 0.033 | 21.23 |
| (A1) | 1.7 | 3.333 | 7.133 | 6.9 | 4.133 | 1.967 | 0.133 | 0 | 0 | 26.37 |
| 5.75 | | | | | | | | | | |
| 6.25 | 1.067 | 1.433 | 4.833 | 3.567 | 1.233 | 0.467 | 0 | 0 | 0 | 13.5 |
| 6.75 | 1.8 | 2.567 | 2.133 | 3.333 | 1.167 | 0.4 | 0.033 | 0 | 0 | 13.8 |
| 7.25 | 0.567 | 1.567 | 0.867 | 0.333 | 0.1 | 0.067 | 0 | 0 | 0 | 4.7 |
| 7.75 | 0.2 | 0.133 | 0.1 | 0.033 | 0.033 | 0 | 0 | 0 | 0 | 0.8 |
| 8.25 | 0.133 | 0.033 | 0 | 0 | 0 | 0 | 0 | 0 | 0 | 0.467 |
| 8.75 | 0 | 0 | 0 | 0 | 0 | 0 | 0 | 0 | 0 | 0 |
| 9.25 | 0 | 0 | 0 | 0 | 0 | 0 | 0 | 0 | 0 | 0 |
| 9.75 | 0 | 0 | 0 | 0 | 0 | 0 | 0 | 0 | 0 | 0 |

TABLE 1-7

| | A1 | B1 | A2 | B2 | k1 | k2 |
|---|---|---|---|---|---|---|
| Example 1-1 | 4.75 | −0.75 | 3.25 | −0.25 | 0.33 | 29 |
| Example 1-2 | 6.25 | −1.25 | 4.75 | −0.75 | 0.33 | 41 |
| Example 1-3 | 6.25 | −1.25 | 4.25 | −0.25 | 0.50 | 44 |
| Comparative Example 1-1 | 5.75 | −1.75 | 4.25 | −0.25 | 1.00 | — |

TABLE 1-7-continued

| | A1 | B1 | A2 | B2 | k1 | k2 |
|---|---|---|---|---|---|---|
| Comparative Example 1-2 | 5.75 | −1.25 | 4.25 | −0.25 | 0.667 | — |
| Comparative Example 1-3 | 5.75 | −0.75 | 3.75 | 0.25 | 0.50 | — |

TABLE 1-8

| | Resistance to edge effect (OD value difference) | Fogging resistance |
|---|---|---|
| Example 1-1 | Good (0.08) | Good |
| Example 1-2 | Excellent (0.04) | Good |
| Example 1-3 | Excellent (0.03) | Good |
| Comparative Example 1-1 | Poor (0.14) | Good |
| Comparative Example 1-2 | Poor (0.12) | Good |
| Comparative Example 1-3 | Poor (0.09) | Poor |

Example 2-1

A monomer mixture comprising 80 parts by weight of a styrene monomer, 20 parts by weight of butyl acrylate and 5 parts by weight of acrylic acid was added to a water-soluble mixture comprising 105 parts by weight of water, 1 part by weight of a nonionic emulsifier, 1.5 parts by weight of an anionic emulsifier and 0.55 parts by weight of potassium persulfate to obtain a lacteous resin emulsion having a particle size of 0.25 μm.

Subsequently, 200 parts by weight of the resin emulsion thus obtained, 20 parts by weight of a polyethylene wax emulsion (produced by Sanyo Chemical Industries, Ltd.) and 7 parts by weight of a phthalocyanine blue were dispersed in water containing 0.2 parts by weight of sodium dodecylbenzenesulfonate as a surface active agent. To the mixture was then added diethylamine to adjust the pH value thereof to 5.5. To the mixture was then added 0.3 parts by weight of aluminum sulfate as an electrolyte with stirring. Subsequently, the mixture was subjected to high speed stirring using a TK homomixer to undergo dispersion. To the mixture were then added 40 parts by weight of a styrene monomer, 10 parts by weight of butyl acrylate and 5 parts by weight of zinc salicylate together with 40 parts by weight of water. The mixture was then heated to 90° C. with stirring in a nitrogen stream. To the mixture was then added aqueous hydrogen peroxide. The mixture was then allowed to undergo polymerization for 5 hours to cause the growth of particles. After the termination of polymerization, with the pH value being adjusted to not lower than 5, the mixture was then heated to 95° C. where it was then allowed to stand for 5 hours to enhance the bonding strength of associated particles. Thereafter, the particulate material thus obtained was washed with water, and then vacuum-dried at 45° C. for 10 hours. Thus, toner mother particles having an average particle size of 7 μm were obtained.

To the toner mother particles having an particle size of 7 μm were then added 0.2 wt % of a large particle size silica (Type RX50; produced by NIPPON AEROSIL CO., LTD.), 0.5 wt % of a small particle size silica (Type RX300; produced by NIPPON AEROSIL CO., LTD.) and 0.7 wt % of titanium (STT-30S, produced by TITAN KOGYO KABUSHIKI KAISHA) as external additives. The mixture was then processed at a rotary speed of 2,000 rpm for 2 minutes using a small-sized stirrer.

The toner thus obtained was then negatively charged in a non-contact process development device similar to that of FIG. 2. The regulating pressure of the regulating blade was 36 gf/cm and the amount of the toner to be conveyed was 0.354 mg/cm$^2$. The conveying speed was adjusted to 310 mm/sec.

Figure 10:
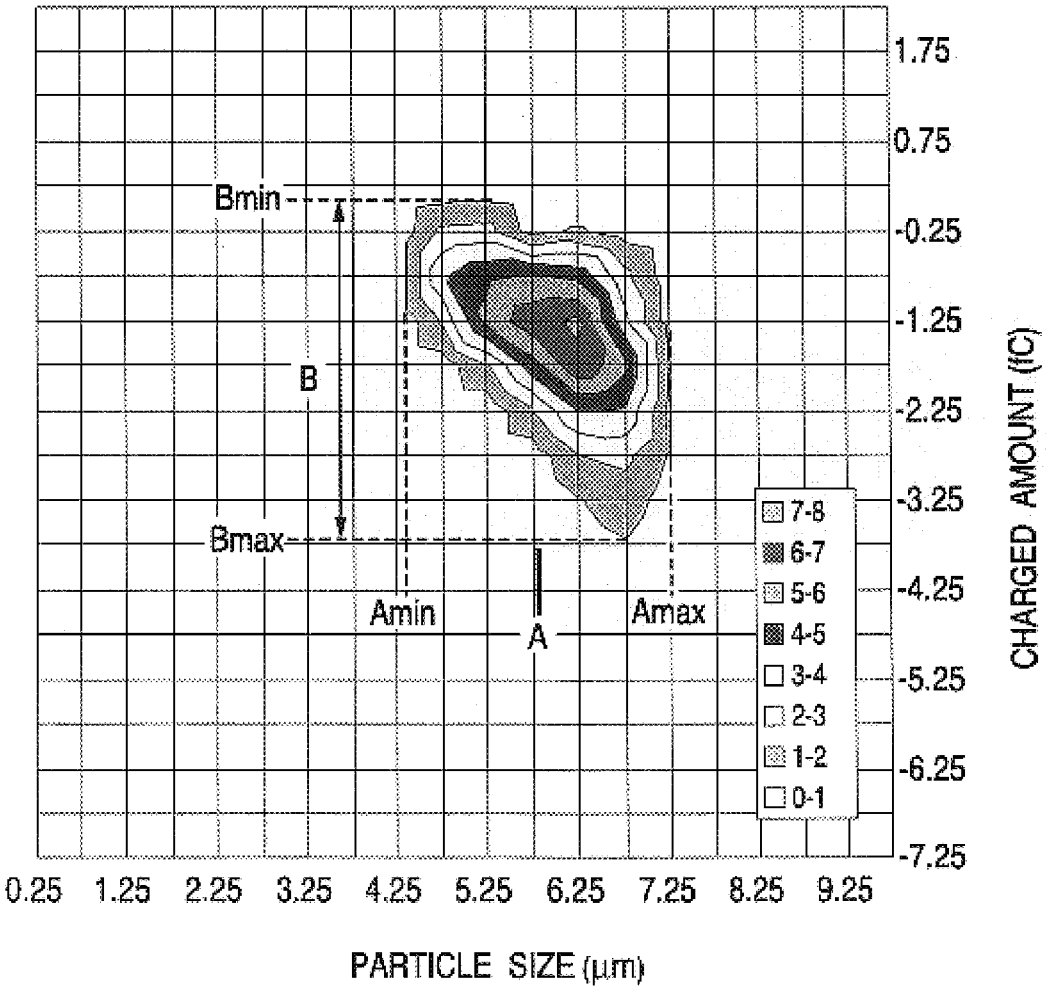
FIG. 10 is a drawing illustrating the particle size-charged amount distribution of Example 2-1.

About 3,000 particles of the toner thus charged were then measured for particle size and charged amount. The measurements are shown in FIG. 10 and are set forth in detail in Table 2-1. As can be seen in FIG. 10, the center value in the toner particle size distribution [sign A (μm) in FIG. 10], the maximum charged amount [sign Bmax (fC) in FIG. 10], the minimum charged amount [sign Bmin (fC) in FIG. 10] and the width of the charged amount distribution [sign B (fC) in FIG. 10] were 5.86, −3.69, 0.07 and 3.76, respectively, which satisfy the formulas 3 to 5, as set forth in Table 2-9. As can be seen in the results of evaluation of Table 2-10, there occurred no problems of dot formation, fogging and background stain. As previously mentioned, only data of division defined by particle size every 0.5 μm and charged amount every 0.5 fC having toner particles in an amount of 1% or more of the total number of toner particles were reviewed.

TABLE 2-1

| Particle size | Charged amount [fC] | | | | | | | | | |
|---|---|---|---|---|---|---|---|---|---|---|
| [μm] | −7.25 | −6.75 | −6.25 | −5.75 | −5.25 | −4.75 | −4.25 | −3.75 | −3.25 | −2.75 |
| 0.25 | 0 | 0 | 0 | 0 | 0 | 0 | 0 | 0 | 0 | 0 |
| 0.75 | 0 | 0 | 0 | 0 | 0 | 0 | 0 | 0 | 0 | 0 |
| 1.25 | 0 | 0 | 0 | 0 | 0 | 0 | 0 | 0 | 0 | 0 |
| 1.75 | 0 | 0 | 0 | 0 | 0 | 0 | 0 | 0 | 0 | 0 |
| 2.25 | 0 | 0 | 0 | 0 | 0 | 0 | 0 | 0 | 0 | 0 |
| 2.75 | 0 | 0 | 0 | 0 | 0 | 0 | 0 | 0 | 0 | 0 |
| 3.25 | 0 | 0 | 0 | 0 | 0 | 0 | 0 | 0 | 0 | 0 |
| 3.75 | 0 | 0 | 0 | 0 | 0 | 0 | 0 | 0 | 0 | 0 |
| 4.25 | 0 | 0 | 0 | 0 | 0 | 0 | 0 | 0 | 0 | 0 |
| 4.75 | 0 | 0 | 0 | 0 | 0 | 0 | 0 | 0 | 0 | 0.033 |
| 5.25 | 0 | 0 | 0 | 0 | 0 | 0 | 0 | 0.067 | 0.033 | 0.133 |
| 5.75 | 0 | 0 | 0 | 0 | 0 | 0 | 0.033 | 0.1 | 0.033 | 0.4 |
| 6.25 | 0 | 0 | 0 | 0.033 | 0 | 0 | 0.2 | 0.6 | 0.933 | 2 |
| 6.75 | 0 | 0 | 0 | 0 | 0.067 | 0.133 | 0.567 | 0.933 | 1.467 | 2.267 |
| 7.25 | 0 | 0 | 0.033 | 0.133 | 0.067 | 0.267 | 0.267 | 0.033 | 0.5 | 0.867 |
| 7.75 | 0 | 0.033 | 0 | 0.067 | 0 | 0.067 | 0.033 | 0.2 | 0.033 | 0.2 |

TABLE 2-1-continued

| | | | | | | | | | | |
|---|---|---|---|---|---|---|---|---|---|---|
| 8.25 | 0 | 0 | 0 | 0.033 | 0 | 0 | 0 | 0 | 0 | 0.067 |
| 8.75 | 0.033 | 0 | 0.033 | 0 | 0 | 0.033 | 0.033 | 0.033 | 0 | 0 |
| 9.25 | 0 | 0 | 0 | 0 | 0 | 0 | 0 | 0 | 0 | 0 |
| 9.75 | 0 | 0 | 0 | 0 | 0 | 0 | 0 | 0 | 0.033 | 0 |

| Particle size | Charged amount [fC] | | | | | | | | | |
|---|---|---|---|---|---|---|---|---|---|---|
| [μm] | −2.25 | −1.75 | −1.25 | −0.75 | −0.25 | 0.25 | 0.75 | 1.25 | 1.75 | 2.25 |
| 0.25 | 0 | 0 | 0 | 0 | 0 | 0 | 0 | 0 | 0 | 0 |
| 0.75 | 0 | 0 | 0 | 0 | 0 | 0 | 0 | 0 | 0 | 0 |
| 1.25 | 0 | 0 | 0 | 0 | 0 | 0.033 | 0 | 0 | 0 | 0 |
| 1.75 | 0 | 0 | 0 | 0 | 0.033 | 0 | 0 | 0 | 0 | 0 |
| 2.25 | 0 | 0 | 0 | 0 | 0 | 0.033 | 0 | 0 | 0 | 0 |
| 2.75 | 0 | 0 | 0 | 0 | 0 | 0 | 0 | 0 | 0 | 0 |
| 3.25 | 0 | 0 | 0 | 0 | 0.033 | 0 | 0 | 0 | 0 | 0 |
| 3.75 | 0 | 0 | 0.033 | 0.033 | 0.167 | 0 | 0 | 0 | 0 | 0 |
| 4.25 | 0 | 0.033 | 0.1 | 0.167 | 0.2 | 0.067 | 0 | 0 | 0 | 0 |
| 4.75 | 0.133 | 0.433 | 2.1 | 3.8 | 2.167 | 0.233 | 0 | 0 | 0 | 0 |
| 5.25 | 0.233 | 1.933 | 5.3 | 4.767 | 2.367 | 0.2 | 0 | 0 | 0 | 0 |
| 5.75 | 1.9 | 4.567 | 6.6 | 5.1 | 0.667 | 0.1 | 0 | 0 | 0 | 0 |
| 6.25 | 4.067 | 6.8 | 7.167 | 4.733 | 1.133 | 0.167 | 0 | 0 | 0 | 0 |
| 6.75 | 3.833 | 5.267 | 3.3 | 2.3 | 0.567 | 0.1 | 0 | 0 | 0 | 0 |
| 7.25 | 0.767 | 0.9 | 0.533 | 0.4 | 0.133 | 0 | 0 | 0 | 0 | 0 |
| 7.75 | 0.2 | 0.3 | 0.067 | 0.067 | 0.033 | 0 | 0 | 0 | 0 | 0 |
| 8.25 | 0 | 0 | 0 | 0 | 0 | 0 | 0 | 0 | 0 | 0 |
| 8.75 | 0.033 | 0.033 | 0 | 0 | 0 | 0 | 0 | 0 | 0 | 0 |
| 9.25 | 0 | 0 | 0 | 0 | 0 | 0 | 0 | 0 | 0 | 0 |
| 9.75 | 0 | 0 | 0 | 0 | 0 | 0 | 0 | 0 | 0 | 0 |

Comparative Example 2-1

To the same toner mother particles as used in Example 2-1 were then added 0.2 wt % of a large particle size silica (Type RX50; produced by NIPPON AEROSIL CO., LTD.), 0.5 wt % of a small particle size silica (Type RX300; produced by NIPPON AEROSIL CO., LTD.) and 1.5 wt % of titanium (STT-30S, produced by TITAN KOGYO KABUSHIKI KAISHA) as external additives. The mixture was then processed at a rotary speed of 2,000 rpm for 2 minutes using a small-sized stirrer.

The toner thus obtained was then negatively charged in a non-contact process development device similar to that of FIG. 2. The regulating pressure of the regulating blade was 35 gf/cm and the amount of the toner to be conveyed was 0.344 mg/cm$^2$. The conveying speed was adjusted to 310 mm/sec.

Figure 11:
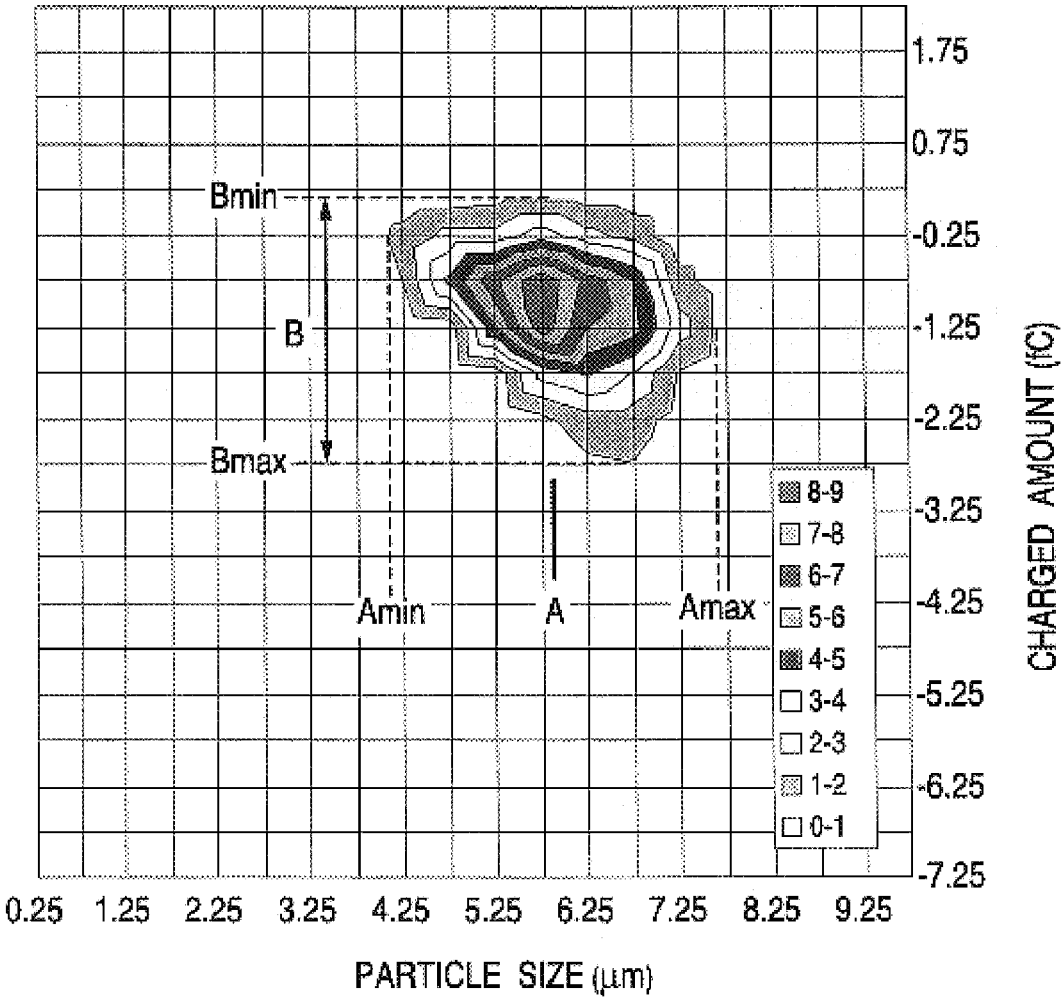
FIG. 11 is a drawing illustrating the particle size-charged amount distribution of Comparative Example 2-1.

About 3,000 particles of the toner thus charged were then measured for particle size and charged amount. The measurements are shown in FIG. 11 and are set forth in detail in Table 2-2. As can be seen in FIG. 11, the center value in the toner particle size distribution [sign A (μm) in FIG. 11], the maximum charged amount [sign Bmax (fC) in FIG. 11], the minimum charged amount [sign Bmin (fC) in FIG. 11] and the width of the charged amount distribution [sign B (fC) in FIG. 11] were 5.93, −2.69, 0.15 and 2.84, respectively, which don't satisfy the formula 3, as set forth in Table 2-9. As can be seen in the results of evaluation of Table 2-10, there occurred defective dot formation. As previously mentioned, only data of division defined by particle size every 0.5 μm and charged amount every 0.5 fC having toner particles in an amount of 1% or more of the total number of toner particles were reviewed.

TABLE 2-2

| Particle size | Charged amount [fC] | | | | | | | | | |
|---|---|---|---|---|---|---|---|---|---|---|
| [μm] | −7.25 | −6.75 | −6.25 | −5.75 | −5.25 | −4.75 | −4.25 | −3.75 | −3.25 | −2.75 |
| 0.25 | 0 | 0 | 0 | 0 | 0 | 0 | 0 | 0 | 0 | 0 |
| 0.75 | 0 | 0 | 0 | 0 | 0 | 0 | 0 | 0 | 0 | 0 |
| 1.25 | 0 | 0 | 0 | 0 | 0 | 0 | 0 | 0 | 0 | 0 |
| 1.75 | 0 | 0 | 0 | 0 | 0 | 0 | 0 | 0 | 0 | 0 |
| 2.25 | 0 | 0 | 0 | 0 | 0 | 0 | 0 | 0 | 0 | 0 |
| 2.75 | 0 | 0 | 0 | 0 | 0 | 0 | 0 | 0 | 0 | 0 |
| 3.25 | 0 | 0 | 0 | 0 | 0 | 0 | 0 | 0 | 0 | 0 |
| 3.75 | 0 | 0 | 0 | 0 | 0 | 0 | 0 | 0 | 0 | 0 |
| 4.25 | 0 | 0 | 0 | 0 | 0 | 0 | 0 | 0 | 0 | 0 |
| 4.75 | 0 | 0 | 0 | 0 | 0 | 0 | 0 | 0 | 0 | 0.033 |
| 5.25 | 0 | 0 | 0 | 0 | 0 | 0 | 0 | 0 | 0.033 | 0 |
| 5.75 | 0 | 0 | 0 | 0 | 0 | 0 | 0 | 0 | 0.1 | 0.1 |
| 6.25 | 0 | 0 | 0 | 0 | 0 | 0.033 | 0.033 | 0.033 | 0.233 | 0.8 |
| 6.75 | 0 | 0 | 0 | 0 | 0 | 0.1 | 0.133 | 0.1 | 0.5 | 0.933 |
| 7.25 | 0 | 0 | 0.033 | 0 | 0.133 | 0 | 0.167 | 0.167 | 0.233 | 0.167 |
| 7.75 | 0 | 0 | 0 | 0 | 0 | 0 | 0 | 0 | 0 | 0.067 |
| 8.25 | 0 | 0 | 0 | 0 | 0 | 0 | 0 | 0 | 0 | 0 |

TABLE 2-2-continued

| | | | | | | | | | | |
|---|---|---|---|---|---|---|---|---|---|---|
| 8.75 | 0 | 0 | 0 | 0 | 0 | 0 | 0 | 0 | 0 | 0.067 |
| 9.25 | 0 | 0 | 0 | 0 | 0 | 0 | 0 | 0 | 0 | 0 |
| 9.75 | 0 | 0 | 0 | 0 | 0 | 0 | 0 | 0 | 0 | 0 |

| Particle size | Charged amount [fC] | | | | | | | | | |
|---|---|---|---|---|---|---|---|---|---|---|
| [μm] | −2.25 | −1.75 | −1.25 | −0.75 | −0.25 | 0.25 | 0.75 | 1.25 | 1.75 | 2.25 |
| 0.25 | 0 | 0 | 0 | 0 | 0 | 0 | 0 | 0 | 0 | 0 |
| 0.75 | 0 | 0 | 0 | 0 | 0 | 0 | 0 | 0 | 0 | 0 |
| 1.25 | 0 | 0 | 0 | 0 | 0 | 0 | 0 | 0 | 0 | 0 |
| 1.75 | 0 | 0 | 0 | 0 | 0 | 0 | 0 | 0 | 0 | 0 |
| 2.25 | 0 | 0 | 0 | 0 | 0 | 0 | 0 | 0 | 0 | 0 |
| 2.75 | 0 | 0 | 0 | 0 | 0 | 0 | 0 | 0 | 0 | 0 |
| 3.25 | 0 | 0 | 0 | 0 | 0 | 0 | 0 | 0 | 0 | 0 |
| 3.75 | 0 | 0 | 0 | 0 | 0.267 | 0 | 0 | 0 | 0 | 0 |
| 4.25 | 0 | 0 | 0.033 | 1 | 1.333 | 0.1 | 0 | 0 | 0 | 0 |
| 4.75 | 0 | 0 | 0.4 | 4.267 | 2.4 | 0.1 | 0 | 0.033 | 0 | 0 |
| 5.25 | 0.033 | 0.4 | 4.967 | 6.767 | 2.433 | 0.233 | 0.033 | 0 | 0 | 0 |
| 5.75 | 0.767 | 3.367 | 8.7 | 8.933 | 3.533 | 0.4 | 0 | 0 | 0 | 0 |
| 6.25 | 1.567 | 4.167 | 6 | 6.633 | 2.433 | 0.233 | 0 | 0 | 0 | 0 |
| 6.75 | 1.467 | 2.967 | 5.5 | 5.067 | 1.667 | 0.2 | 0 | 0 | 0.033 | 0 |
| 7.25 | 0.533 | 0.9 | 2.5 | 1.333 | 0.2 | 0.133 | 0 | 0 | 0 | 0 |
| 7.75 | 0 | 0.167 | 0.4 | 0.4 | 0.2 | 0 | 0 | 0 | 0 | 0 |
| 8.25 | 0.067 | 0.133 | 0.167 | 0.033 | 0.033 | 0.033 | 0 | 0 | 0 | 0 |
| 8.75 | 0.033 | 0.067 | 0 | 0 | 0 | 0 | 0 | 0 | 0 | 0 |
| 9.25 | 0 | 0.033 | 0 | 0 | 0 | 0 | 0 | 0 | 0 | 0 |
| 9.75 | 0 | 0 | 0 | 0 | 0 | 0 | 0 | 0 | 0 | 0 |

Comparative Example 2-2

To the same toner mother particles as used in Example 2-1 were then added 0.2 wt % of a large particle size silica (Type RX50; produced by NIPPON AEROSIL CO., LTD.), 0.3 wt % of a small particle size silica (Type RX300; produced by NIPPON AEROSIL CO., LTD.) and 0.5 wt % of titanium (STT-30S, produced by TITAN KOGYO KABUSHIKI KAISHA) as external additives. The mixture was then processed at a rotary speed of 2,000 rpm for 2 minutes using a small-sized stirrer.

The toner thus obtained was then negatively charged in a non-contact process development device similar to that of FIG. 2. The regulating pressure of the regulating blade was 37 gf/cm and the amount of the toner to be conveyed was 0.358 mg/cm$^2$. The conveying speed was adjusted to 310 mm/sec.

Figure 12:
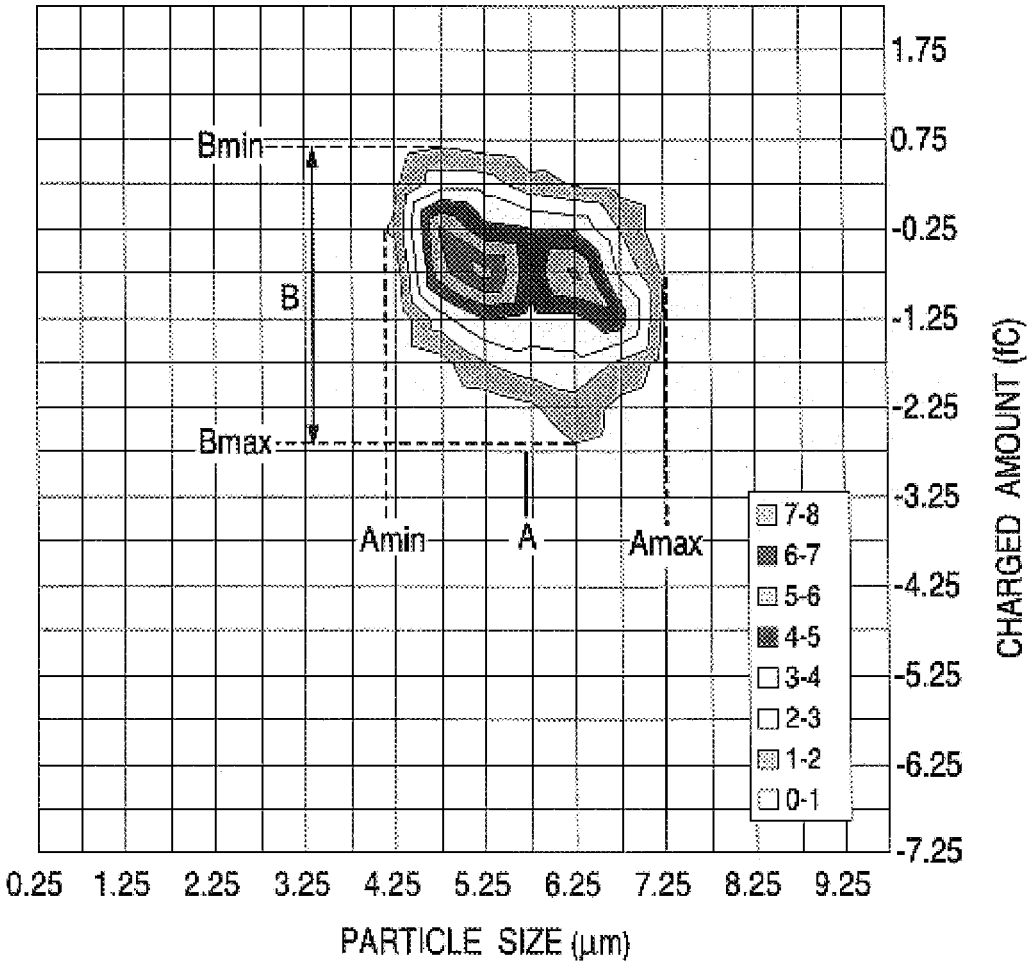
FIG. 12 is a drawing illustrating the particle size-charged amount distribution of Comparative Example 2-2.

About 3,000 particles of the toner thus charged were then measured for particle size and charged amount. The measurements are shown in FIG. 12 and are set forth in detail in Table 2-3. As can be seen in FIG. 12, the center value in the toner particle size distribution [sign A (μm) in FIG. 12], the maximum charged amount [sign Bmax (fC) in FIG. 12], the minimum charged amount [sign Bmin (fC) in FIG. 12] and the width of the charged amount distribution [sign B (fC) in FIG. 12] were 5.69, −2.64, 0.66 and 3.30, respectively, which don't satisfy the formula 5, as set forth in Table 2-9. As can be seen in the results of evaluation of Table 2-10, there occurred poor fogging resistance. As previously mentioned, only data of division defined by particle size every 0.5 μm and charged amount every 0.5 fC having toner particles in an amount of 1% or more of the total number of toner particles were reviewed.

TABLE 2-3

| Particle size | Charged amount [fC] | | | | | | | | | |
|---|---|---|---|---|---|---|---|---|---|---|
| [μm] | −7.25 | −6.75 | −6.25 | −5.75 | −5.25 | −4.75 | −4.25 | −3.75 | −3.25 | −2.75 |
| 0.25 | 0 | 0 | 0 | 0 | 0 | 0 | 0 | 0 | 0 | 0 |
| 0.75 | 0 | 0 | 0 | 0 | 0 | 0 | 0 | 0 | 0 | 0 |
| 1.25 | 0 | 0 | 0 | 0 | 0 | 0 | 0 | 0 | 0 | 0 |
| 1.75 | 0 | 0 | 0 | 0 | 0 | 0 | 0 | 0 | 0 | 0 |
| 2.25 | 0 | 0 | 0 | 0 | 0 | 0 | 0 | 0 | 0 | 0 |
| 2.75 | 0 | 0 | 0 | 0 | 0 | 0 | 0 | 0 | 0 | 0 |
| 3.25 | 0 | 0 | 0 | 0 | 0 | 0 | 0 | 0 | 0 | 0 |
| 3.75 | 0 | 0 | 0 | 0 | 0 | 0 | 0 | 0 | 0 | 0 |
| 4.25 | 0 | 0 | 0 | 0 | 0 | 0 | 0 | 0 | 0 | 0 |
| 4.75 | 0 | 0 | 0 | 0 | 0 | 0 | 0 | 0 | 0 | 0 |
| 5.25 | 0 | 0 | 0 | 0 | 0 | 0 | 0.033 | 0.033 | 0 | 0 |
| 5.75 | 0 | 0 | 0 | 0 | 0 | 0 | 0 | 0 | 0.033 | 0.133 |
| 6.25 | 0 | 0 | 0 | 0 | 0 | 0.033 | 0.1 | 0.133 | 0.533 | 0.833 |
| 6.75 | 0 | 0 | 0 | 0 | 0 | 0.1 | 0.133 | 0.233 | 0.367 | 0.6 |
| 7.25 | 0.033 | 0 | 0 | 0.067 | 0.1 | 0.1 | 0.033 | 0.067 | 0.067 | 0.067 |
| 7.75 | 0.033 | 0 | 0 | 0.033 | 0 | 0 | 0 | 0 | 0 | 0.067 |
| 8.25 | 0 | 0 | 0 | 0 | 0 | 0 | 0 | 0 | 0 | 0.033 |
| 8.75 | 0 | 0 | 0 | 0 | 0 | 0 | 0 | 0.033 | 0.1 | 0 |

TABLE 2-3-continued

| | | | | | | | | | | |
|---|---|---|---|---|---|---|---|---|---|---|
| 9.25 | 0 | 0 | 0 | 0 | 0 | 0 | 0 | 0 | 0 | 0 |
| 9.75 | 0 | 0 | 0 | 0 | 0 | 0 | 0 | 0 | 0 | 0 |

| Particle size | Charged amount [fC] | | | | | | | | | |
|---|---|---|---|---|---|---|---|---|---|---|
| [μm] | −2.25 | −1.75 | −1.25 | −0.75 | −0.25 | 0.25 | 0.75 | 1.25 | 1.75 | 2.25 |
| 0.25 | 0 | 0 | 0 | 0 | 0 | 0 | 0 | 0 | 0 | 0 |
| 0.75 | 0 | 0 | 0 | 0 | 0 | 0 | 0 | 0 | 0 | 0 |
| 1.25 | 0 | 0 | 0 | 0 | 0 | 0 | 0 | 0 | 0 | 0 |
| 1.75 | 0 | 0 | 0 | 0 | 0 | 0 | 0.033 | 0 | 0 | 0 |
| 2.25 | 0 | 0 | 0 | 0 | 0 | 0 | 0 | 0 | 0 | 0 |
| 2.75 | 0 | 0 | 0 | 0 | 0 | 0 | 0 | 0 | 0 | 0 |
| 3.25 | 0 | 0 | 0 | 0 | 0.1 | 0.267 | 0 | 0 | 0 | 0 |
| 3.75 | 0 | 0 | 0 | 0.067 | 0.4 | 0.1 | 0.033 | 0 | 0 | 0 |
| 4.25 | 0 | 0.033 | 0.067 | 0.5 | 1.133 | 0.733 | 0.3 | 0.033 | 0 | 0 |
| 4.75 | 0.067 | 0.633 | 2.6 | 5.633 | 6.133 | 2.767 | 0.6 | 0 | 0 | 0 |
| 5.25 | 0.367 | 2 | 4.033 | 7.433 | 4.267 | 2.6 | 0.233 | 0 | 0 | 0 |
| 5.75 | 0.833 | 2.633 | 3.633 | 4.367 | 4.033 | 1.4 | 0.033 | 0.033 | 0 | 0 |
| 6.25 | 1.6 | 2.733 | 3.733 | 6.267 | 3.933 | 0.9 | 0.133 | 0 | 0 | 0 |
| 6.75 | 0.7 | 1.833 | 4.633 | 2.8 | 2 | 0.633 | 0.067 | 0.033 | 0 | 0 |
| 7.25 | 0.167 | 0.6 | 0.767 | 0.9 | 0.2 | 0.167 | 0 | 0 | 0 | 0 |
| 7.75 | 0.033 | 0.167 | 0.233 | 0.167 | 0.033 | 0 | 0 | 0 | 0 | 0 |
| 8.25 | 0.033 | 0 | 0 | 0 | 0 | 0 | 0 | 0 | 0 | 0 |
| 8.75 | 0.033 | 0.067 | 0.033 | 0 | 0.067 | 0 | 0 | 0 | 0 | 0 |
| 9.25 | 0 | 0 | 0 | 0 | 0 | 0 | 0 | 0 | 0 | 0 |
| 9.75 | 0 | 0.033 | 0 | 0 | 0 | 0 | 0 | 0 | 0 | 0 |

Comparative Example 2-3

To the same toner mother particles as used in Example 2-1 were then added 0.5 wt % of a large particle size silica (Type RX50; produced by NIPPON AEROSIL CO., LTD.), 0.5 wt % of a small particle size silica (Type RX300; produced by NIPPON AEROSIL CO., LTD.) and 0.5 wt % of titanium (STT-30S, produced by TITAN KOGYO KABUSHIKI KAISHA) as external additives. The mixture was then processed at a rotary speed of 2,000 rpm for 2 minutes using a small-sized stirrer.

The toner thus obtained was then negatively charged in a non-contact process development device similar to that of FIG. 2. The regulating pressure of the regulating blade was 35 gf/cm and the amount of the toner to be conveyed was 0.352 mg/cm$^2$. The conveying speed was adjusted to 310 mm/sec.

Figure 13:
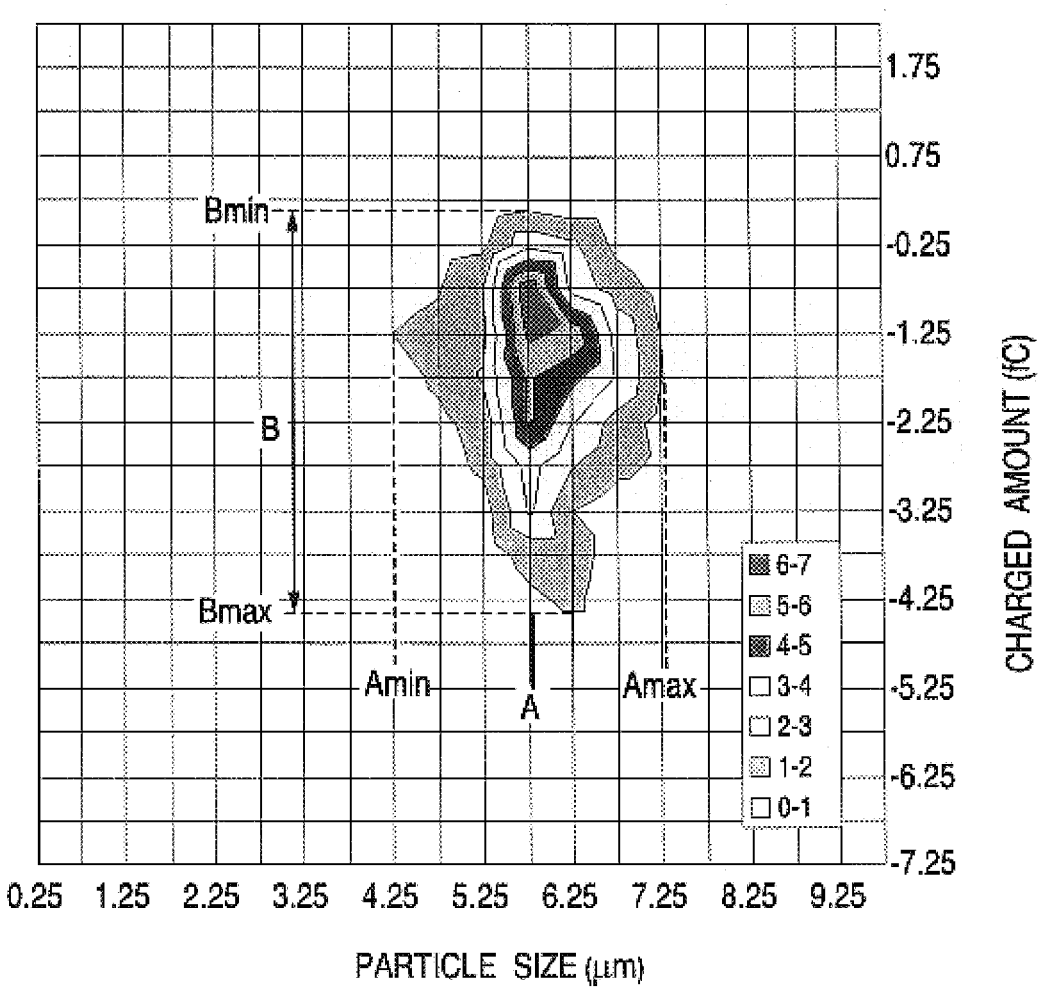
FIG. 13 is a drawing illustrating the particle size-charged amount distribution of Comparative Example 2-3.

About 3,000 particles of the toner thus charged were then measured for particle size and charged amount. The measurements are shown in FIG. 13 and are set forth in detail in Table 2-4. As can be seen in FIG. 13, the center value in the toner particle size distribution [sign A (μm) in FIG. 13], the maximum charged amount [sign Bmax (fC) in FIG. 13], the minimum charged amount [sign Bmin (fC) in FIG. 13] and the width of the charged amount distribution [sign B (fC) in FIG. 13] were 5.77, −4.38, 0.13 and 4.51, respectively, which don't satisfy the formula 4, as set forth in Table 2-9. As can be seen in the results of evaluation of Table 2-10, there occurred poor background stain resistance. As previously mentioned, only data of division defined by particle size every 0.5 μm and charged amount every 0.5 fC having toner particles in an amount of 1% or more of the total number of toner particles were reviewed.

TABLE 2-4

| | Charged amount [fC] | | | | | | | | | |
|---|---|---|---|---|---|---|---|---|---|---|
| Particle size [μm] | −7.25 | −6.75 | −6.25 | −5.75 | −5.25 | −4.75 | −4.25 | −3.75 | −3.25 | −2.75 |
| 0.25 | 0 | 0 | 0 | 0 | 0 | 0 | 0 | 0 | 0 | 0 |
| 0.75 | 0 | 0 | 0 | 0 | 0 | 0 | 0 | 0 | 0 | 0 |
| 1.25 | 0 | 0 | 0 | 0 | 0 | 0 | 0 | 0 | 0 | 0 |
| 1.75 | 0 | 0 | 0 | 0 | 0 | 0 | 0 | 0 | 0 | 0 |
| 2.25 | 0 | 0 | 0 | 0 | 0 | 0 | 0 | 0 | 0 | 0 |
| 2.75 | 0 | 0 | 0 | 0 | 0 | 0 | 0 | 0 | 0 | 0 |
| 3.25 | 0 | 0 | 0 | 0 | 0 | 0 | 0 | 0 | 0 | 0 |
| 3.75 | 0 | 0 | 0 | 0 | 0 | 0 | 0 | 0.033 | 0 | 0 |
| 4.25 | 0 | 0 | 0 | 0 | 0 | 0 | 0 | 0 | 0 | 0 |
| 4.75 | 0 | 0 | 0 | 0 | 0 | 0 | 0 | 0 | 0.033 | 0.5 |
| 5.25 | 0 | 0 | 0 | 0 | 0 | 0 | 0.133 | 0.367 | 0.5 | 1.233 |
| 5.75 | 0 | 0 | 0 | 0.067 | 0.167 | 0.267 | 0.767 | 1.4 | 3.133 | 3.333 |
| 6.25 | 0.067 | 0 | 0.1 | 0.267 | 0.267 | 0.367 | 1.233 | 1.4 | 1 | 2.033 |
| 6.75 | 0.067 | 0.067 | 0.033 | 0.067 | 0.1 | 0.233 | 0.333 | 0.533 | 0.5 | 1.233 |
| 7.25 | 0.067 | 0.033 | 0.067 | 0.067 | 0.1 | 0.033 | 0.133 | 0.3 | 0.367 | 0.8 |
| 7.75 | 0 | 0 | 0 | 0.1 | 0 | 0 | 0.033 | 0.067 | 0.167 | 0.133 |
| 8.25 | 0 | 0 | 0 | 0 | 0.033 | 0.033 | 0 | 0 | 0 | 0 |
| 8.75 | 0 | 0 | 0 | 0 | 0 | 0 | 0 | 0 | 0 | 0 |
| 9.25 | 0 | 0 | 0 | 0 | 0 | 0 | 0 | 0 | 0 | 0 |

TABLE 2-4-continued

| | | | | | | | | | | |
|---|---|---|---|---|---|---|---|---|---|---|
| 9.75 | 0 | 0 | 0 | 0 | 0 | 0 | 0 | 0 | 0 | 0 |

| | Charged amount [fC] | | | | | | | | | |
|---|---|---|---|---|---|---|---|---|---|---|
| Particle size [μm] | −2.25 | −1.75 | −1.25 | −0.75 | −0.25 | 0.25 | 0.75 | 1.25 | 1.75 | 2.25 |
| 0.25 | 0 | 0 | 0 | 0 | 0 | 0 | 0 | 0 | 0 | 0 |
| 0.75 | 0 | 0 | 0 | 0 | 0 | 0 | 0 | 0 | 0 | 0 |
| 1.25 | 0 | 0 | 0 | 0 | 0 | 0 | 0 | 0 | 0 | 0 |
| 1.75 | 0 | 0 | 0 | 0 | 0 | 0 | 0 | 0 | 0 | 0 |
| 2.25 | 0 | 0 | 0 | 0 | 0 | 0 | 0 | 0 | 0 | 0 |
| 2.75 | 0 | 0 | 0 | 0.1 | 0 | 0 | 0 | 0 | 0 | 0 |
| 3.25 | 0.033 | 0.033 | 0.167 | 0.033 | 0.033 | 0.033 | 0 | 0 | 0 | 0 |
| 3.75 | 0 | 0.033 | 0.1 | 0.1 | 0.1 | 0 | 0 | 0 | 0 | 0 |
| 4.25 | 0.233 | 0.467 | 1 | 0.6 | 0.267 | 0.133 | 0 | 0 | 0 | 0 |
| 4.75 | 0.733 | 1.233 | 1.367 | 0.9 | 0.533 | 0.1 | 0.033 | 0 | 0 | 0 |
| 5.25 | 1.433 | 2.1 | 1.733 | 2 | 0.733 | 0.067 | 0 | 0 | 0 | 0 |
| 5.75 | 5.133 | 5.133 | 6.2 | 6.9 | 2.733 | 0.467 | 0.1 | 0 | 0 | 0 |
| 6.25 | 3.033 | 4.267 | 5.733 | 2.767 | 2.233 | 0.2 | 0 | 0 | 0 | 0 |
| 6.75 | 1.567 | 2.967 | 2.733 | 1.533 | 0.733 | 0.133 | 0 | 0 | 0 | 0 |
| 7.25 | 0.667 | 1.067 | 1 | 0.667 | 0.2 | 0.067 | 0 | 0.033 | 0 | 0 |
| 7.75 | 0.233 | 0.167 | 0.1 | 0.033 | 0.033 | 0.033 | 0 | 0 | 0 | 0 |
| 8.25 | 0 | 0 | 0 | 0 | 0 | 0 | 0 | 0 | 0 | 0 |
| 8.75 | 0 | 0 | 0 | 0 | 0 | 0 | 0 | 0 | 0 | 0 |
| 9.25 | 0 | 0 | 0 | 0 | 0 | 0 | 0 | 0 | 0 | 0 |
| 9.75 | 0 | 0 | 0 | 0 | 0 | 0 | 0 | 0 | 0 | 0 |

Example 2-2

A monomer mixture comprising 80 parts by weight of a styrene monomer, 20 parts by weight of butyl acrylate and 5 parts by weight of acrylic acid was added to a water-soluble mixture comprising 105 parts by weight of water, 1 part by weight of a nonionic emulsifier, 1.5 parts by weight of an anionic emulsifier and 0.55 parts by weight of potassium persulfate to obtain a lacteous resin emulsion having a particle size of 0.25 μm.

Subsequently, 200 parts by weight of the resin emulsion thus obtained, 20 parts by weight of a polyethylene wax emulsion (produced by Sanyo Chemical Industries, Ltd.) and 10 parts by weight of a phthalocyanine blue were dispersed in water containing 0.2 parts by weight of sodium dodecylbenzenesulfonate as a surface active agent. To the mixture was then added diethylamine to adjust the pH value thereof to 5.5. To the mixture was then added 0.3 parts by weight of aluminum sulfate as an electrolyte with stirring. Subsequently, the mixture was subjected to high speed stirring using a TK homomixer to undergo dispersion. To the mixture were then added 40 parts by weight of a styrene monomer, 10 parts by weight of butyl acrylate and 5 parts by weight of zinc salicylate together with 40 parts by weight of water. The mixture was then heated to 90° C. with stirring in a nitrogen stream. To the mixture was then added aqueous hydrogen peroxide. The mixture was then allowed to undergo polymerization for 3 hours to cause the growth of particles. After the termination of polymerization, with the pH value being adjusted to not lower than 5, the mixture was then heated to 95° C. where it was then allowed to stand for 5 hours to enhance the bonding strength of associated particles. Thereafter, the particulate material thus obtained was washed with water, and then vacuum-dried at 45° C. for 10 hours. Thus, toner mother particles having an average particle size of 5 μm were obtained.

To the toner mother particles having an particle size of 5 μm were then added 0.4 wt % of a large particle size silica (Type RX50; produced by NIPPON AEROSIL CO., LTD.), 0.6 wt % of a small particle size silica (Type RX300; produced by NIPPON AEROSIL CO., LTD.) and 1.0 wt % of titanium (STT-30S, produced by TITAN KOGYO KABUSHIKI KAISHA) as external additives. The mixture was then processed at a rotary speed of 2,000 rpm for 2 minutes using a small-sized stirrer.

The toner thus obtained was then negatively charged in a non-contact process development device similar to that of FIG. 2. The regulating pressure of the regulating blade was 35 gf/cm and the amount of the toner to be conveyed was 0.254 mg/cm$^2$. The conveying speed was adjusted to 310 mm/sec.

Figure 14:
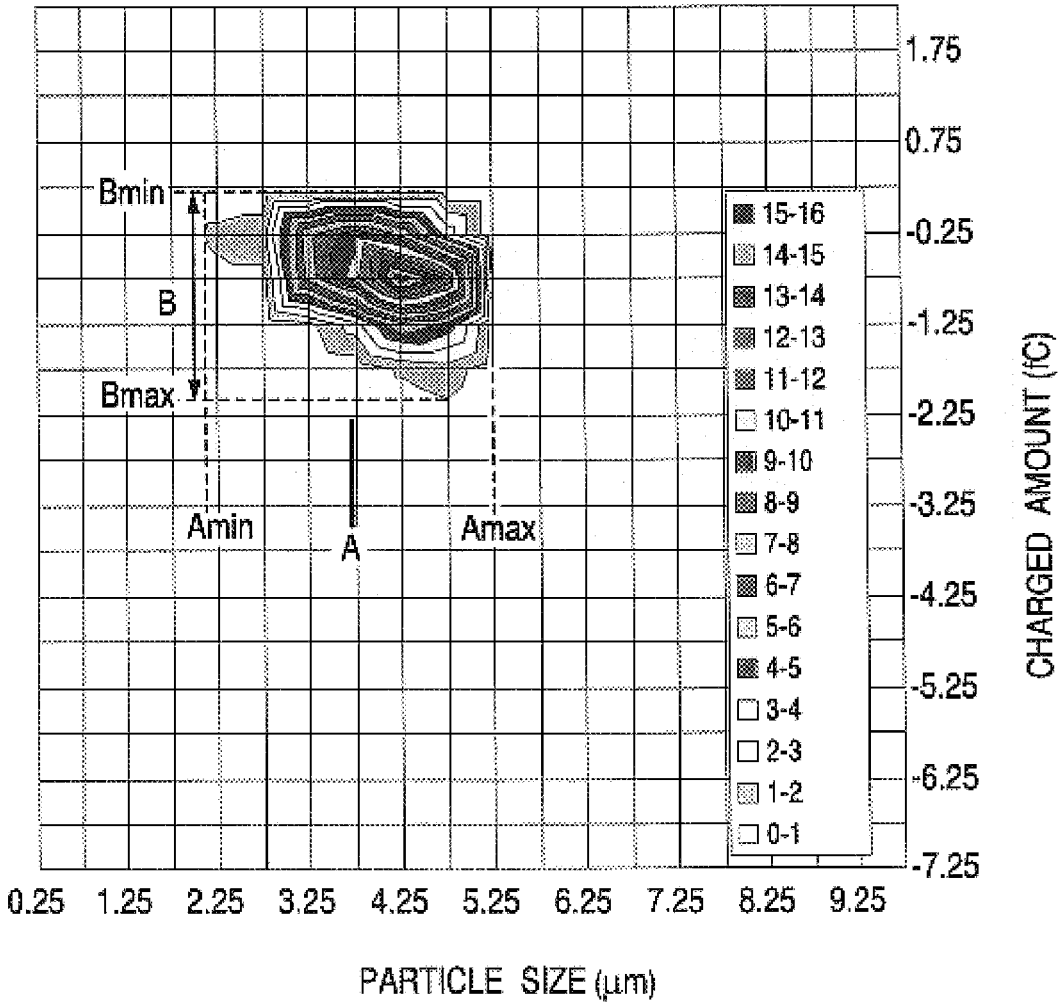
FIG. 14 is a drawing illustrating the particle size-charged amount distribution of Example 2-2.

About 3,000 particles of the toner thus charged were then measured for particle size and charged amount. The measurements are shown in FIG. 14 and set forth in detail in Table 2-5. As can be seen in FIG. 14, the center value in the toner particle size distribution [sign A (μm) in FIG. 14], the maximum charged amount [sign Bmax (fC) in FIG. 14], the minimum charged amount [sign Bmin (fC) in FIG. 14] and the width of the charged amount distribution [sign B (fC) in FIG. 14] were 3.68, −2.01, 0.20 and 2.21, respectively, which satisfy the formulas 3 to 5, as set forth in Table 2-9. As can be seen in the results of evaluation of Table 2-10, there occurred no problems of dot formation, fogging and background stain. As previously mentioned, only data of division defined by particle size every 0.5 μm and charged amount every 0.5 fC having toner particles in an amount of 1% or more of the total number of toner particles were reviewed.

TABLE 2-5

| | Charged amount [fC] | | | | | | | | | | |
|---|---|---|---|---|---|---|---|---|---|---|---|
| Particle size [μm] | −7.25 | −6.75 | −6.25 | −5.75 | −5.25 | −4.75 | −4.25 | −3.75 | −3.25 | −2.75 | −2.25 |
| 0.25 | 0 | 0 | 0 | 0 | 0 | 0 | 0 | 0 | 0 | 0 | 0 |
| 0.75 | 0 | 0 | 0 | 0 | 0 | 0 | 0 | 0 | 0 | 0 | 0 |
| 1.25 | 0 | 0 | 0 | 0 | 0 | 0 | 0 | 0 | 0 | 0 | 0 |
| 1.75 | 0 | 0 | 0 | 0 | 0 | 0 | 0 | 0 | 0 | 0 | 0 |
| 2.25 | 0 | 0 | 0 | 0 | 0 | 0 | 0 | 0 | 0 | 0 | 0 |
| 2.75 | 0 | 0 | 0 | 0 | 0 | 0 | 0 | 0 | 0 | 0 | 0 |
| 3.25 | 0 | 0 | 0 | 0 | 0 | 0 | 0 | 0 | 0 | 0 | 0 |
| 3.75 | 0 | 0 | 0 | 0 | 0 | 0 | 0 | 0 | 0 | 0 | 0 |
| 4.25 | 0 | 0 | 0 | 0 | 0 | 0 | 0 | 0 | 0 | 0 | 0.233 |
| 4.75 | 0 | 0 | 0 | 0 | 0 | 0 | 0 | 0 | 0.033 | 0.133 | 0.733 |
| 5.25 | 0 | 0 | 0 | 0 | 0 | 0 | 0 | 0 | 0 | 0 | 0.033 |
| 5.75 | 0 | 0 | 0 | 0 | 0 | 0 | 0 | 0 | 0 | 0 | 0.033 |
| 6.25 | 0 | 0 | 0 | 0 | 0 | 0 | 0 | 0 | 0 | 0 | 0 |
| 6.75 | 0 | 0 | 0 | 0 | 0 | 0 | 0 | 0 | 0 | 0 | 0 |
| 7.25 | 0 | 0 | 0 | 0 | 0 | 0 | 0 | 0 | 0 | 0 | 0 |
| 7.75 | 0 | 0 | 0 | 0 | 0 | 0 | 0 | 0 | 0 | 0 | 0 |
| 8.25 | 0 | 0 | 0 | 0 | 0 | 0 | 0 | 0 | 0 | 0 | 0 |
| 8.75 | 0 | 0 | 0 | 0 | 0 | 0 | 0 | 0 | 0 | 0 | 0 |
| 9.25 | 0 | 0 | 0 | 0 | 0 | 0 | 0 | 0 | 0 | 0 | 0 |
| 9.75 | 0 | 0 | 0 | 0 | 0 | 0 | 0 | 0 | 0 | 0 | 0 |

| | Charged amount [fC] | | | | | | | | |
|---|---|---|---|---|---|---|---|---|---|
| Particle size [μm] | −1.75 | −1.25 | −.075 | −0.25 | 0.25 | 0.75 | 1.25 | 1.75 | 2.25 |
| 0.25 | 0 | 0 | 0 | 0 | 0 | 0 | 0 | 0 | 0 |
| 0.75 | 0 | 0 | 0 | 0 | 0 | 0 | 0 | 0 | 0 |
| 1.25 | 0 | 0 | 0 | 0.033 | 0 | 0 | 0 | 0 | 0 |
| 1.75 | 0 | 0 | 0 | 0.1 | 0 | 0 | 0 | 0 | 0 |
| 2.25 | 0 | 0.033 | 0.633 | 1.3 | 0.033 | 0 | 0 | 0 | 0 |
| 2.75 | 0 | 0 | 0.633 | 1.733 | 0.033 | 0 | 0 | 0 | 0 |
| 3.25 | 0 | 0.667 | 7.433 | 7.733 | 0.033 | 0 | 0 | 0 | 0 |
| 3.75 | 0.2 | 2.567 | 10.47 | 9.767 | 0.033 | 0 | 0 | 0 | 0 |
| 4.25 | 1.167 | 5.767 | 15.73 | 7.767 | 0.1 | 0 | 0 | 0 | 0 |
| 4.75 | 1.5 | 4.667 | 12.87 | 3.6 | 0.1 | 0 | 0 | 0 | 0.033 |
| 5.25 | 0.4 | 0.767 | 0.6 | 0.133 | 0 | 0 | 0 | 0 | 0 |
| 5.75 | 0.067 | 0.067 | 0 | 0 | 0 | 0 | 0 | 0 | 0 |
| 6.25 | 0 | 0 | 0 | 0.033 | 0 | 0 | 0 | 0 | 0 |
| 6.75 | 0 | 0 | 0 | 0 | 0 | 0 | 0 | 0 | 0 |
| 7.25 | 0 | 0 | 0 | 0 | 0 | 0 | 0 | 0 | 0 |
| 7.75 | 0 | 0 | 0 | 0 | 0 | 0 | 0 | 0 | 0 |
| 8.25 | 0 | 0 | 0 | 0 | 0 | 0 | 0 | 0 | 0 |
| 8.75 | 0 | 0 | 0 | 0 | 0 | 0 | 0 | 0 | 0 |
| 9.25 | 0 | 0 | 0 | 0 | 0 | 0 | 0 | 0 | 0 |
| 9.75 | 0 | 0 | 0 | 0 | 0 | 0 | 0 | 0 | 0 |

Comparative Example 2-4

To the same toner mother particles as used in Example 2-1 were then added 0.3 wt % of a large particle size silica (Type RX50; produced by NIPPON AEROSIL CO., LTD.), 0.5 wt % of a small particle size silica (Type RX300; produced by NIPPON AEROSIL CO., LTD.) and 2.0 wt % of titanium (STT-30S, produced by TITAN KOGYO KABUSHIKI KAISHA) as external additives. The mixture was then processed at a rotary speed of 2,000 rpm for 2 minutes using a small-sized stirrer.

The toner thus obtained was then negatively charged in a non-contact process development device similar to that of FIG. 2. The regulating pressure of the regulating blade was 35 gf/cm and the amount of the toner to be conveyed was 0.255 mg/cm$^2$. The conveying speed was adjusted to 310 mm/sec.

Figure 15:
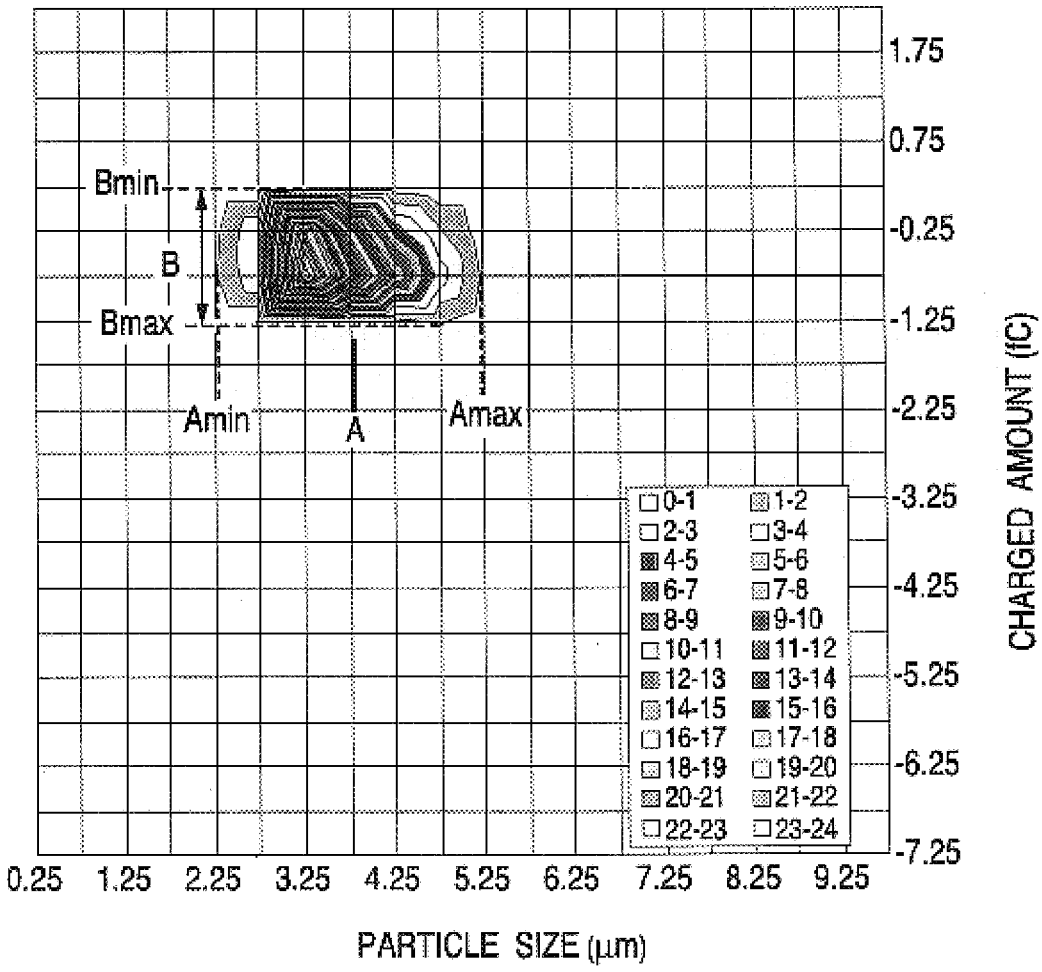
FIG. 15 is a drawing illustrating the particle size-charged amount distribution of Comparative Example 2-4.

About 3,000 particles of the toner thus charged were then measured for particle size and charged amount. The measurements are shown in FIG. 15 and are set forth in detail in Table 2-6. As can be seen in FIG. 15, the center value in the toner particle size distribution [sign A (μm) in FIG. 15], the maximum charged amount [sign Bmax (fC) in FIG. 15], the minimum charged amount [sign Bmin (fC) in FIG. 15] and the width of the charged amount distribution [sign B (fC) in FIG. 15] were 3.74, −1.30, 0.23 and 1.53, respectively, which don't satisfy the formula 3, as set forth in Table 2-9. As can be seen in the results of evaluation of Table 2-10, there occurred defective dot formation. As previously mentioned, only data of division defined by particle size every 0.5 μm and charged amount every 0.5 fC having toner particles in an amount of 1% or more of the total number of toner particles were reviewed.

TABLE 2-6

| | Charged amount [fC] | | | | | | | | | | |
|---|---|---|---|---|---|---|---|---|---|---|---|
| Particle size [μm] | −7.25 | −6.75 | −6.25 | −5.75 | −5.25 | −4.75 | −4.25 | −3.75 | −3.25 | −2.75 | −2.25 |
| 0.25 | 0 | 0 | 0 | 0 | 0 | 0 | 0 | 0 | 0 | 0 | 0 |
| 0.75 | 0 | 0 | 0 | 0 | 0 | 0 | 0 | 0 | 0 | 0 | 0 |
| 1.25 | 0 | 0 | 0 | 0 | 0 | 0 | 0 | 0 | 0 | 0 | 0 |
| 1.75 | 0 | 0 | 0 | 0 | 0 | 0 | 0 | 0 | 0 | 0 | 0 |
| 2.25 | 0 | 0 | 0 | 0 | 0 | 0 | 0 | 0 | 0 | 0 | 0 |
| 2.75 | 0 | 0 | 0 | 0 | 0 | 0 | 0 | 0 | 0 | 0 | 0 |
| 3.25 | 0 | 0 | 0 | 0 | 0 | 0 | 0 | 0 | 0 | 0 | 0.033 |
| 3.75 | 0 | 0 | 0 | 0 | 0 | 0 | 0 | 0 | 0 | 0 | 0 |
| 4.25 | 0 | 0 | 0 | 0 | 0 | 0 | 0 | 0 | 0 | 0 | 0 |
| 4.75 | 0 | 0 | 0 | 0 | 0 | 0 | 0 | 0 | 0 | 0 | 0.033 |
| 5.25 | 0 | 0 | 0 | 0 | 0 | 0 | 0 | 0 | 0 | 0 | 0 |
| 5.75 | 0 | 0 | 0 | 0 | 0 | 0 | 0 | 0 | 0 | 0 | 0 |
| 6.25 | 0 | 0 | 0 | 0 | 0 | 0 | 0 | 0 | 0 | 0 | 0 |
| 6.75 | 0 | 0 | 0 | 0 | 0 | 0 | 0 | 0 | 0 | 0 | 0 |
| 7.25 | 0 | 0 | 0 | 0 | 0 | 0 | 0 | 0 | 0 | 0 | 0 |
| 7.75 | 0 | 0 | 0 | 0 | 0 | 0 | 0 | 0 | 0 | 0 | 0 |
| 8.25 | 0 | 0 | 0 | 0 | 0 | 0 | 0 | 0 | 0 | 0 | 0 |
| 8.75 | 0 | 0 | 0 | 0 | 0 | 0 | 0 | 0 | 0 | 0 | 0 |
| 9.25 | 0 | 0 | 0 | 0 | 0 | 0 | 0 | 0 | 0 | 0 | 0 |
| 9.75 | 0 | 0 | 0 | 0 | 0 | 0 | 0 | 0 | 0 | 0 | 0 |

| | Charged amount [fC] | | | | | | | | |
|---|---|---|---|---|---|---|---|---|---|
| Particle size [μm] | −1.75 | −1.25 | −0.75 | −0.25 | 0.25 | 0.75 | 1.25 | 1.75 | 2.25 |
| 0.25 | 0 | 0 | 0 | 0 | 0 | 0 | 0 | 0 | 0 |
| 0.75 | 0 | 0 | 0 | 0 | 0 | 0 | 0 | 0 | 0 |
| 1.25 | 0 | 0 | 0.033 | 0.033 | 0 | 0 | 0 | 0 | 0 |
| 1.75 | 0 | 0 | 0 | 0.033 | 0 | 0 | 0 | 0 | 0 |
| 2.25 | 0 | 0 | 0.9 | 0.667 | 0 | 0 | 0 | 0 | 0 |
| 2.75 | 0 | 0 | 3 | 3.1 | 0 | 0 | 0 | 0 | 0 |
| 3.25 | 0.067 | 0.467 | 23.2 | 19.43 | 0.167 | 0.033 | 0 | 0 | 0 |
| 3.75 | 0.033 | 0.8 | 14.4 | 10.4 | 0.2 | 0.067 | 0 | 0 | 0 |
| 4.25 | 0.067 | 0.733 | 7.9 | 4.633 | 0.4 | 0 | 0 | 0 | 0 |
| 4.75 | 0.167 | 1.1 | 3.533 | 2.167 | 0.033 | 0 | 0 | 0 | 0 |
| 5.25 | 0.033 | 0.267 | 0.8 | 0.4 | 0 | 0 | 0 | 0 | 0 |
| 5.75 | 0.067 | 0.067 | 0.133 | 0.1 | 0 | 0 | 0 | 0 | 0 |
| 6.25 | 0 | 0.033 | 0.133 | 0.067 | 0 | 0 | 0 | 0 | 0 |
| 6.75 | 0 | 0.033 | 0.033 | 0 | 0 | 0 | 0 | 0 | 0 |
| 7.25 | 0 | 0 | 0 | 0 | 0 | 0 | 0 | 0 | 0 |
| 7.75 | 0 | 0 | 0 | 0 | 0 | 0 | 0 | 0 | 0 |
| 8.25 | 0 | 0 | 0 | 0 | 0 | 0 | 0 | 0 | 0 |
| 8.75 | 0 | 0 | 0 | 0 | 0 | 0 | 0 | 0 | 0 |
| 9.25 | 0 | 0 | 0 | 0 | 0 | 0 | 0 | 0 | 0 |
| 9.75 | 0 | 0 | 0 | 0 | 0 | 0 | 0 | 0 | 0 |

Comparative Example 2-5

To the same toner mother particles as used in Example 2-1 were then added 0.3 wt % of a large particle size silica (Type RX50; produced by NIPPON AEROSIL CO., LTD.), 0.3 wt % of a small particle size silica (Type RX300; produced by NIPPON AEROSIL CO., LTD.) and 1.5 wt % of titanium (STT-30S, produced by TITAN KOGYO KABUSHIKI KAISHA) as external additives. The mixture was then processed at a rotary speed of 2,000 rpm for 2 minutes using a small-sized stirrer.

The toner thus obtained was then negatively charged in a non-contact process development device similar to that of FIG. 2. The regulating pressure of the regulating blade was 36 gf/cm and the amount of the toner to be conveyed was 0.258 mg/cm$^2$. The conveying speed was adjusted to 310 mm/sec.

Figure 16:
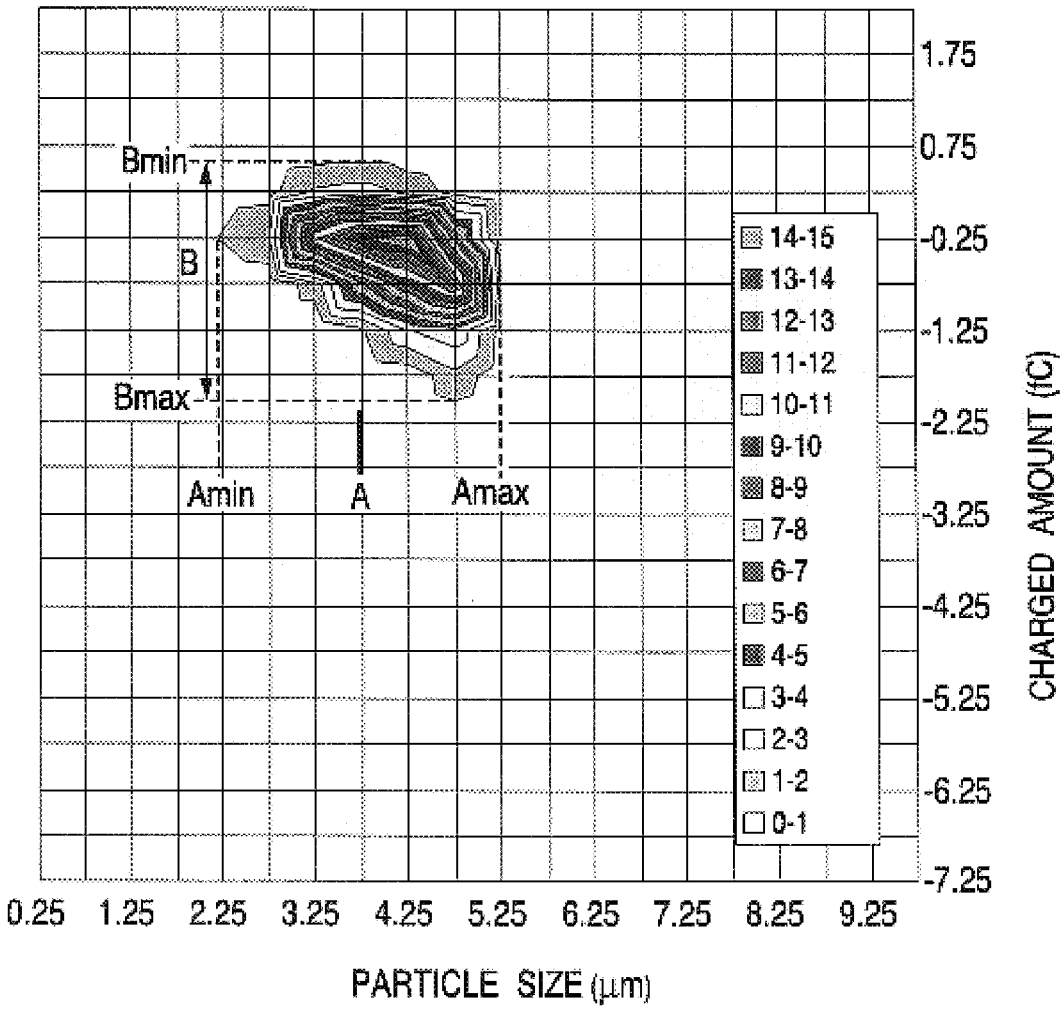
FIG. 16 is a drawing illustrating the particle size-charged amount distribution of Comparative Example 2-5.

About 3,000 particles of the toner thus charged were then measured for particle size and charged amount. The measurements are shown in FIG. 16 and are set forth in detail in Table 2-7. As can be seen in FIG. 16, the center value in the toner particle size distribution [sign A (μm) in FIG. 16], the maximum charged amount [sign Bmax (fC) in FIG. 16], the minimum charged amount [sign Bmin (fC) in FIG. 16] and the width of the charged amount distribution [sign B (fC) in FIG. 16] were 3.73, −2.00, 0.56 and 2.56, respectively, which don't satisfy the formula 5, as set forth in Table 2-9. As can be seen in the results of evaluation of Table 2-10, there occurred poor fogging resistance. As previously mentioned, only data of division defined by particle size every 0.5 μm and charged amount every 0.5 fC having toner particles in an amount of 1% or more of the total number of toner particles were reviewed.

TABLE 2-7

| | Charged amount [fC] | | | | | | | | | | |
|---|---|---|---|---|---|---|---|---|---|---|---|
| Particle size [μm] | −7.25 | −6.75 | −6.25 | −5.75 | −5.25 | −4.75 | −4.25 | −3.75 | −3.25 | −2.75 | −2.25 |
| 0.25 | 0 | 0 | 0 | 0 | 0 | 0 | 0 | 0 | 0 | 0 | 0 |
| 0.75 | 0 | 0 | 0 | 0 | 0 | 0 | 0 | 0 | 0 | 0 | 0 |
| 1.25 | 0 | 0 | 0 | 0 | 0 | 0 | 0 | 0 | 0 | 0 | 0 |
| 1.75 | 0 | 0 | 0 | 0 | 0 | 0 | 0 | 0 | 0 | 0 | 0 |
| 2.25 | 0 | 0 | 0 | 0 | 0 | 0 | 0 | 0 | 0 | 0 | 0 |
| 2.75 | 0 | 0 | 0 | 0 | 0 | 0 | 0 | 0 | 0 | 0 | 0 |
| 3.25 | 0 | 0 | 0 | 0 | 0 | 0 | 0 | 0 | 0 | 0 | 0 |
| 3.75 | 0 | 0 | 0 | 0 | 0 | 0 | 0 | 0 | 0 | 0 | 0 |
| 4.25 | 0 | 0 | 0 | 0 | 0 | 0 | 0 | 0 | 0 | 0 | 0 |
| 4.75 | 0 | 0 | 0 | 0 | 0 | 0 | 0 | 0 | 0 | 0.1 | 0.4 |
| 5.25 | 0 | 0 | 0 | 0 | 0 | 0 | 0 | 0 | 0.033 | 0.033 | 0.067 |
| 5.75 | 0 | 0 | 0 | 0 | 0 | 0 | 0 | 0 | 0 | 0.033 | 0 |
| 6.25 | 0 | 0 | 0 | 0 | 0 | 0 | 0 | 0 | 0.033 | 0 | 0.067 |
| 6.75 | 0 | 0 | 0 | 0 | 0 | 0 | 0 | 0 | 0 | 0 | 0 |
| 7.25 | 0 | 0 | 0 | 0 | 0 | 0 | 0 | 0 | 0 | 0 | 0 |
| 7.75 | 0 | 0 | 0 | 0 | 0 | 0 | 0 | 0 | 0 | 0 | 0 |
| 8.25 | 0 | 0 | 0 | 0 | 0 | 0 | 0 | 0 | 0 | 0 | 0 |
| 8.75 | 0 | 0 | 0 | 0 | 0 | 0 | 0 | 0 | 0 | 0 | 0 |
| 9.25 | 0 | 0 | 0 | 0 | 0 | 0 | 0 | 0 | 0 | 0 | 0 |
| 9.75 | 0 | 0 | 0 | 0 | 0 | 0 | 0 | 0 | 0 | 0 | 0 |

| | Charged amount [fC] | | | | | | | | |
|---|---|---|---|---|---|---|---|---|---|
| Particle size [μm] | −1.75 | −1.25 | −.075 | −0.25 | 0.25 | 0.75 | 1.25 | 1.75 | 2.25 |
| 0.25 | 0 | 0 | 0 | 0 | 0 | 0 | 0 | 0 | 0 |
| 0.75 | 0 | 0 | 0 | 0 | 0 | 0 | 0 | 0 | 0 |
| 1.25 | 0 | 0 | 0 | 0.033 | 0 | 0 | 0 | 0 | 0 |
| 1.75 | 0 | 0 | 0 | 0.067 | 0.067 | 0 | 0 | 0 | 0 |
| 2.25 | 0 | 0 | 0.067 | 1.067 | 0.467 | 0 | 0 | 0 | 0 |
| 2.75 | 0 | 0 | 0.133 | 1.967 | 0.567 | 0 | 0.033 | 0 | 0 |
| 3.25 | 0 | 0.1 | 1.533 | 10.83 | 2.167 | 0.033 | 0 | 0 | 0 |
| 3.75 | 0.033 | 0.8 | 6 | 14.1 | 2.567 | 0.033 | 0 | 0 | 0 |
| 4.25 | 0.033 | 2.933 | 9.167 | 14.97 | 1.7 | 0.033 | 0 | 0 | 0.033 |
| 4.75 | 1.633 | 3.833 | 12.27 | 6.6 | 0.667 | 0 | 0 | 0 | 0 |
| 5.25 | 0.367 | 0.6 | 0.9 | 0.2 | 0.033 | 0 | 0 | 0 | 0 |
| 5.75 | 0.067 | 0 | 0.133 | 0.033 | 0 | 0 | 0 | 0 | 0 |
| 6.25 | 0 | 0.033 | 0.033 | 0 | 0 | 0 | 0 | 0 | 0 |
| 6.75 | 0 | 0 | 0 | 0 | 0 | 0 | 0 | 0 | 0 |
| 7.25 | 0 | 0 | 0 | 0 | 0 | 0 | 0 | 0 | 0 |
| 7.75 | 0 | 0 | 0 | 0 | 0 | 0 | 0 | 0 | 0 |
| 8.25 | 0 | 0 | 0 | 0 | 0 | 0 | 0 | 0 | 0 |
| 8.75 | 0 | 0 | 0 | 0 | 0 | 0 | 0 | 0 | 0 |
| 9.25 | 0 | 0 | 0 | 0 | 0 | 0 | 0 | 0 | 0 |
| 9.75 | 0 | 0 | 0 | 0 | 0 | 0 | 0 | 0 | 0 |

Comparative Example 2-6

To the same toner mother particles as used in Example 2-1 were then added 0.5 wt % of a large particle size silica (Type RX50; produced by NIPPON AEROSIL CO., LTD.), 0.5 wt % of a small particle size silica (Type RX300; produced by NIPPON AEROSIL CO., LTD.) and 0.7 wt % of titanium (STT-30S, produced by TITAN KOGYO KABUSHIKI KAISHA) as external additives. The mixture was then processed at a rotary speed of 2,000 rpm for 2 minutes using a small-sized stirrer.

The toner thus obtained was then negatively charged in a non-contact process development device similar to that of FIG. 2. The regulating pressure of the regulating blade was 34 gf/cm and the amount of the toner to be conveyed was 0.247 mg/cm$^2$. The conveying speed was adjusted to 310 mm/sec.

Figure 17:
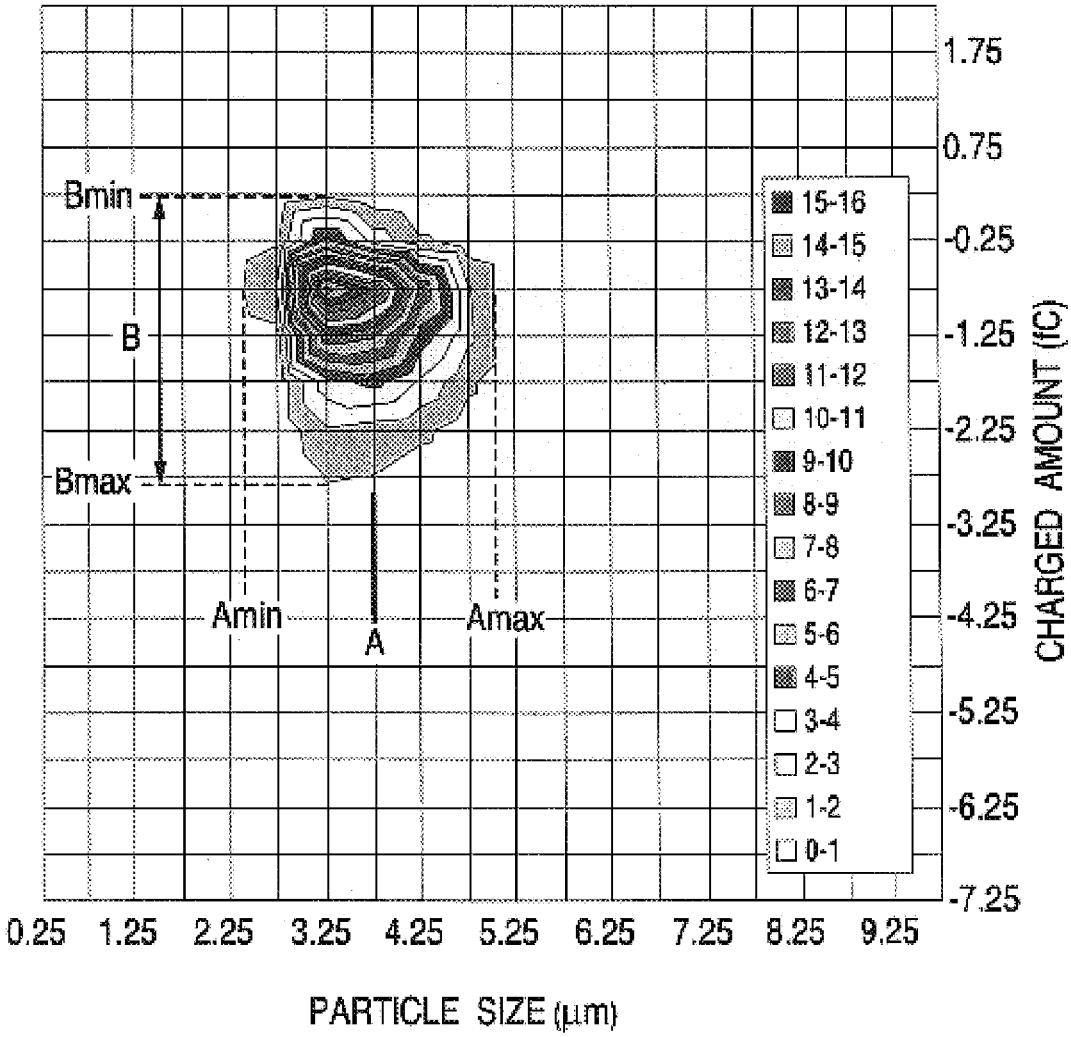
FIG. 17 is a drawing illustrating the particle size-charged amount distribution of Comparative Example 2-6.
Figure 18:
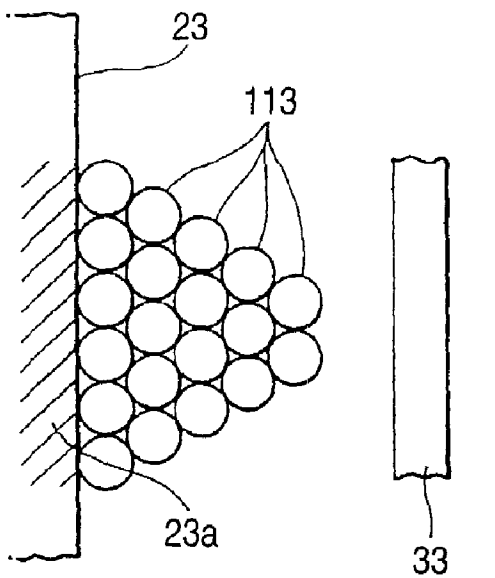
FIG. 18 is a schematic illustration showing the principle of white blanks.
Figure 18:
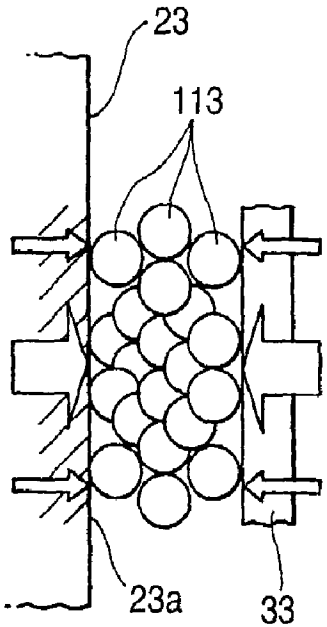
Figure 18:
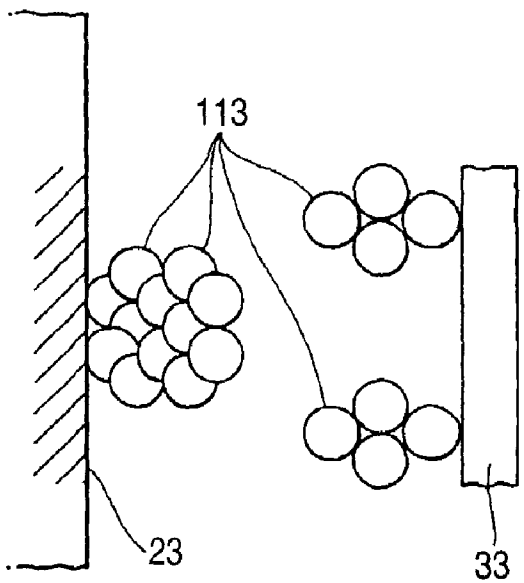
Figure 19:
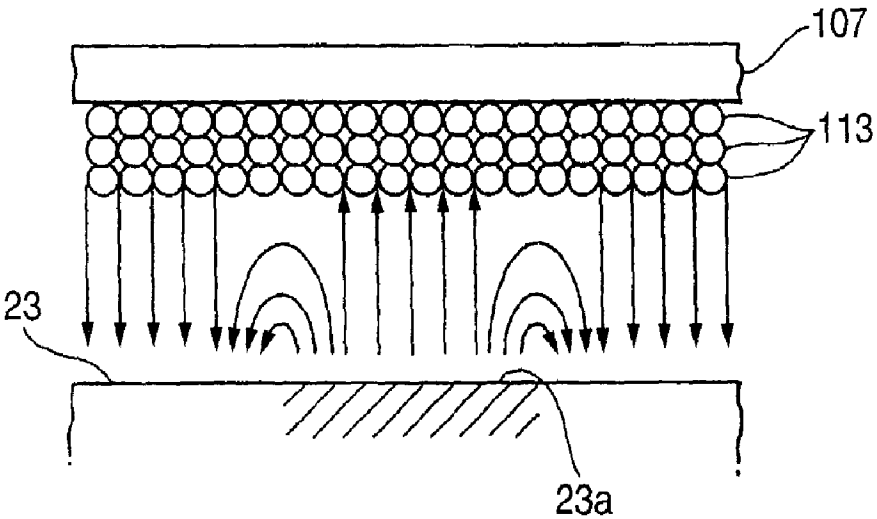
FIG. 19 is a schematic illustration showing the principle of edge effect.
Figure 19:
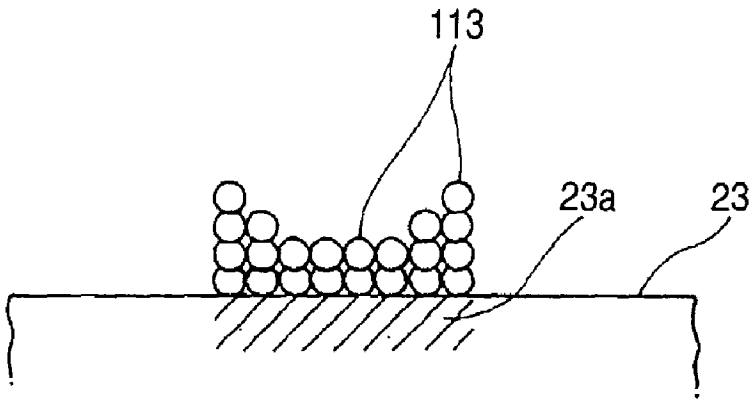

About 3,000 particles of the toner thus charged were then measured for particle size and charged amount. The measurements are shown in FIG. 17 and are set forth in detail in Table 2-8. As can be seen in FIG. 17, the center value in the toner particle size distribution [sign A (μm) in FIG. 17], the maximum charged amount [sign Bmax (fC) in FIG. 17], the minimum charged amount [sign Bmin (fC) in FIG. 17] and the width of the charged amount distribution [sign B (fC) in FIG. 17] were 3.72, −2.81, 0.23 and 3.04, respectively, which don't satisfy the formula 4, as set forth in Table 2-9. As can be seen in the results of evaluation of Table 2-10, there occurred poor background stain resistance. As previously mentioned, only data of division defined by particle size every 0.5 μm and charged amount every 0.5 fC having toner particles in an amount of 1% or more of the total number of toner particles were reviewed.

TABLE 2-8

| | Charged amount [fC] | | | | | | | | | | |
|---|---|---|---|---|---|---|---|---|---|---|---|
| Particle size [μm] | −7.25 | −6.75 | −6.25 | −5.75 | −5.25 | −4.75 | −4.25 | −3.75 | −3.25 | −2.75 | −2.25 |
| 0.25 | 0 | 0 | 0 | 0 | 0 | 0 | 0 | 0 | 0 | 0 | 0 |
| 0.75 | 0 | 0 | 0 | 0 | 0 | 0 | 0 | 0 | 0 | 0 | 0 |
| 1.25 | 0 | 0 | 0 | 0 | 0 | 0 | 0 | 0 | 0 | 0 | 0 |
| 1.75 | 0 | 0 | 0 | 0 | 0 | 0 | 0 | 0 | 0 | 0 | 0 |
| 2.25 | 0 | 0 | 0 | 0 | 0 | 0 | 0 | 0 | 0 | 0 | 0 |
| 2.75 | 0 | 0 | 0 | 0 | 0 | 0 | 0 | 0 | 0 | 0.067 | 0.2 |
| 3.25 | 0 | 0 | 0 | 0 | 0 | 0 | 0 | 0.033 | 0.5 | 1.067 | 1.867 |
| 3.75 | 0 | 0 | 0 | 0 | 0 | 0 | 0.033 | 0.1 | 0.333 | 0.967 | 1.567 |
| 4.25 | 0 | 0 | 0 | 0 | 0 | 0 | 0 | 0.033 | 0.367 | 0.533 | 1.233 |
| 4.75 | 0 | 0 | 0 | 0 | 0 | 0.033 | 0.033 | 0.1 | 0.1 | 0.233 | 0.333 |
| 5.25 | 0 | 0 | 0 | 0 | 0 | 0.033 | 0 | 0.033 | 0.033 | 0 | 0.033 |
| 5.75 | 0 | 0 | 0 | 0 | 0 | 0 | 0 | 0 | 0 | 0.033 | 0 |
| 6.25 | 0 | 0 | 0 | 0 | 0 | 0 | 0 | 0 | 0 | 0 | 0 |
| 6.75 | 0 | 0 | 0 | 0 | 0 | 0 | 0 | 0 | 0 | 0 | 0 |
| 7.25 | 0 | 0 | 0 | 0 | 0 | 0 | 0 | 0 | 0 | 0 | 0 |
| 7.75 | 0 | 0 | 0 | 0 | 0 | 0 | 0 | 0 | 0 | 0 | 0 |
| 8.25 | 0 | 0 | 0 | 0 | 0 | 0 | 0 | 0 | 0 | 0 | 0 |
| 8.75 | 0 | 0 | 0 | 0 | 0 | 0 | 0 | 0 | 0 | 0 | 0 |
| 9.25 | 0 | 0 | 0 | 0 | 0 | 0 | 0 | 0 | 0 | 0 | 0 |
| 9.75 | 0 | 0 | 0 | 0 | 0 | 0 | 0 | 0 | 0 | 0 | 0 |

| | Charged amount [fC] | | | | | | | | |
|---|---|---|---|---|---|---|---|---|---|
| Particle size [μm] | −1.75 | −1.25 | −0.75 | −0.25 | 0.25 | 0.75 | 1.25 | 1.75 | 2.25 |
| 0.25 | 0 | 0 | 0 | 0 | 0 | 0 | 0 | 0 | 0 |
| 0.75 | 0 | 0 | 0.033 | 0 | 0 | 0 | 0 | 0 | 0 |
| 1.25 | 0 | 0 | 0 | 0.067 | 0 | 0 | 0 | 0 | 0 |
| 1.75 | 0 | 0 | 0.067 | 0.033 | 0 | 0 | 0 | 0 | 0 |
| 2.25 | 0.033 | 0.133 | 0.567 | 0.333 | 0.067 | 0 | 0 | 0 | 0 |
| 2.75 | 0.333 | 0.633 | 2.033 | 0.9 | 0.2 | 0 | 0 | 0 | 0 |
| 3.25 | 3.567 | 8.9 | 15.53 | 5.233 | 0.833 | 0.033 | 0.033 | 0 | 0 |
| 3.75 | 4.3 | 8.1 | 12.97 | 2.633 | 0.2 | 0.067 | 0 | 0 | 0 |
| 4.25 | 2.867 | 4.6 | 7.1 | 1.2 | 0.033 | 0.067 | 0 | 0 | 0 |
| 4.75 | 1.233 | 2.233 | 2.2 | 0.4 | 0 | 0 | 0 | 0 | 0 |
| 5.25 | 0.1 | 0.067 | 0.067 | 0.033 | 0 | 0 | 0 | 0 | 0 |
| 5.75 | 0 | 0.033 | 0 | 0 | 0 | 0 | 0 | 0 | 0 |
| 6.25 | 0 | 0 | 0 | 0 | 0 | 0 | 0.033 | 0 | 0 |
| 6.75 | 0 | 0 | 0 | 0 | 0 | 0 | 0 | 0 | 0 |
| 7.25 | 0 | 0 | 0 | 0 | 0 | 0 | 0 | 0 | 0 |
| 7.75 | 0 | 0 | 0 | 0 | 0 | 0 | 0 | 0 | 0 |
| 8.25 | 0 | 0 | 0 | 0 | 0 | 0 | 0 | 0 | 0 |
| 8.75 | 0 | 0 | 0 | 0 | 0 | 0 | 0 | 0 | 0 |
| 9.25 | 0 | 0 | 0 | 0 | 0 | 0 | 0 | 0 | 0 |
| 9.75 | 0 | 0 | 0 | 0 | 0 | 0 | 0 | 0 | 0 |

TABLE 2-9

| | Amax | Amin | A | ½ · A | ⅔ 2· A | Bmax | Bmin | B |
|---|---|---|---|---|---|---|---|---|
| Example 2-1 | 7.24 | 4.48 | 5.86 | 2.93 | 3.91 | −3.69 | 0.07 | 3.76 |
| Comparative Example 2-1 | 7.61 | 4.25 | 5.93 | 2.97 | 3.95 | −2.69 | 0.15 | 2.84 |
| Comparative Example 2-2 | 7.22 | 4.16 | 5.69 | 2.85 | 3.79 | −2.64 | 0.66 | 3.30 |
| Comparative Example 2-3 | 7.29 | 4.25 | 5.77 | 2.89 | 3.85 | −4.38 | 0.13 | 4.51 |
| Example 2-2 | 5.23 | 2.13 | 3.68 | 1.84 | 2.45 | −2.01 | 0.20 | 2.21 |
| Comparative Example 2-4 | 5.21 | 2.27 | 3.74 | 1.87 | 2.49 | −1.30 | 0.23 | 1.53 |
| Comparative Example 2-5 | 5.25 | 2.22 | 3.73 | 1.87 | 2.49 | −2.00 | 0.56 | 2.56 |
| Comparative Example 2-6 | 5.03 | 2.40 | 3.72 | 1.86 | 2.48 | −2.81 | 0.23 | 3.04 |

TABLE 2-10

| | Dot formation | Background stain resistance | Fogging resistance |
|---|---|---|---|
| Example 2-1 | Good | Good | Good (0.12) |
| Comparative Example 2-1 | Poor | Good | Good (0.13) |
| Comparative Example 2-2 | Good | Good | Poor (0.15) |
| Comparative Example 2-3 | Good | Poor | Good (0.10) |
| Example 2-2 | Good | Good | Good (0.13) |
| Comparative Example 2-4 | Poor | Good | Good (0.12) |
| Comparative Example 2-5 | Good | Good | Poor (0.16) |
| Comparative Example 2-6 | Good | Poor | Good (0.13) |

Production of Toner Mother Particles 3-A

A monomer mixture comprising 80 parts by weight of a styrene monomer, 20 parts by weight of butyl acrylate and 5 parts by weight of acrylic acid was added to a water-soluble mixture comprising 105 parts by weight of water, 1 part by weight of a nonionic emulsifier, 1.5 parts by weight of an anionic emulsifier and 0.55 parts by weight of potassium persulfate to obtain a lacteous resin emulsion having a particle size of 0.25 μm.

Subsequently, 200 parts by weight of the resin emulsion thus obtained, 20 parts by weight of a polyethylene wax emulsion (produced by Sanyo Chemical Industries, Ltd.) and 7 parts by weight of a phthalocyanine blue were dispersed in water containing 0.2 parts by weight of sodium dodecylbenzenesulfonate as a surface active agent. To the mixture was then added diethylamine to adjust the pH value thereof to 5.5. To the mixture was then added 0.3 parts by weight of aluminum sulfate as an electrolyte with stirring. Subsequently, the mixture was subjected to high speed stirring using a TK homomixer to undergo dispersion. To the mixture were then added 40 parts by weight of a styrene monomer, 10 parts by weight of butyl acrylate and 5 parts by weight of zinc salicylate together with 40 parts by weight of water. The mixture was then heated to 90° C. with stirring in a nitrogen stream. To the mixture was then added aqueous hydrogen peroxide. The mixture was then allowed to undergo polymerization for 5 hours to cause the growth of particles. After the termination of polymerization, with the pH value being adjusted to not lower than 5, the mixture was then heated to 95° C. where it was then allowed to stand for 5 hours to enhance the bonding strength of associated particles. Thereafter, the particulate material thus obtained was washed with water, and then vacuum-dried at 45° C. for 10 hours. Thus, toner mother particles 3-A having an average particle size of 6.5 μm were obtained.

Production of Toner Mother Particles 3-B

A monomer mixture comprising 80 parts by weight of a styrene monomer, 20 parts by weight of butyl acrylate and 5 parts by weight of acrylic acid was added to a water-soluble mixture comprising 105 parts by weight of water, 1 part by weight of a nonionic emulsifier, 1.5 parts by weight of an anionic emulsifier and 0.55 parts by weight of potassium persulfate to obtain a lacteous resin emulsion having a particle size of 0.25 μm.

Subsequently, 200 parts by weight of the resin emulsion thus obtained, 20 parts by weight of a polyethylene-wax emulsion (produced by Sanyo Chemical Industries, Ltd.) and 10 parts by weight of a phthalocyanine blue were dispersed in water containing 0.2 parts by weight of sodium dodecylbenzenesulfonate as a surface active agent. To the mixture was then added diethylamine to adjust the pH value thereof to 5.5. To the mixture was then added 0.3 parts by weight of aluminum sulfate as an electrolyte with stirring. Subsequently, the mixture was subjected to high speed stirring using a TK homomixer to undergo dispersion. To the mixture were then added 40 parts by weight of a styrene monomer, 10 parts by weight of butyl acrylate and 5 parts by weight of zinc salicylate together with 40 parts by weight of water. The mixture was then heated to 90° C. with stirring in a nitrogen stream. To the mixture was then added aqueous hydrogen peroxide. The mixture was then allowed to undergo polymerization for 3 hours to cause the growth of particles. After the termination of polymerization, with the pH value being adjusted to not lower than 5, the mixture was then heated to 95° C. where it was then allowed to stand for 5 hours to enhance the bonding strength of associated particles. Thereafter, the particulate material thus obtained was washed with water, and then vacuum-dried at 45° C. for 10 hours. Thus, toner mother particles 3-B having an average particle size of 4.8 μm were obtained.

Example 3-1

To the toner mother particles 3-A were then added 0.4 wt % of a large particle size silica (Type RX50; produced by NIPPON AEROSIL CO., LTD.), 0.6 wt % of a small particle size silica (Type RX200; produced by NIPPON AEROSIL CO., LTD.) and 0.4 wt % of titanium (STT-30S, produced by TITAN KOGYO KABUSHIKI KAISHA). The mixture was then processed at a rotary speed of 2,000 rpm for 2 minutes using a small-sized stirrer to produce a toner.

The toner thus obtained was then negatively charged in a non-contact process development device similar to that of FIG. 2. The regulating pressure of the regulating blade was 34 gf/cm and the amount of the toner to be conveyed was 0.355 mg/cm$^2$.

Figure 20:
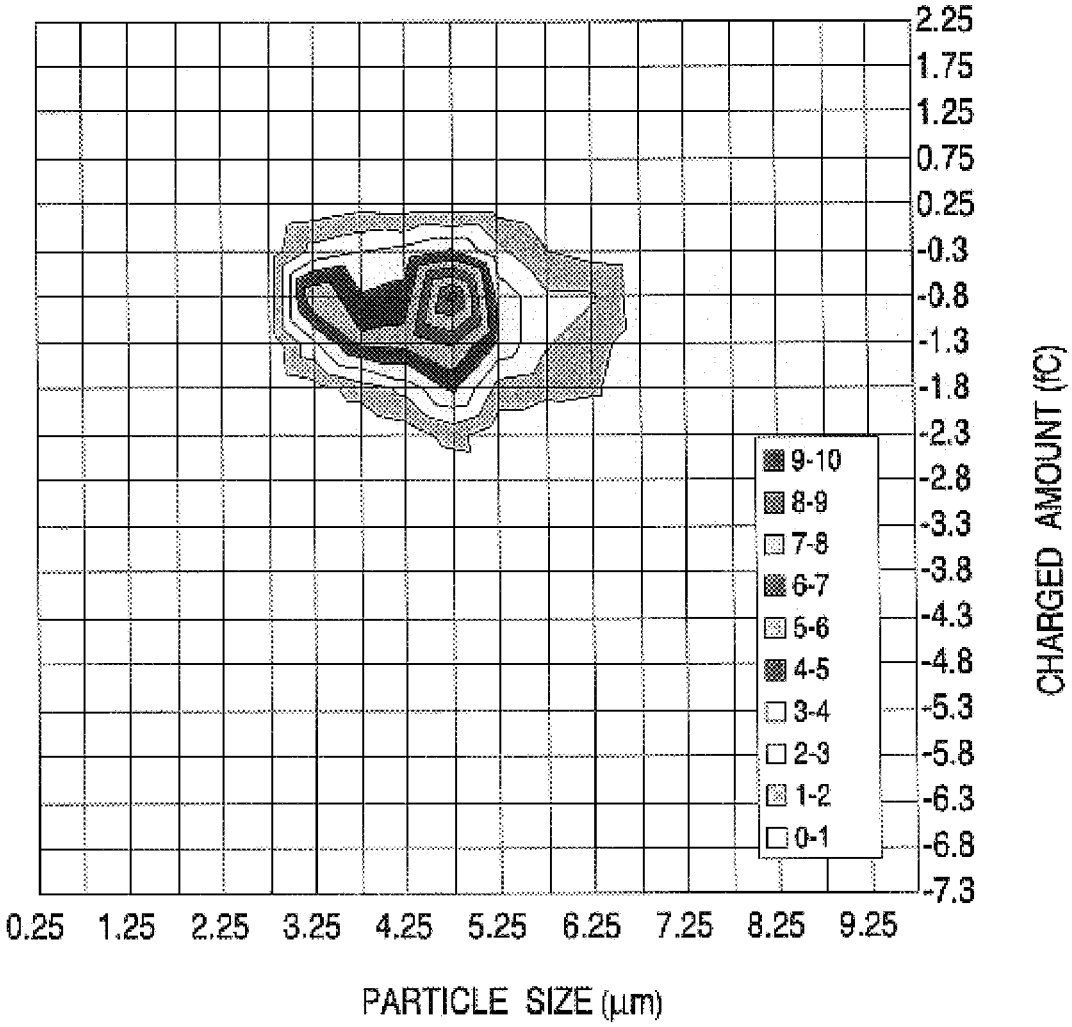
FIG. 20 is a drawing illustrating the particle size-charged amount distribution of Example 3-1.
Figure 21:
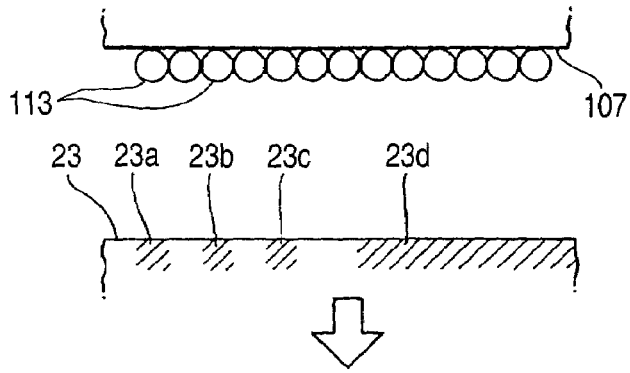
FIG. 21 is a schematic illustration showing the principle of starvation.
Figure 21:
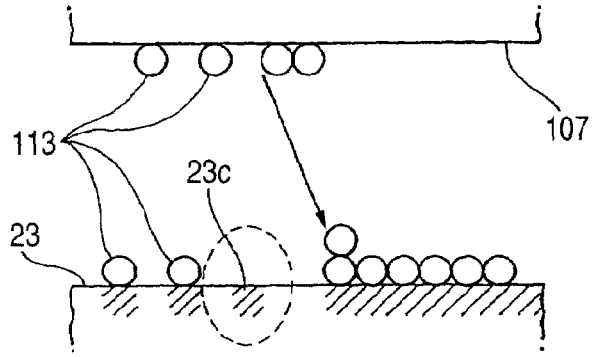

About 3,000 particles of the toner thus charged were then measured for particle size and charged amount. The measurements are set forth in Table 3-1 and a three-dimensional graph corresponding to these data is shown in FIG. 20.

TABLE 3-1

| | Charged amount [fC] | | | | | | | | | | |
|---|---|---|---|---|---|---|---|---|---|---|---|
| Particle size [μm] | −7.25 | −6.75 | −6.25 | −5.75 | −5.25 | −4.75 | −4.25 | −3.75 | −3.25 | −2.75 | −2.25 |
| 0.25 | — | — | — | — | — | — | — | — | — | — | — |
| 0.75 | — | — | — | — | — | — | — | — | — | — | — |
| 1.25 | — | — | — | — | — | — | — | — | — | — | — |

TABLE 3-1-continued

| | | | | | | | | | | | |
|---|---|---|---|---|---|---|---|---|---|---|---|
| 1.75 | — | — | — | — | — | — | — | — | — | — | — |
| 2.25 | — | — | — | — | — | — | — | — | — | — | — |
| 2.75 | — | — | — | — | — | — | — | — | — | — | — |
| 3.25 | — | — | — | — | — | — | — | — | — | — | — |
| 3.75 | — | — | — | — | — | — | — | — | — | 0.033 | 0.167 |
| 4.25 | — | — | — | — | — | — | — | — | — | 0.033 | 0.467 |
| 4.75 | — | — | — | — | — | — | 0.067 | — | 0.067 | 0.300 | 1.333 |
| 5.25 | — | — | — | — | — | 0.033 | 0.033 | 0.100 | 0.167 | 0.500 | 0.333 |
| 5.75 | — | — | — | — | — | 0.033 | 0.067 | 0.033 | 0.167 | 0.300 | 0.333 |
| 6.25 | — | — | — | 0.033 | — | — | 0.133 | — | 0.167 | 0.167 | 0.433 |
| 6.75 | — | — | — | — | — | — | — | 0.067 | 0.067 | — | 0.200 |
| 7.25 | — | — | — | — | — | — | — | — | — | 0.067 | — |
| 7.75 | 0.033 | — | — | — | — | — | — | — | — | — | 0.100 |
| 8.25 | — | — | — | — | — | — | — | — | — | — | — |
| 8.75 | — | — | — | — | — | — | — | — | — | — | — |
| 9.25 | — | — | — | — | — | — | — | — | — | — | — |
| 9.75 | — | — | — | — | — | — | — | — | — | — | — |

| | Charged amount [fC] | | | | | | | | | |
|---|---|---|---|---|---|---|---|---|---|---|
| Particle size [μm] | −1.75 | −1.25 | −0.75 | −0.25 | 0.25 | 0.75 | 1.25 | 1.75 | 2.25 | |
| 0.25 | — | — | — | — | — | — | — | — | — | — |
| 0.75 | — | — | — | — | — | — | — | — | — | — |
| 1.25 | — | — | 0.033 | — | — | — | — | — | — | 0.033 |
| 1.75 | — | — | 0.033 | 0.067 | — | — | — | — | — | 0.100 |
| 2.25 | — | 0.067 | 0.100 | 0.133 | 0.033 | — | — | — | — | 0.333 |
| 2.75 | — | 0.100 | 0.367 | 0.400 | — | — | — | 0.033 | — | 0.900 |
| 3.25 | 0.600 | 2.900 | 6.000 *3 | 2.367 | 0.267 | — | — | — | — | 12.133 |
| 3.75 | 1.367 | 5.300 | 4.100 | 3.000 | 0.567 | — | — | — | — | 14.533 |
| 4.25 | 2.333 | 5.367 | 4.433 | 3.233 | 0.433 | — | — | — | — | 16.300 |
| 4.75 | 4.267 | 6.167 | 9.367 *1 | 4.100 | 0.367 | — | 0.033 | — | — | 26.067 |
| 5.25 | 1.600 | 3.767 | 3.633 | 2.267 | 0.433 | 0.067 | — | — | — | 12.933 |
| 5.75 | 1.200 | 2.100 | 2.200 | 1.033 | 0.167 | 0.033 | 0.067 | — | — | 7.733 |
| 6.25 | 1.133 | 1.333 | 2.133 | 0.600 | 0.133 | — | — | — | — | 6.267 |
| 6.75 | 0.233 | 0.533 *2 | 0.367 | 0.433 | 0.100 | 0.033 | — | — | — | 2.033 |
| 7.25 | 0.033 | 0.033 | 0.033 | 0.100 | 0.067 | — | — | — | — | 0.333 |
| 7.75 | — | 0.033 | — | 0.033 | 0.033 | — | — | — | — | 0.233 |
| 8.25 | — | 0.033 | — | — | — | 0.033 | — | — | — | 0.067 |
| 8.75 | — | — | — | — | — | — | — | — | — | — |
| 9.25 | — | — | — | — | — | — | — | — | — | — |
| 9.75 | — | — | — | — | — | — | — | — | — | — |

*1: A1, B1
*2: A2, B2
*3: A3, B3

As can be seen in Table 3-1, the particle size divisional value A1 [μm] and the charged amount divisional value B1 [fC] in the division where there is the largest number proportion of the toner particles, the particle size divisional value A3 [μm] where the particulate toner has the greatest particle size in the particle size distribution indicating that the number proportion of the toner particles is 1% or more and the charged amount divisional value B3 [fC] where there is the largest number proportion of the toner particles when the particle size division is A3 defined above were 4.75, −0.75, 6.75 and −1.25, respectively, and (B3−B1)/(A3−A1) is −0.25, demonstrating that the aforementioned formulas 1 and 2 are satisfied (see Table 3-7).

Further, the particle size divisional value A2 [μm] where the particulate toner has the smallest particle size in the particle size distribution indicating that the number proportion of the toner particles is 1% or more and the charged amount divisional value B2 [fC] where there is the largest number proportion of the toner particles when the particle size division is A2 defined above were 3.25 and −0.75, respectively, and the relationship between A1 and B1 (B2−B1)/(A2−A1) was 0, demonstrating that the aforementioned formula 12 is satisfied (see Table 3-7).

Under these conditions, image formation was effected. The resulting printed matter was then evaluated for white blanks, fogging and edge effect. The results of evaluation are set forth in Table 3-8 below. Under the conditions of Example 3-1, no white blanks were observed. The edge effect was inhibited. An image having a uniform development density was formed with little density difference between end portion and center. Further, no fogging was observed.

Example 3-2

To the toner mother particles 3-A were then added 0.4 wt % of a large particle size silica (Type RX50; produced by NIPPON AEROSIL CO., LTD.), 0.6 wt % of a small particle size silica (Type RX200; produced by NIPPON AEROSIL CO., LTD.) and 0.7 wt % of titanium (STT-30S, produced by TITAN KOGYO KABUSHIKI KAISHA). The mixture was then processed at a rotary speed of 2,000 rpm for 2 minutes using a small-sized stirrer to produce a toner.

The toner thus obtained was then negatively charged in a non-contact process development device similar to that of FIG. 2. The regulating pressure of the regulating blade was 35 gf/cm and the amount of the toner to be conveyed was 0.348 mg/cm$^2$.

About 3,000 particles of the toner thus charged were then measured for particle size and charged amount. The measurements are set forth in Table 3-2.

TABLE 3-2

| | Charged amount [fC] | | | | | | | | | | |
|---|---|---|---|---|---|---|---|---|---|---|---|
| Particle size [μm] | −7.25 | −6.75 | −6.25 | −5.75 | −5.25 | −4.75 | −4.25 | −3.75 | −3.25 | −2.75 | −2.25 |
| 0.25 | — | — | — | — | — | — | — | — | — | — | — |
| 0.75 | — | — | — | — | — | — | — | — | — | — | — |
| 1.25 | — | — | — | — | — | — | — | — | — | — | — |
| 1.75 | — | — | — | — | — | — | — | — | — | — | — |
| 2.25 | — | — | — | — | — | — | — | — | — | — | — |
| 2.75 | — | — | — | — | — | — | — | — | — | — | — |
| 3.25 | — | — | — | — | — | — | — | — | — | — | 0.067 |
| 3.75 | — | — | — | — | — | — | — | — | 0.033 | 0.133 | 0.500 |
| 4.25 | — | — | — | — | — | — | — | — | 0.133 | 0.433 | 1.200 |
| 4.75 | — | — | — | — | — | 0.033 | 0.033 | 0.200 | 0.533 | 1.033 | 1.967 |
| 5.25 | — | — | 0.067 | 0.033 | — | 0.033 | 0.133 | 0.167 | 0.233 | 0.500 | 0.800 |
| 5.75 | — | — | — | — | — | 0.067 | 0.100 | 0.200 | 0.333 | 0.267 | 0.400 |
| 6.25 | 0.033 | 0.067 | 0.033 | 0.033 | — | 0.067 | 0.033 | 0.167 | 0.167 | 0.200 | 0.300 |
| 6.75 | — | — | — | — | 0.067 | 0.033 | 0.033 | — | 0.100 | 0.067 | 0.100 |
| 7.25 | — | — | — | — | 0.033 | 0.033 | — | — | 0.033 | — | 0.033 |
| 7.75 | — | — | 0.033 | — | — | — | — | — | 0.033 | — | 0.033 |
| 8.25 | — | — | — | — | — | — | — | — | — | — | — |
| 8.75 | — | — | — | — | — | — | — | — | — | — | — |
| 9.25 | — | — | — | — | — | — | — | — | — | — | — |
| 9.75 | — | — | — | — | — | — | — | — | — | — | — |

| | Charged amount [fC] | | | | | | | | | |
|---|---|---|---|---|---|---|---|---|---|---|
| Particle size [μm] | −1.75 | −1.25 | −0.75 | −0.25 | 0.25 | 0.75 | 1.25 | 1.75 | 2.25 | |
| 0.25 | — | — | — | — | — | — | — | — | — | — |
| 0.75 | — | — | — | — | — | — | — | — | — | — |
| 1.25 | — | — | 0.033 | — | 0.033 | — | — | — | — | 0.067 |
| 1.75 | — | — | 0.033 | — | — | — | — | — | — | 0.033 |
| 2.25 | 0.033 | 0.200 | 0.067 | 0.033 | 0.067 | — | — | — | — | 0.400 |
| 2.75 | 0.067 | 0.200 | 0.267 | 0.067 | 0.033 | — | — | — | — | 0.633 |
| 3.25 | 0.667 | 1.800 | 1.467 | 0.600 | 0.167 | — | — | — | — | 4.767 |
| | | *3 | | | | | | | | |
| 3.75 | 1.733 | 2.767 | 1.000 | 0.967 | 0.167 | — | — | — | — | 7.300 |
| 4.25 | 2.600 | 2.667 | 2.000 | 1.933 | 0.267 | — | — | — | — | 11.233 |
| 4.75 | 3.233 | 4.033 | 6.167 | 4.633 | 1.633 | 0.067 | 0.033 | — | 0.033 | 23.633 |
| | | | *1 | | | | | | | |
| 5.25 | 1.300 | 3.333 | 4.667 | 5.000 | 1.733 | — | — | — | — | 18.000 |
| 5.75 | 0.733 | 2.100 | 4.100 | 3.300 | 1.200 | 0.167 | — | — | — | 12.967 |
| 6.25 | 0.733 | 2.400 | 3.667 | 3.067 | 1.200 | 0.400 | 0.033 | — | — | 12.600 |
| 6.75 | 0.233 | 0.833 | 1.200 | 2.033 | 1.200 | 0.267 | 0.033 | — | — | 6.200 |
| 7.25 | 0.067 | 0.167 | 0.233 | 0.433 | 0.167 | 0.033 | 0.033 | — | — | 1.267 |
| | | | | *2 | | | | | | |
| 7.75 | — | 0.067 | 0.100 | 0.133 | 0.200 | — | — | — | 0.033 | 0.633 |
| 8.25 | — | — | — | — | — | — | — | — | — | — |
| 8.75 | — | — | 0.067 | 0.033 | — | 0.033 | — | — | — | 0.133 |
| 9.25 | — | — | — | — | — | — | — | — | — | — |
| 9.75 | — | — | — | — | — | — | — | — | — | — |

*1: A1, B1
*2: A2, B2
*3: A3, B3

As can be seen in Table 3-2, the particle size divisional value A1 [μm] and the charged amount divisional value B1 [fC] in the division where there is the largest number proportion of the toner particles, the particle size divisional value A3 [μm] where the particulate toner has the greatest particle size in the particle size distribution indicating that the number proportion of the toner particles is 1% or more and the charged amount divisional value B3 [fC] where there is the largest number proportion of the toner particles when the particle size division is A3 defined above were 4.75, −0.75, 7.25 and −0.25, respectively, and (B3−B1)/(A3−A1) is −0.20, demonstrating that the aforementioned formulas 1 and 2 are satisfied (see Table 3-7).

Further, the particle size divisional value A2 [μm] where the particulate toner has the smallest particle size in the particle size distribution indicating that the number proportion of the toner particles is 1% or more and the charged amount divisional value B2 [fC] where there is the largest number proportion of the toner particles when the particle size division is A2 defined above were 3.25 and −1.25, respectively, and the formula between A1 and B1 (B2−B1)/(A2−A1) was 0.33, demonstrating that the aforementioned formula 12 is satisfied (see Table 3-7).

Under these conditions, image formation was effected. The resulting printed matter was then evaluated for white blanks, fogging and edge effect. The results of evaluation are set forth in Table 3-8 below. Under the conditions of Example 3-2, no white blanks were observed. The edge effect was inhibited. An image having a uniform development density was formed with little density difference between end portion and center. Further, no fogging was observed.

Example 3-3

To the toner mother particles 3-B were then added 0.7 wt % of a large particle size silica (Type RX50; produced by NIPPON AEROSIL CO., LTD.), 1.0 wt % of a small particle size silica (Type RX200; produced by NIPPON AEROSIL CO., LTD.) and 0.5 wt % of titanium (STT-30S, produced by TITAN KOGYO KABUSHIKI KAISHA). The mixture was then processed at a rotary speed of 2,000 rpm for 2 minutes using a small-sized stirrer to produce a toner.

The toner thus obtained was then negatively charged in a non-contact process development device similar to that of FIG. 2. The regulating pressure of the regulating blade was 33 gf/cm and the amount of the toner to be conveyed was 0.354 mg/cm$^2$.

About 3,000 particles of the toner thus charged were then measured for particle size and charged amount. The measurements are set forth in Table 3-3.

As can be seen in Table 3-3, the particle size divisional value A1 [μm] and the charged amount divisional value B1 [fC] in the division where there is the largest number proportion of the toner particles, the particle size divisional value A3 [μm] where the particulate toner has the greatest particle size in the particle size distribution indicating that the number proportion of the toner particles is 1% or more and the charged amount divisional value B3 [fC] where there is the largest number proportion of the toner particles when the particle size division is A3 defined above were 3.25, −0.25, 5.75 and −2.25, respectively, and (B3−B1)/(A3−A1) is −0.8, demonstrating that the aforementioned formulas 1 and 2 are satisfied (see Table 3-7).

Further, the particle size divisional value A2 [μm] where the particulate toner has the smallest particle size in the particle size distribution indicating that the number proportion of the toner particles is 1% or more and the charged amount divisional value B2 [fC] where there is the largest

TABLE 3-3

| | Charged amount [fC] | | | | | | | | | | |
|---|---|---|---|---|---|---|---|---|---|---|---|
| Particle size [μm] | −7.25 | −6.75 | −6.25 | −5.75 | −5.25 | −4.75 | −4.25 | −3.75 | −3.25 | −2.75 | −2.25 |
| 0.25 | — | — | — | — | — | — | — | — | — | — | — |
| 0.75 | — | — | — | — | — | — | — | — | — | — | — |
| 1.25 | — | — | — | — | — | — | — | — | — | — | — |
| 1.75 | — | — | — | — | — | — | — | — | — | — | — |
| 2.25 | — | — | — | — | — | — | — | — | — | — | — |
| 2.75 | — | — | — | — | — | — | — | — | — | — | — |
| 3.25 | — | — | — | — | — | — | — | — | — | — | — |
| 3.75 | — | — | — | — | — | — | — | — | 0.033 | — | 0.100 |
| 4.25 | — | — | — | — | — | — | 0.033 | — | 0.067 | 0.133 | 0.333 |
| 4.75 | — | — | — | — | 0.067 | 0.100 | 0.167 | 0.333 | 0.733 | 1.067 | 1.567 |
| 5.25 | — | — | 0.033 | 0.033 | 0.100 | 0.133 | 0.100 | 0.300 | 0.333 | 0.600 | 0.867 |
| 5.75 | 0.067 | — | 0.033 | — | 0.067 | 0.033 | 0.067 | 0.200 | 0.167 | 0.067 | 0.267 *2 |
| 6.25 | — | — | — | — | — | 0.033 | 0.100 | 0.033 | 0.133 | 0.067 | 0.033 |
| 6.75 | — | — | — | — | — | — | — | 0.033 | 0.067 | — | — |
| 7.25 | — | — | — | 0.033 | — | — | — | — | 0.033 | — | — |
| 7.75 | — | — | — | — | — | — | — | — | — | — | — |
| 8.25 | — | — | — | — | — | — | — | — | — | — | — |
| 8.75 | — | — | — | — | — | — | — | — | — | — | — |
| 9.25 | — | — | — | — | — | — | — | — | — | — | — |
| 9.75 | — | — | — | — | — | — | — | — | — | — | — |

| | Charged amount [fC] | | | | | | | | | |
|---|---|---|---|---|---|---|---|---|---|---|
| Particle size [μm] | −1.75 | −1.25 | −0.75 | −0.25 | 0.25 | 0.75 | 1.25 | 1.75 | 2.25 | |
| 0.25 | — | — | — | — | — | — | — | — | — | — |
| 0.75 | — | — | — | — | — | — | — | — | — | — |
| 1.25 | — | — | — | — | — | — | — | — | — | — |
| 1.75 | — | — | — | — | — | — | — | — | — | — |
| 2.25 | — | — | 0.267 | 0.400 | 0.167 | — | — | — | — | 0.833 |
| 2.75 | — | 0.033 | 0.667 *3 | 1.433 | 0.467 | 0.033 | — | — | — | 2.633 |
| 3.25 | 0.100 | 0.900 | 5.633 | 9.167 *1 | 2.800 | 0.167 | — | — | — | 18.767 |
| 3.75 | 0.233 | 2.667 | 8.033 | 7.233 | 3.000 | 0.467 | — | — | — | 21.767 |
| 4.25 | 1.900 | 3.967 | 8.333 | 5.533 | 1.767 | 0.400 | 0.067 | — | — | 22.533 |
| 4.75 | 3.033 | 5.400 | 6.700 | 3.967 | 1.267 | 0.200 | 0.033 | 0.033 | — | 24.667 |
| 5.25 | 1.233 | 1.100 | 1.133 | 0.500 | 0.100 | 0.033 | — | — | — | 6.600 |
| 5.75 | 0.167 | 0.033 | 0.067 | — | 0.033 | — | — | — | — | 1.267 |
| 6.25 | 0.033 | 0.067 | 0.067 | 0.033 | — | — | — | — | — | 0.600 |
| 6.75 | — | — | — | 0.033 | — | 0.033 | — | — | — | 0.167 |
| 7.25 | — | — | — | — | — | — | — | — | — | 0.067 |
| 7.75 | — | — | — | — | — | — | — | — | — | — |
| 8.25 | — | — | — | — | — | — | — | — | — | — |
| 8.75 | — | — | — | — | — | — | — | — | — | — |
| 9.25 | — | — | — | — | — | — | — | — | — | — |
| 9.75 | — | — | — | — | — | — | — | — | — | — |

*1: A1, B1
*2: A2, B2
*3: A3, B3 number proportion of the toner particles when the particle size division is A2 defined above were 2.75 and −0.75, respectively, and the formula between A1 and B1 (B2−B1)/(A2−A1) was 1, demonstrating that the aforementioned formula 12 is satisfied (see Table 3-7).

Under these conditions, image formation was effected. The resulting printed matter was then evaluated for white blanks, fogging and edge effect. The results of evaluation are set forth in Table 3-8 below. Under the conditions of Example 3-3, no white blanks were observed. The edge effect was inhibited. An image having a uniform development density was formed with little density difference between end portion and center. Further, no fogging was observed.

Example 3-4

To the toner mother particles 3-A were then added 0.5 wt % of a large particle size silica (Type RX50; produced by NIPPON AEROSIL CO., LTD.), 0.5 wt % of a small particle size silica (Type RX200; produced by NIPPON AEROSIL CO., LTD.) and 0.3 wt % of titanium (STT-30S, produced by TITAN KOGYO KABUSHIKI KAISHA). The mixture was then processed at a rotary speed of 2,000 rpm for 2 minutes using a small-sized stirrer to produce a toner.

The toner thus obtained was then negatively charged in a non-contact process development device similar to that of FIG. 2. The regulating pressure of the regulating blade was 33 gf/cm and the amount of the toner to be conveyed was 0.349 mg/cm$^2$.

About 3,000 particles of the toner thus charged were then measured for particle size and charged amount. The measurements are set forth in Table 3-4.

TABLE 3-4

| | Charged amount [fC] | | | | | | | | | | |
|---|---|---|---|---|---|---|---|---|---|---|---|
| Particle size [μm] | −7.25 | −6.75 | −6.25 | −5.75 | −5.25 | −4.75 | −4.25 | −3.75 | −3.25 | −2.75 | −2.25 |
| 0.25 | — | — | — | — | — | — | — | — | — | — | — |
| 0.75 | — | — | — | — | — | — | — | — | — | — | — |
| 1.25 | — | — | — | — | — | — | — | — | — | — | — |
| 1.75 | — | — | — | — | — | — | — | — | — | — | — |
| 2.25 | — | — | — | — | — | — | — | — | — | — | — |
| 2.75 | — | — | — | — | — | — | — | — | — | — | — |
| 3.25 | — | — | — | — | — | — | — | — | — | — | 0.167 |
| 3.75 | — | — | — | — | — | — | — | — | 0.033 | 0.100 | 1.167 |
| 4.25 | — | — | — | — | — | — | — | — | 0.033 | 0.933 | 2.767 |
| 4.75 | — | — | — | — | — | 0.067 | 0.033 | 0.133 | 1.133 | 2.833 | 5.767 |
| 5.25 | — | — | — | 0.067 | — | 0.133 | 0.200 | 0.500 | 0.700 | 2.200 | 4.000 |
| 5.75 | — | — | 0.033 | 0.033 | 0.067 | 0.100 | 0.233 | 0.333 | 1.033 | 1.533 | 2.567 |
| 6.25 | 0.033 | — | 0.033 | 0.100 | 0.033 | 0.167 | 0.167 | 0.533 | 1.267 | 1.467 | 1.800 |
| 6.75 | — | — | — | 0.033 | 0.100 | — | 0.133 | 0.267 | 0.433 | 0.467 *2 | 0.200 |
| 7.25 | — | — | — | — | — | 0.067 | — | 0.033 | 0.033 | 0.033 | 0.100 |
| 7.75 | — | — | — | — | — | 0.067 | 0.033 | — | 0.033 | 0.033 | 0.033 |
| 8.25 | — | — | — | — | — | — | — | 0.033 | — | — | — |
| 8.75 | — | — | — | — | — | — | — | — | — | — | — |
| 9.25 | — | — | — | — | — | — | — | — | — | — | — |
| 9.75 | — | — | — | — | — | — | — | — | — | — | — |

| | Charged amount [fC] | | | | | | | | | |
|---|---|---|---|---|---|---|---|---|---|---|
| Particle size [μm] | −1.75 | −1.25 | −0.75 | −0.25 | 0.25 | 0.75 | 1.25 | 1.75 | 2.25 | |
| 0.25 | — | — | — | — | — | — | — | — | — | — |
| 0.75 | — | — | — | — | — | — | — | — | — | — |
| 1.25 | — | — | — | — | 0.033 | — | — | — | — | 0.033 |
| 1.75 | — | — | — | 0.033 | 0.067 | — | — | — | — | 0.100 |
| 2.25 | — | 0.033 | 0.033 | 0.200 | 0.033 | 0.033 | — | — | — | 0.333 |
| 2.75 | — | 0.033 | 0.367 | 0.467 *3 | 0.200 | — | — | — | 0.033 | 1.100 |
| 3.25 | 1.100 | 4.333 | 4.733 | 1.733 | 0.067 | — | — | — | — | 12.133 |
| 3.75 | 3.393 | 5.233 | 3.067 | 1.000 | — | — | — | — | — | 14.533 |
| 4.25 | 5.367 | 5.100 | 1.867 | 0.233 | — | — | — | — | — | 16.300 |
| 4.75 | 7.933 *1 | 7.133 | 0.967 | 0.033 | 0.033 | — | — | — | — | 26.067 |
| 5.25 | 3.233 | 1.633 | 0.200 | 0.067 | — | — | — | — | — | 12.933 |
| 5.75 | 1.367 | 0.300 | 0.067 | 0.067 | — | — | — | — | — | 7.733 |
| 6.25 | 0.600 | 0.067 | — | — | — | — | — | — | — | 6.267 |
| 6.75 | 0.100 | 0.100 | — | — | — | — | — | — | — | 1.833 |
| 7.25 | 0.067 | — | — | — | — | — | — | — | — | 0.333 |
| 7.75 | — | — | — | — | — | — | — | — | — | 0.200 |
| 8.25 | 0.033 | — | — | — | — | — | — | — | — | 0.067 |
| 8.75 | — | — | — | — | — | — | — | — | — | — |
| 9.25 | — | — | — | — | — | — | — | — | — | — |
| 9.75 | — | — | — | — | — | — | — | — | — | — |

*1: A1, B1
*2: A2, B2
*3: A3, B3

As can be seen in Table 3-4, the particle size divisional value A1 [μm] and the charged amount divisional value B1 [fC] in the division where there is the largest number proportion of the toner particles, the particle size divisional value A3 [μm] where the particulate toner has the greatest particle size in the particle size distribution indicating that the number proportion of the toner particles is 1% or more and the charged amount divisional value B3 [fC] where there is the largest number proportion of the toner particles when the particle size division is A3 defined above were 4.75, −1.75, 6.75 and −2.75, respectively, and (B3−B1)/(A3−A1) is −0.5, demonstrating that the aforementioned formulas 1 and 2 are satisfied (see Table 3-7).

Further, the particle size divisional value A2 [μm] where the particulate toner has the smallest particle size in the particle size distribution indicating that the number proportion of the toner particles is 1% or more and the charged amount divisional value B2 [fC] where there is the largest number proportion of the toner particles when the particle size division is A2 defined above were 2.75 and −0.25, respectively, and the relationship between A1 and B1 (B2−B1)/(A2−A1) was 0.75, demonstrating that the aforementioned formula 12 is not satisfied (see Table 3-7).

Under these conditions, image formation was effected. The resulting printed matter was then evaluated for white blanks, fogging and edge effect. The results of evaluation are set forth in Table 3-8 below. Under the conditions of Example 3-4, no white blanks were observed and no fogging occurred. However, the density was higher at the edge than at the center, demonstrating that some effect due to edge effect was developed.

Comparative Example 3-1

To the toner mother particles 3-B were then added 0.7% of a large particle size silica (Type RX50; produced by NIPPON AEROSIL CO., LTD.), 1.0 wt % of a small particle size silica (Type RX200; produced by NIPPON AEROSIL CO., LTD.) and 1.0 wt % of titanium (STT-30S, produced by TITAN KOGYO KABUSHIKI KAISHA). The mixture was then processed at a rotary speed of 2,000 rpm for 2 minutes using a small-sized stirrer to produce a toner.

The toner thus obtained was then negatively charged in a non-contact process development device similar to that of FIG. 2. The regulating pressure of the regulating blade was 34 gf/cm and the amount of the toner to be conveyed was 0.350 mg/cm$^2$.

About 3,000 particles of the toner thus charged were then measured for particle size and charged amount. The measurements are set forth in Table 3-5.

TABLE 3-5

| | Charged amount [fC] | | | | | | | | | | |
|---|---|---|---|---|---|---|---|---|---|---|---|
| Particle size [μm] | 0 | −6.75 | −6.25 | −5.75 | −5.25 | −4.75 | −4.25 | −3.75 | −3.25 | −2.75 | −2.25 |
| 0.25 | — | — | — | — | — | — | — | — | — | — | — |
| 0.75 | — | — | — | — | — | — | — | — | — | — | — |
| 1.25 | — | — | — | — | — | — | — | — | — | — | — |
| 1.75 | — | — | — | — | — | — | — | — | — | — | — |
| 2.25 | — | — | — | — | — | — | — | — | — | — | — |
| 2.75 | — | — | — | — | — | — | — | — | — | — | — |
| 3.25 | — | — | — | — | — | — | — | — | — | — | — |
| 3.75 | — | — | — | — | — | — | — | — | — | — | 0.100 |
| 4.25 | — | — | — | — | — | — | — | 0.033 | 0.067 | 0.233 | 0.633 |
| 4.75 | — | — | 0.100 | 0.033 | 0.033 | 0.067 | 0.133 | 0.200 | 0.200 | 1.033 | 2.600 |
| 5.25 | 0.033 | 0.033 | 0.033 | 0.067 | 0.033 | 0.067 | 0.233 | 0.333 | 0.333 | 0.533 | 1.467 |
| 5.75 | — | 0.033 | 0.033 | — | — | 0.033 | 0.100 | 0.167 | 0.233 | 0.433 | 0.467 |
| 6.25 | — | — | — | — | 0.067 | 0.033 | 0.067 | 0.233 | 0.300 *2 | 0.167 | 0.133 |
| 6.75 | — | 0.033 | — | — | — | 0.067 | 0.033 | 0.067 | — | — | 0.033 |
| 7.25 | — | — | — | — | — | — | — | — | — | 0.033 | — |
| 7.75 | — | — | — | — | — | — | — | — | — | — | — |
| 8.25 | — | — | — | — | — | — | — | — | — | — | — |
| 8.75 | — | — | — | — | — | — | — | — | — | — | — |
| 9.25 | — | — | — | — | — | — | — | — | — | — | — |
| 9.75 | — | — | — | — | — | — | — | — | — | — | — |

| | Charged amount [fC] | | | | | | | | | |
|---|---|---|---|---|---|---|---|---|---|---|
| Particle size [μm] | −1.75 | −1.25 | −0.75 | −0.25 | 0.25 | 0.75 | 1.25 | 1.75 | 2.25 | |
| 0.25 | — | — | — | — | — | — | — | — | — | — |
| 0.75 | — | — | — | — | — | — | — | — | — | — |
| 1.25 | — | — | — | — | 0.033 | — | — | — | — | 0.033 |
| 1.75 | — | — | — | — | — | — | — | — | — | — |
| 2.25 | — | — | — | 0.600 | — | — | — | — | — | 0.600 |
| 2.75 | — | — | 0.333 | 1.933 *3 | — | — | — | — | — | 2.267 |
| 3.25 | 0.067 | 0.467 | 12.400 | 4.267 | — | 0.033 | — | — | — | 17.233 |
| 3.75 | 0.633 | 4.367 | 12.167 | 1.333 | 0.033 | — | — | — | — | 18.633 |
| 4.25 | 2.033 | 9.167 | 8.300 | 1.000 | 0.033 | — | — | — | — | 21.500 |
| 4.75 | 5.667 | 13.533 *1 | 3.667 | 0.700 | 0.033 | — | — | — | — | 28.000 |
| 5.25 | 2.133 | 1.967 | 0.500 | 0.067 | — | — | — | — | — | 7.833 |
| 5.75 | 0.433 | 0.200 | 0.067 | — | — | — | — | — | — | 2.200 |
| 6.25 | 0.067 | 0.100 | 0.033 | 0.033 | — | — | — | — | — | 1.233 |
| 6.75 | 0.067 | 0.033 | — | — | — | — | — | — | — | 0.333 |
| 7.25 | — | — | — | — | — | — | — | — | — | 0.033 |

TABLE 3-5-continued

| | | | | | | | | | | |
|---|---|---|---|---|---|---|---|---|---|---|
| 7.75 | — | — | — | — | — | — | — | — | — | — |
| 8.25 | — | — | — | — | — | — | — | — | — | — |
| 8.75 | — | — | — | — | — | — | — | — | — | — |
| 9.25 | — | — | — | — | — | — | — | — | — | — |
| 9.75 | — | — | — | — | — | — | — | — | — | — |

*1: A1, B1
*2: A2, B2
*3: A3, B3

As can be seen in Table 3-5, the particle size divisional value A1 [μm] and the charged amount divisional value B1 [fC] in the division where there is the largest number proportion of the toner particles, the particle size divisional value A3 [μm] where the particulate toner has the greatest particle size in the particle size distribution indicating that the number proportion of the toner particles is 1% or more and the charged amount divisional value B3 [fC] where there is the largest number proportion of the toner particles when the particle size division is A3 defined above were 4.75, −1.25, 6.25 and −3.25, respectively, and (B3−B1)/(A3−A1) is −1.33, demonstrating that the aforementioned formula 10 is not satisfied (see Table 3-7).

Further, the particle size divisional value A2 [μm] where the particulate toner has the smallest particle size in the particle size distribution indicating that the number proportion of the toner particles is 1% or more and the charged amount divisional value B2 [fC] where there is the largest number proportion of the toner particles when the particle size division is A2 defined above were 2.75 and −0.25, respectively, and the relationship between A1 and B1 (B2−B1)/(A2−A1) was −0.5, demonstrating that the aforementioned formula 12 is satisfied (see Table 3-7).

Under these conditions, image formation was effected. The resulting printed matter was then evaluated for white blanks, fogging and edge effect. The results of evaluation are set forth in Table 3-8 below. Under the conditions of Comparative Example 3-1, white blanks were observed, but no fogging and edge effect were developed.

Comparative Example 3-2

To the toner mother particles 3-A were then added 0.3 wt % of a large particle size silica (Type RX50; produced by NIPPON AEROSIL CO., LTD.), 0.3 wt % of a small particle size silica (Type RX200; produced by NIPPON AEROSIL CO., LTD.) and 0.5 wt % of titanium (STT-30S, produced by TITAN KOGYO KABUSHIKI KAISHA). The mixture was then processed at a rotary speed of 2,000 rpm for 2 minutes using a small-sized stirrer to produce a-toner.

The toner thus obtained was then negatively charged in a non-contact process development device similar to that of FIG. 2. The regulating pressure of the regulating blade was 34 gf/cm and the amount of the toner to be conveyed was 0.352 mg/cm$^2$.

About 3,000 particles of the toner thus charged were then measured for particle size and charged amount. The measurements are set forth in Table 3-6.

TABLE 3-6

| | Charged amount [fC] | | | | | | | | | | |
|---|---|---|---|---|---|---|---|---|---|---|---|
| Particle size [μm] | −7.25 | −6.75 | −6.25 | −5.75 | −5.25 | −4.75 | −4.25 | −3.75 | −3.25 | −2.75 | −2.25 |
| 0.25 | — | — | — | — | — | — | — | — | — | — | — |
| 0.75 | — | — | — | — | — | — | — | — | — | — | — |
| 1.25 | — | — | — | — | — | — | — | — | — | — | — |
| 1.75 | — | — | — | — | — | — | — | — | — | — | — |
| 2.25 | — | — | — | — | — | — | — | — | — | — | — |
| 2.75 | — | — | — | — | — | — | — | — | — | — | — |
| 3.25 | — | — | — | — | — | — | — | — | — | — | — |
| 3.75 | — | — | — | — | — | — | — | — | — | — | 0.033 |
| 4.25 | — | — | — | — | — | — | — | — | 0.033 | 0.067 | — |
| 4.75 | — | — | — | — | — | — | 0.067 | 0.033 | 0.067 | 0.100 | 0.667 |
| 5.25 | — | — | — | — | — | — | — | 0.067 | 0.100 | 0.233 | 0.633 |
| 5.75 | — | — | — | — | — | 0.033 | — | 0.200 | 0.200 | 0.367 | 1.333 |
| 6.25 | — | — | — | — | 0.067 | 0.067 | 0.233 | 0.333 | 0.300 | 1.167 | 1.067 |
| 6.75 | — | — | 0.067 | 0.067 | 0.033 | 0.100 | 0.033 | 0.133 | 0.167 | 0.067 | 0.200 |
| 7.25 | — | — | 0.033 | 0.067 | — | 0.033 | 0.033 | — | 0.033 | 0.033 | 0.033 |
| 7.75 | — | — | — | 0.033 | 0.033 | 0.033 | 0.100 | — | — | — | — |
| 8.25 | — | — | — | — | — | — | — | — | — | — | — |
| 8.75 | — | — | — | — | — | — | — | — | — | — | 0.067 |
| 9.25 | — | — | — | — | — | — | — | — | — | — | — |
| 9.75 | — | — | — | — | — | 0.033 | — | — | — | — | — |

| | Charged amount [fC] | | | | | | | | | |
|---|---|---|---|---|---|---|---|---|---|---|
| Particle size [μm] | −1.75 | −1.25 | −0.75 | −0.25 | 0.25 | 0.75 | 1.25 | 1.75 | 2.25 | |
| 0.25 | — | — | — | — | — | — | — | — | — | — |
| 0.75 | — | — | — | — | — | — | — | — | — | — |
| 1.25 | — | — | — | — | 0.033 | — | — | — | — | 0.033 |

TABLE 3-6-continued

| | | | | | | | | | | |
|---|---|---|---|---|---|---|---|---|---|---|
| 1.75 | — | — | — | — | — | — | — | — | — | — |
| 2.25 | — | 0.033 | 0.367 | 0.100 | 0.033 | — | — | — | — | 0.533 |
| 2.75 | 0.033 | 0.100 | 0.367 | 0.167 | — | — | — | — | — | 0.667 |
| 3.25 | 0.033 | 0.700 | 2.733 | 0.933 | 0.100 | — | — | — | — | 4.500 |
| | | | *3 | | | | | | | |
| 3.75 | 0.167 | 2.800 | 2.633 | 0.833 | 0.167 | — | — | — | 0.033 | 6.667 |
| 4.25 | 0.967 | 3.933 | 2.833 | 1.167 | 0.400 | — | — | — | — | 9.400 |
| 4.75 | 3.267 | 5.900 | 5.100 | 3.867 | 0.867 | 0.100 | 0.033 | — | — | 20.067 |
| | | *1 | | | | | | | | |
| 5.25 | 2.967 | 3.333 | 3.933 | 3.133 | 0.967 | 0.100 | 0.033 | — | — | 15.500 |
| 5.75 | 1.333 | 2.400 | 3.933 | 2.900 | 0.633 | — | — | — | — | 13.333 |
| 6.25 | 1.167 | 2.633 | 4.900 | 4.133 | 0.700 | 0.167 | — | — | — | 16.933 |
| 6.75 | 0.367 | 1.367 | 2.333 | 3.200 | 0.900 | 0.167 | — | — | — | 9.200 |
| 7.25 | 0.033 | 0.067 | 0.333 | 0.600 | 0.400 | 0.067 | — | 0.033 | — | 1.800 |
| 7.75 | — | 0.067 | 0.067 | 0.267 | 0.367 | 0.067 | — | — | — | 1.033 |
| | | | | | *2 | | | | | |
| 8.25 | — | — | — | — | — | — | — | — | — | — |
| 8.75 | — | 0.033 | 0.033 | 0.033 | 0.067 | — | — | — | — | 0.233 |
| 9.25 | — | — | — | — | — | — | — | — | — | — |
| 9.75 | — | — | — | — | — | — | — | — | — | 0.033 |

*1: A1, B1
*2: A2, B2
*3: A3, B3

As can be seen in Table 3-6, the particle size divisional value A1 [μm] and the charged amount divisional value B1 [fC] in the division where there is the largest number proportion of the toner particles, the particle size divisional value A3 [μm] where the particulate toner has the greatest particle size in the particle size distribution indicating that the number proportion of the toner particles is 1% or more and the charged amount divisional value B3 [fC] where there is the largest number proportion of the toner particles when the particle size division is A3 defined above were 4.75, −1.25, 7.75 and 0.25, respectively, and (B3−B1)/(A3−A1) is 0.5, demonstrating that the aforementioned formula 10 is satisfied but the aforementioned formula 11 is not satisfied (see Table 3-7).

Further, the particle size divisional value A2 [μm] where the particulate toner has the smallest particle size in the particle size distribution indicating that the number proportion of the toner particles is 1% or more and the charged amount divisional value B2 [fC] where there is the largest number proportion of the toner particles when the particle size division is A2 defined above were 3.25 and −0.75, respectively, and the relationship between A1 and B1 (B2−B1)/(A2−A1) was −0.33, demonstrating that the aforementioned formula 12 is satisfied (see Table 3-7).

Under these conditions, image formation was effected. The resulting printed matter was then evaluated for white blanks, fogging and edge effect. The results of evaluation are set forth in Table 3-8 below. Under the conditions of Comparative Example 3-2, no white blanks were observed and no edge effect was recognized, but much fogging occurred.

TABLE 3-8

| | Resistance to white blanks | Resistance to fogging | Resistance to edge effect (OD value difference) |
|---|---|---|---|
| Example 3-1 | Good | Good | Good (0.06) |
| Example 3-2 | Good | Good | Good (0.03) |
| Example 3-3 | Good | Good | Good (0.03) |
| Example 3-4 | Good | Good | Poor (0.12) |
| Comparative Example 3-1 | Poor | Good | Good (0.08) |
| Comparative Example 3-2 | Good | Poor | Good (0.07) |

Production of Toner Mother Particles 4-A

A monomer mixture comprising 80 parts by weight of a styrene monomer, 20 parts by weight of butyl acrylate and 5 parts by weight of acrylic acid was added to a water-soluble mixture comprising 105 parts by weight of water, 1 part by weight of a nonionic emulsifier, 1.5 parts by weight of an anionic emulsifier and 0.55 parts by weight of potassium persulfate to obtain a lacteous resin emulsion having a particle size of 0.25 μm.

Subsequently, 200 parts by weight of the resin emulsion thus obtained, 20 parts by weight of a polyethylene wax emulsion (produced by Sanyo Chemical Industries, Ltd.) and 7 parts by weight of a phthalocyanine blue were dispersed in water containing 0.2 parts by weight of sodium dodecylbenzenesulfonate as a surface active agent. To the mixture was then added diethylamine to adjust the pH value

TABLE 3-7

| | A1 | B1 | A3 | B3 | A2 | B2 | (B3 − B1)/(A3 − A1) | (B2 − B1)/(A2 − A1) |
|---|---|---|---|---|---|---|---|---|
| Example 3-1 | 4.75 | −0.75 | 6.75 | −1.25 | 3.25 | −0.75 | −0.25 | 0 |
| Example 3-2 | 4.75 | −0.75 | 7.25 | −0.25 | 3.25 | −1.25 | 0.2 | 0.33 |
| Example 3-3 | 3.25 | −0.25 | 5.75 | −2.25 | 2.75 | −0.75 | −0.8 | 1 |
| Example 3-4 | 4.75 | −1.75 | 6.75 | −2.75 | 2.75 | −0.25 | −0.5 | −0.75 |
| Comparative Example 3-1 | 4.75 | −1.25 | 6.25 | −3.25 | 2.75 | −0.25 | −1.33 | −0.5 |
| Comparative Example 3-2 | 4.75 | −1.25 | 7.75 | 0.25 | 3.25 | −0.75 | 0.5 | −0.33 |

thereof to 5.5. To the mixture was then added 0.3 parts by weight of aluminum sulfate as an electrolyte with stirring. Subsequently, the mixture was subjected to high speed stirring using a TK homomixer to undergo dispersion. To the mixture were then added 40 parts by weight of a styrene monomer, 10 parts by weight of butyl acrylate and 5 parts by weight of zinc salicylate together with 40 parts by weight of water. The mixture was then heated to 90° C. with stirring in a nitrogen stream. To the mixture was then added aqueous hydrogen peroxide. The mixture was then allowed to undergo polymerization for 5 hours to cause the growth of particles. After the termination of polymerization, with the pH value being adjusted to not lower than 5, the mixture was then heated to 95° C. where it was then allowed to stand for 5 hours to enhance the bonding strength of associated particles. Thereafter, the particulate material thus obtained was washed with water, and then vacuum-dried at 45° C. for 10 hours.

Production of Toner Mother Particles 4-B

A monomer mixture comprising 80 parts by weight of a styrene monomer, 20 parts by weight of butyl acrylate and 5 parts by weight of acrylic acid was added to a water-soluble mixture comprising 105 parts by weight of water, 1 part by weight of a nonionic emulsifier, 1.5 parts by weight of an anionic emulsifier and 0.55 parts by weight of potassium persulfate to obtain a lacteous resin emulsion having a particle size of 0.25 μm.

Subsequently, 200 parts by weight of the resin emulsion thus obtained, 20 parts by weight of a polyethylene wax emulsion (produced by Sanyo Chemical Industries, Ltd.) and 10 parts by weight of a phthalocyanine blue were dispersed in water containing 0.2 parts by weight of sodium dodecylbenzenesulfonate as a surface active agent. To the mixture was then added diethylamine to adjust the pH value thereof to 5.5. To the mixture was then added 0.3 parts by weight of aluminum sulfate as an electrolyte with stirring. Subsequently, the mixture was subjected to high speed stirring using a TK homomixer to undergo dispersion. To the mixture were then added 40 parts by weight of a styrene monomer, 10 parts by weight of butyl acrylate and 5 parts by weight of zinc salicylate together with 40 parts by weight of water. The mixture was then heated to 90° C. with stirring in a nitrogen stream. To the mixture was then added aqueous hydrogen peroxide. The mixture was then allowed to undergo polymerization for 3 hours to cause the growth of particles. After the termination of polymerization, with the pH value being adjusted to not lower than 5, the mixture was then heated to 95° C. where it was then allowed to stand for 5 hours to enhance the bonding strength of associated particles. Thereafter, the particulate material thus obtained was washed with water, and then vacuum-dried at 45° C. for 10 hours.

Experimental Example 4-1

To the toner mother particles 4-A were then added 0.8 wt % of a large particle size silica (Type RX50; produced by NIPPON AEROSIL CO., LTD.), 0.8 wt % of a small particle size silica (Type RX200; produced by NIPPON AEROSIL CO., LTD.) and 0.2 wt % of titanium (STT-30S, produced by TITAN KOGYO KABUSHIKI KAISHA). The mixture was then processed at a rotary speed of 2,000 rpm for 2 minutes using a small-sized stirrer to produce a toner.

Figure 23:
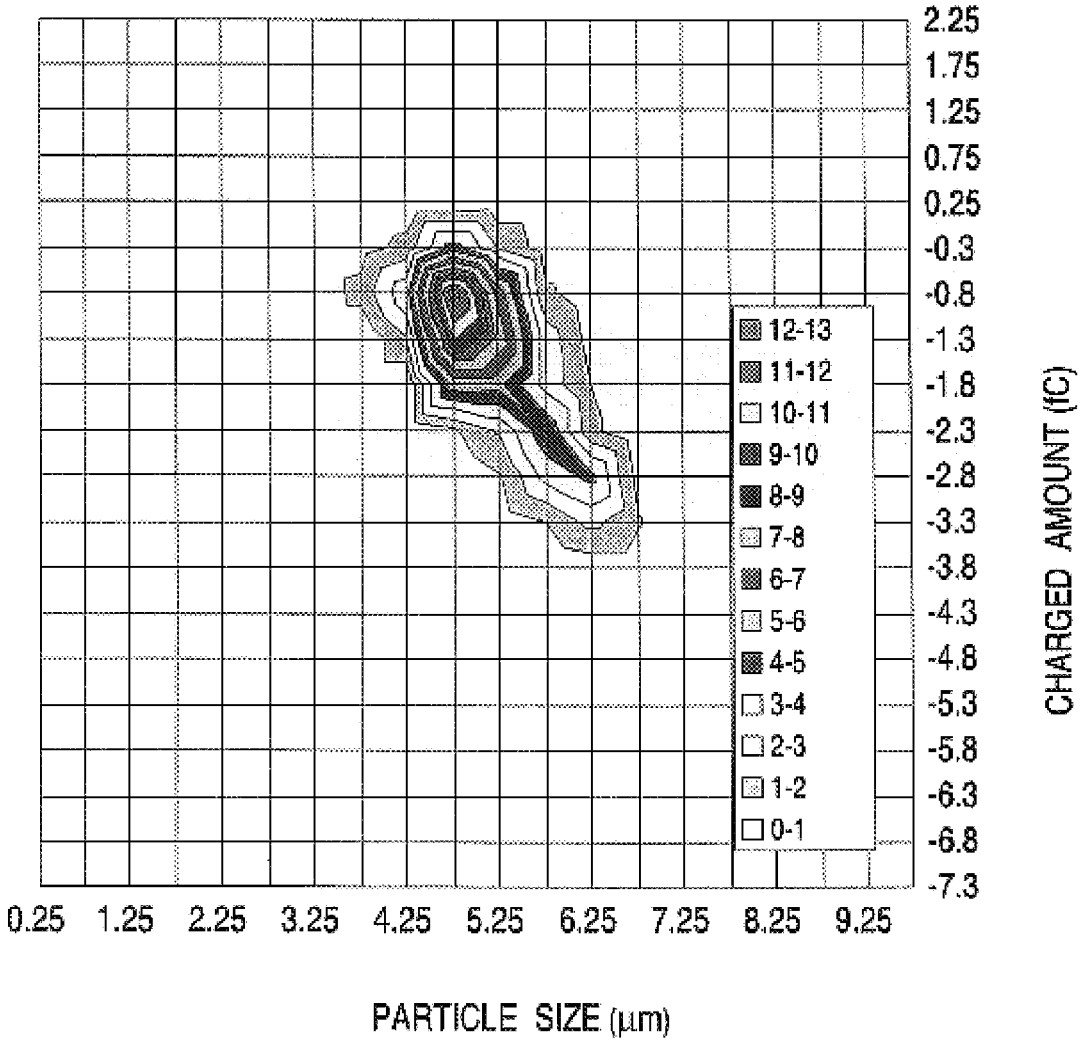
FIG. 23 is a drawing illustrating the particle size-charged amount distribution of Experimental Example 4-1.

The toner thus obtained was then negatively charged in a non-contact process development device similar to that of FIG. 2. The regulating pressure of the regulating blade was 35 gf/cm and the amount of the toner to be conveyed was 0.361 mg/cm$^2$. About 3,000 particles of the toner thus charged were then measured for particle size and charged amount. The measurements are set forth in Table 4-1 and a three-dimensional graph corresponding to these data is shown in FIG. 23.

TABLE 4-1

| | Charged amount [fC] | | | | | | | | | | |
|---|---|---|---|---|---|---|---|---|---|---|---|
| Particle size [μm] | −7.25 | −6.75 | −6.25 | −5.75 | −5.25 | −4.75 | −4.25 | −3.75 | −3.25 | −2.75 | −2.25 |
| 0.25 | — | — | — | — | — | — | — | — | — | — | — |
| 0.75 | — | — | — | — | — | — | — | — | — | — | — |
| 1.25 | — | — | — | — | — | — | — | — | — | — | — |
| 1.75 | — | — | — | — | — | — | — | — | — | — | — |
| 2.25 | — | — | — | — | — | — | — | — | — | — | — |
| 2.75 | — | — | — | — | — | — | — | — | — | — | — |
| 3.25 | — | — | — | — | — | — | — | — | — | — | — |
| 3.75 | — | — | — | — | — | — | — | — | — | — | — |
| 4.25 | — | — | — | — | — | — | — | — | — | — | — |
| 4.75 | — | — | — | — | — | — | — | — | — | 0.100 | 0.833 |
| 5.25 | — | — | — | — | — | — | — | 0.067 | 0.200 | 0.933 | 2.100 |
| 5.75 | — | — | — | — | — | — | — | 0.100 | 1.000 | 3.333 | 4.833 |
| 6.25 | — | — | — | — | — | 0.033 | 0.100 | 0.400 | 2.300 | 4.300 | 1.267 |
| 6.75 | — | — | — | — | — | — | 0.167 | 0.467 | 1.100 *2 | 0.533 | 0.100 |
| 7.25 | — | — | — | — | — | — | — | — | 0.033 | 0.067 | 0.133 |
| 7.75 | — | — | — | — | — | — | 0.033 | — | 0.067 | 0.033 | 0.100 |
| 8.25 | — | — | — | — | — | — | — | — | — | — | — |
| 8.75 | — | — | — | — | — | — | — | — | — | — | — |
| 9.25 | — | — | — | — | — | — | — | — | — | — | — |
| 9.75 | — | — | — | — | — | — | — | — | — | — | — |

| | Charged amount [fC] | | | | | | | | | |
|---|---|---|---|---|---|---|---|---|---|---|
| Particle size [μm] | −1.75 | −1.25 | −.075 | −0.25 | 0.25 | 0.75 | 1.25 | 1.75 | 2.25 | |
| 0.25 | — | — | — | — | — | — | — | — | — | — |
| 0.75 | — | — | — | — | — | — | — | — | — | — |
| 1.25 | — | — | — | — | — | — | — | — | — | — |

TABLE 4-1-continued

| | | | | | | | | | | |
|---|---|---|---|---|---|---|---|---|---|---|
| 1.75 | — | — | — | 0.067 | 0.033 | — | — | — | — | 0.100 |
| 2.25 | — | — | — | 0.033 | 0.033 | — | — | — | — | 0.067 |
| 2.75 | — | — | — | 0.033 | — | — | — | — | — | 0.033 |
| 3.25 | — | 0.033 | 0.333 | 0.267 | 0.067 | — | — | — | — | 0.700 |
| 3.75 | — | 0.100 | 1.400 | 0.533 | 0.067 | — | — | — | — | 2.100 |
| 4.25 | 0.133 | 1.933 | 3.867 | 1.367 | 0.100 | — | — | — | — | 7.400 |
| 4.75 | 5.467 | 10.100 | 12.800 *1 | 4.633 | 0.133 | — | — | — | — | 34.067 |
| 5.25 | 5.333 | 7.733 | 6.567 | 2.000 | 0.167 | — | — | — | — | 25.100 |
| 5.75 | 2.567 | 2.567 | 1.200 | 0.433 | 0.167 | — | — | — | — | 16.200 |
| 6.25 | 1.000 | 0.633 | 0.333 | 0.233 | 0.167 | 0.033 | — | — | — | 10.800 |
| 6.75 | 0.100 | 0.100 | 0.033 | 0.067 | — | — | — | — | — | 2.667 |
| 7.25 | 0.067 | 0.033 | 0.033 | — | — | — | — | — | — | 0.367 |
| 7.75 | 0.033 | 0.067 | — | 0.033 | — | — | — | — | — | 0.367 |
| 8.25 | — | — | — | — | — | — | — | — | — | — |
| 8.75 | — | — | — | — | — | — | — | — | — | — |
| 9.25 | — | — | — | — | — | — | — | — | — | — |
| 9.75 | — | — | — | — | — | — | — | — | — | — |

*1: A1, B1
*2: A2, B2

As can be seen in Table 4-1, the particle size divisional value A1 [μm] and the charged amount divisional value B1 [fC] in the division where there is the largest number proportion of the toner particles, the particle size divisional value A2 [μm] where the particulate toner has the greatest particle size in the particle size distribution indicating that the number proportion of the toner particles is 1% or more and the charged amount divisional value B2 [fC] where there is the largest number proportion of the toner particles when the particle size division is A2 defined above were 4.75, −0.75, 6.75 and −3.25, respectively, and (B2−B1)/(A2−A1) is −1.25, demonstrating that the aforementioned formula 13 is satisfied (see Table 4-6).

Under these conditions, image formation was effected. The resulting printed matter was then evaluated for starvation. The results of evaluation are set forth in Table 4-6 below. Under the conditions of Experimental Example 4-1, no starvation was observed. Thus, a high quality halftone image was obtained.

Experimental Example 4-2

To the toner mother particles 4-A were then added 0.8wt % of a large particle size silica (Type RX50; produced by NIPPON AEROSIL CO., LTD.), 0.8 wt % of a small particle size silica (Type RX200; produced by NIPPON AEROSIL CO., LTD.) and 0.3 wt % of titanium (STT-30S, produced by TITAN KOGYO KABUSHIKI KAISHA). The mixture was then processed at a rotary speed of 2,000 rpm for 2 minutes using a small-sized stirrer to produce a toner.

Figure 24:
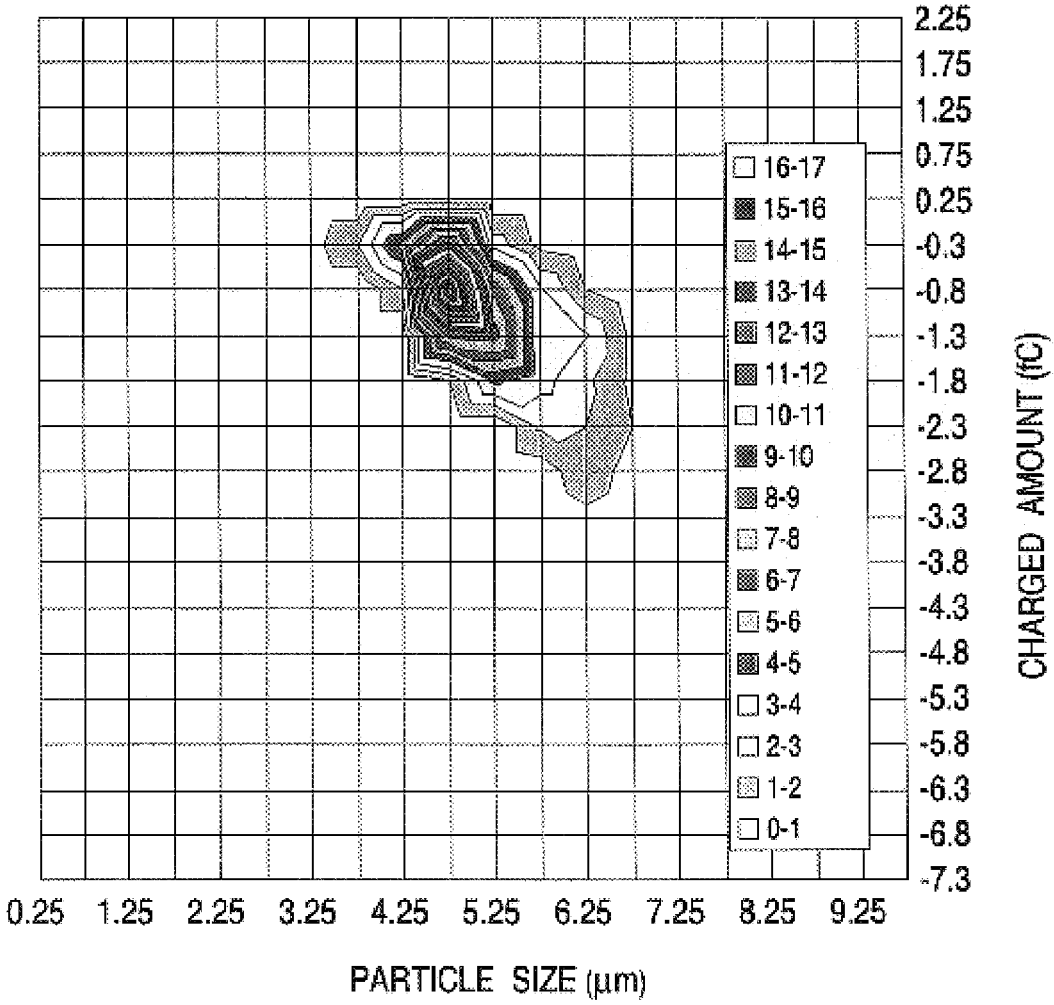
FIG. 24 is a drawing illustrating-the particle size-charged amount distribution of Experimental Example 4-2.

The toner thus obtained was then negatively charged in a non-contact process development device similar to that of FIG. 2. The regulating pressure of the regulating blade was 35 gf/cm and the amount of the toner to be conveyed was 0.359 mg/cm$^2$. About 3,000 particles of the toner thus charged were then measured for particle size and charged amount. The measurements are set forth in Table 4-2 and a three-dimensional graph corresponding to these data is shown in FIG. 24.

TABLE 4-2

| | Charged amount [fC] | | | | | | | | | | |
|---|---|---|---|---|---|---|---|---|---|---|---|
| Particle size [μm] | −7.25 | −6.75 | −6.25 | −5.75 | −5.25 | −4.75 | −4.25 | −3.75 | −3.25 | −2.75 | −2.25 |
| 0.25 | — | — | — | — | — | — | — | — | — | — | — |
| 0.75 | — | — | — | — | — | — | — | — | — | — | — |
| 1.25 | — | — | — | — | — | — | — | — | — | — | — |
| 1.75 | — | — | — | — | — | — | — | — | — | — | — |
| 2.25 | — | — | — | — | — | — | — | — | — | — | — |
| 2.75 | — | — | — | — | — | — | — | — | — | — | — |
| 3.25 | — | — | — | — | — | — | — | — | — | — | — |
| 3.75 | — | — | — | — | — | — | — | — | — | — | — |
| 4.25 | — | — | — | — | — | — | — | — | — | — | — |
| 4.75 | — | — | — | — | — | — | — | — | — | — | — |
| 5.25 | — | — | — | — | — | — | — | — | — | — | 0.067 |
| 5.75 | — | — | — | — | — | — | — | 0.067 | 0.133 | 0.433 | 2.167 |
| 6.25 | — | — | — | — | — | — | 0.133 | 0.200 | 0.700 | 1.700 | 2.000 |
| 6.75 | — | — | 0.033 | 0.033 | 0.100 | 0.100 | 0.167 | 0.100 | 0.300 | 0.500 | 1.000 |
| 7.25 | — | — | — | 0.067 | 0.033 | 0.100 | — | 0.100 | 0.067 | 0.333 | 0.667 *2 |
| 7.75 | — | — | — | 0.033 | — | 0.033 | 0.067 | 0.033 | 0.133 | — | — |
| 8.25 | — | — | 0.067 | 0.033 | — | 0.033 | 0.033 | 0.033 | 0.033 | 0.033 | 0.033 |
| 8.75 | — | — | — | — | — | — | — | — | — | — | — |
| 9.25 | — | — | — | — | — | — | — | — | — | — | — |
| 9.75 | — | — | — | — | — | — | — | — | — | — | — |

TABLE 4-2-continued

| Particle size [μm] | Charged amount [fC] −1.75 | −1.25 | −0.75 | −0.25 | 0.25 | 0.75 | 1.25 | 1.75 | 2.25 | |
|---|---|---|---|---|---|---|---|---|---|---|
| 0.25 | — | — | — | — | — | — | — | — | — | — |
| 0.75 | — | — | — | — | — | — | — | — | — | — |
| 1.25 | — | — | — | — | — | — | — | — | — | — |
| 1.75 | — | — | — | 0.033 | 0.067 | — | — | — | — | 0.100 |
| 2.25 | — | — | — | 0.033 | 0.033 | — | — | — | — | 0.067 |
| 2.75 | — | — | — | — | 0.033 | — | — | — | — | 0.033 |
| 3.25 | — | — | — | 0.633 | 0.067 | — | — | — | — | 0.700 |
| 3.75 | — | — | — | 2.033 | 0.067 | — | — | — | — | 2.100 |
| 4.25 | — | — | 1.900 | 5.400 | 0.100 | — | — | — | — | 7.400 |
| 4.75 | 0.967 | 8.267 | 16.833 *1 | 9.600 | 0.133 | — | — | — | — | 35.800 |
| 5.25 | 4.200 | 8.500 | 6.800 | 2.633 | 0.167 | — | — | — | — | 13.267 |
| 5.75 | 3.367 | 3.133 | 3.133 | 0.733 | 0.100 | — | — | — | — | 11.400 |
| 6.25 | 2.300 | 3.067 | 1.033 | 0.167 | 0.100 | — | — | — | — | 4.633 |
| 6.75 | 0.767 | 0.733 | 0.267 | 0.200 | — | — | — | — | — | 0.333 |
| 7.25 | 0.033 | 0.033 | — | — | — | — | — | — | — | 0.300 |
| 7.75 | — | — | — | 0.033 | — | — | — | — | — | — |
| 8.25 | — | — | — | — | — | — | — | — | — | — |
| 8.75 | — | — | — | — | — | — | — | — | — | — |
| 9.25 | — | — | — | — | — | — | — | — | — | — |
| 9.75 | — | — | — | — | — | — | — | — | — | — |

*1: A1, B1
*2: A2, B2

As can be seen in Table 4-2, the particle size divisional value A1 [μm] and the charged amount divisional value B1 [fC] in the division where there is the largest number proportion of the toner particles, the particle size divisional value A2 [μm] where the particulate toner has the greatest particle size in the particle size distribution indicating that the number proportion of the toner particles is 1% or more and the charged amount divisional value B2 [fC] where there is the largest number proportion of the toner particles when the particle size division is A2 defined above were 4.75, −0.75, 7.25 and −2.25, respectively, and (B2−B1)/(A2−A1) is −0.75, demonstrating that the aforementioned formula 13 is not satisfied (see Table 4-6).

Under these conditions, image formation was effected. The resulting printed matter was then evaluated for starvation. The results of evaluation are set forth in Table 4-6 below. Under the conditions of Experimental Example 4-2, starvation occurred, deteriorating the quality of the halftone image.

Experimental Example 4-3

To the toner mother particles 4-A were then added 0.8 wt % of a large particle size silica (Type RX50; produced by NIPPON AEROSIL CO., LTD.), 0.8 wt % of a small particle size silica (Type RX200; produced by NIPPON AEROSIL CO., LTD.) and 0.4 wt % of titanium (STT-30S, produced by TITAN KOGYO KABUSHIKI KAISHA). The mixture was then processed at a rotary speed of 2,000 rpm for 2 minutes using a small-sized stirrer to produce a toner.

Figure 25:
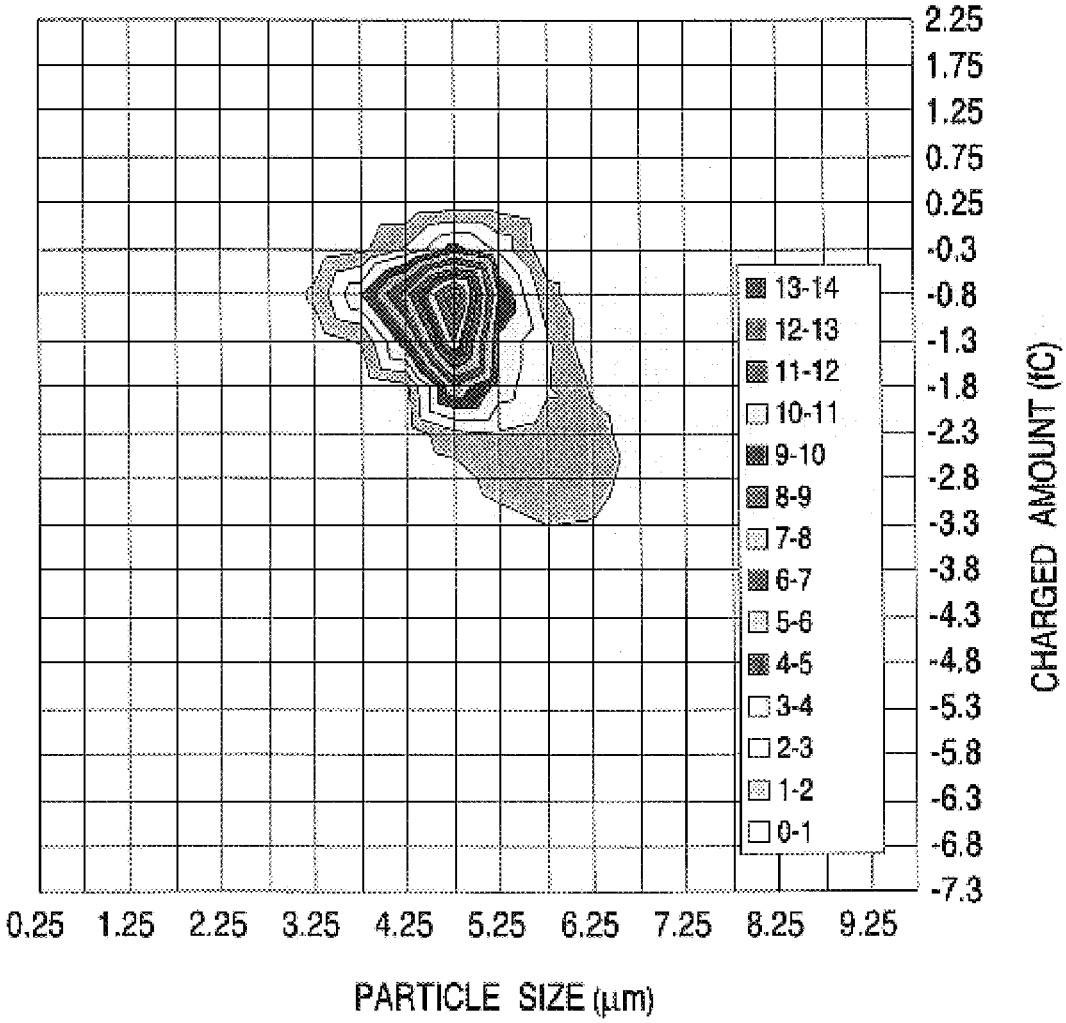
FIG. 25 is a drawing illustrating the particle size-charged amount distribution of Experimental Example 4-3.

The toner thus obtained was then negatively charged in a non-contact process development device similar to that of FIG. 2. The regulating pressure of the regulating blade was 35 gf/cm and the amount of the toner to be conveyed was 0.351 mg/cm$^2$. About 3,000 particles of the toner thus charged were then measured for particle size and charged amount. The measurements are set forth in Table 4-3 and a three-dimensional graph corresponding to these data is shown in FIG. 25.

TABLE 4-3

| Particle size [μm] | Charged amount [fC] −7.25 | −6.75 | −6.25 | −5.75 | −5.25 | −4.75 | −4.25 | −3.75 | −3.25 | −2.75 | −2.25 |
|---|---|---|---|---|---|---|---|---|---|---|---|
| 0.25 | — | — | — | — | — | — | — | — | — | — | — |
| 0.75 | — | — | — | — | — | — | — | — | — | — | — |
| 1.25 | — | — | — | — | — | — | — | — | — | — | — |
| 1.75 | — | — | — | — | — | — | — | — | — | — | — |
| 2.25 | — | — | — | — | — | — | — | — | — | — | — |
| 2.75 | — | — | — | — | — | — | — | — | — | — | — |
| 3.25 | — | — | — | — | — | — | — | — | — | — | — |
| 3.75 | — | — | — | — | — | — | — | — | — | 0.033 | — |
| 4.25 | — | — | — | — | — | — | — | — | — | — | 0.300 |
| 4.75 | — | — | — | — | — | — | — | 0.033 | 0.100 | 0.467 | 1.767 |
| 5.25 | — | — | — | — | — | — | 0.067 | 0.133 | 0.500 | 1.533 | 1.967 |
| 5.75 | — | — | — | 0.033 | — | 0.100 | 0.100 | 0.400 | 1.000 | 1.633 | 1.600 |
| 6.25 | — | 0.033 | — | 0.067 | 0.167 | 0.567 | 0.633 | 0.733 | 0.933 | 1.433 | 1.567 |
| 6.75 | — | — | — | — | 0.067 | 0.033 | 0.067 | 0.067 | 0.267 | 0.567 *1 | 0.100 |
| 7.25 | — | — | — | — | — | — | — | — | — | — | — |

TABLE 4-3-continued

| | | | | | | | | | | | |
|---|---|---|---|---|---|---|---|---|---|---|---|
| 7.75 | — | — | — | — | — | — | — | — | — | — | — |
| 8.25 | — | — | — | — | — | — | — | — | — | — | — |
| 8.75 | — | — | — | — | — | — | — | — | — | — | — |
| 9.25 | — | — | — | — | — | — | — | — | — | — | — |
| 9.75 | — | — | — | — | — | — | — | — | — | — | — |

| | Charged amount [fC] | | | | | | | | | |
|---|---|---|---|---|---|---|---|---|---|---|
| Particle size [μm] | −1.75 | −1.25 | −0.75 | −0.25 | 0.25 | 0.75 | 1.25 | 1.75 | 2.25 | |
| 0.25 | — | — | — | — | — | — | — | — | — | — |
| 0.75 | — | — | — | — | — | — | — | — | — | — |
| 1.25 | — | — | 0.033 | — | — | — | — | — | — | 0.033 |
| 1.75 | — | — | — | — | — | — | — | — | — | — |
| 2.25 | — | — | 0.167 | 0.067 | — | — | — | — | — | 0.233 |
| 2.75 | — | — | 0.267 | 0.133 | — | — | — | — | — | 0.400 |
| 3.25 | 0.033 | 0.300 | 1.167 | 0.300 | 0.033 | — | — | — | — | 1.833 |
| 3.75 | 0.133 | 1.067 | 3.933 | 0.700 | — | — | — | — | — | 5.867 |
| 4.25 | 0.733 | 4.667 | 7.600 | 2.167 | — | — | — | — | — | 15.467 |
| 4.75 | 5.867 | 11.067 | 13.167 *2 | 4.367 | 0.033 | 0.033 | — | — | — | 37.200 |
| 5.25 | 3.500 | 3.833 | 5.000 | 2.800 | 0.500 | — | — | — | — | 19.833 |
| 5.75 | 2.133 | 2.167 | 1.333 | 0.200 | — | — | — | — | — | 10.700 |
| 6.25 | 0.800 | 0.067 | — | — | — | — | — | — | — | 7.000 |
| 6.75 | — | — | — | — | — | — | — | — | — | 1.167 |
| 7.25 | — | — | — | — | — | 0.033 | — | — | — | 0.033 |
| 7.75 | — | — | — | — | — | 0.033 | — | — | — | 0.033 |
| 8.25 | — | — | — | — | — | — | — | — | — | — |
| 8.75 | — | — | — | — | — | — | — | — | — | — |
| 9.25 | — | — | — | — | — | — | — | — | — | — |
| 9.75 | — | — | — | — | — | — | — | — | — | — |

*1: A1, B1
*2: A2, B2

As can be seen in Table 4-3, the particle size divisional value A1 [μm] and the charged amount divisional value B1 [fC] in the division where there is the largest number proportion of the toner particles, the particle size divisional value A2 [μm] where the particulate toner has the greatest particle size in the particle size distribution indicating that the number proportion of the toner particles is 1% or more and the charged amount divisional value B2 [fC] where there is the largest number proportion of the toner particles when the particle size division is A2 defined above were 4.75, −0.75, 6.75 and −2.75, respectively, and (B2−B1)/(A2−A1) is −1.0, demonstrating that the aforementioned formula 13 is not satisfied (see Table 4-6).

Under these conditions, image formation was effected. The resulting printed matter was then evaluated for starvation. The results of evaluation are set forth in Table 4-6 below. Under the conditions of Experimental Example 4-3, starvation occurred, deteriorating the quality of the halftone image.

Experimental Example 4-4

To the toner mother particles 4-B were then added 1.0 wt % of a large particle size silica (Type RX50; produced by NIPPON AEROSIL CO., LTD.), 1.0 wt % of a small particle size silica (Type RX200; produced by NIPPON AEROSIL CO., LTD.) and 0.3 wt % of titanium (STT-30S, produced by TITAN KOGYO KABUSHIKI KAISHA). The mixture was then processed at a rotary speed of 2,000 rpm for 2 minutes using a small-sized stirrer to produce a toner.

Figure 26:
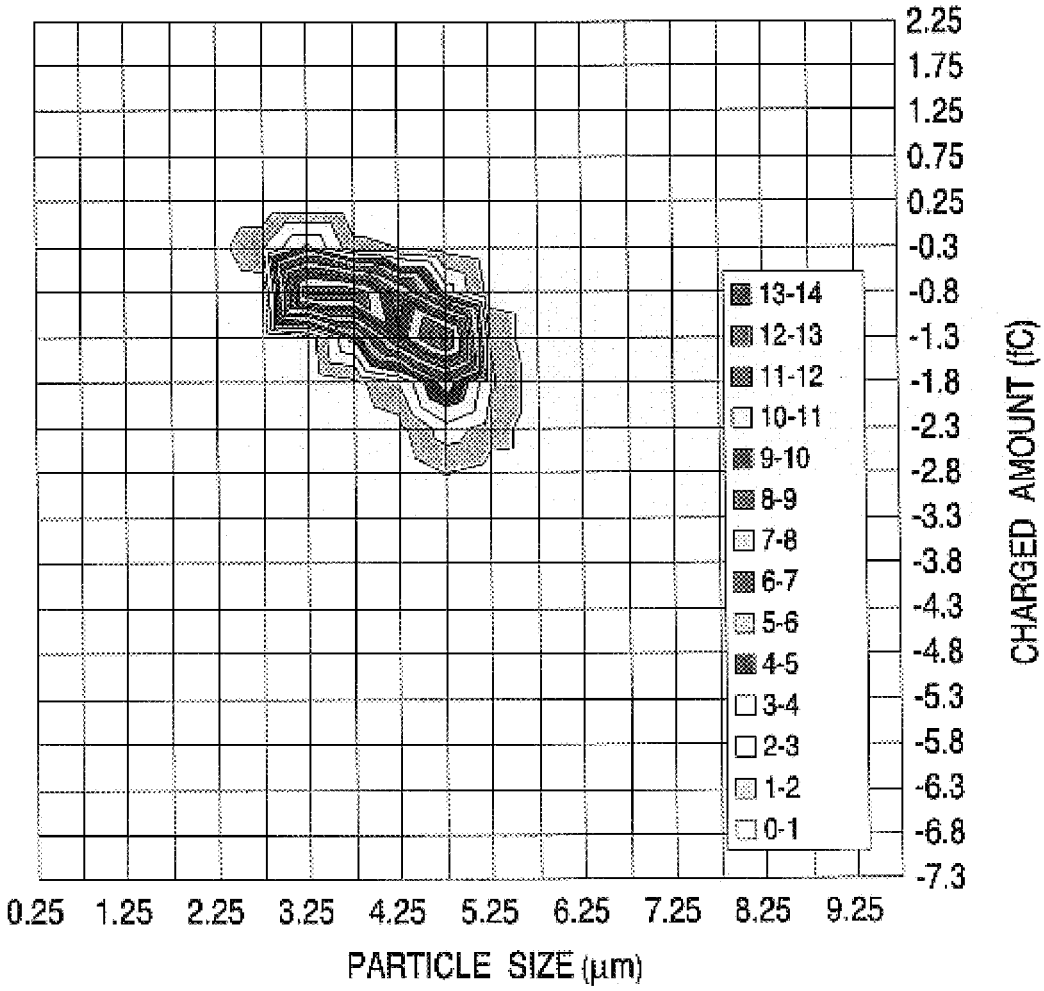
FIG. 26 is a drawing illustrating the particle size-charged amount distribution of Experimental Example 4-4.

The toner thus obtained was then negatively charged in a non-contact process development device similar to that of FIG. 2. The regulating pressure of the regulating blade was 33 gf/cm and the amount of the toner to be conveyed was 0.281 mg/cm$^2$. About 3,000 particles of the toner thus charged were then measured for particle size and charged amount. The measurements are set forth in Table 4-4 and a three-dimensional graph corresponding to these data is shown in FIG. 26.

TABLE 4-4

| | Charged amount [fC] | | | | | | | | | | |
|---|---|---|---|---|---|---|---|---|---|---|---|
| Particle size [μm] | −7.25 | −6.75 | −6.25 | −5.75 | −5.25 | −4.75 | −4.25 | −3.75 | −3.25 | −2.75 | −2.25 |
| 0.25 | — | — | — | — | — | — | — | — | — | — | — |
| 0.75 | — | — | — | — | — | — | — | — | — | — | — |
| 1.25 | — | — | — | — | — | — | — | — | — | — | — |
| 1.75 | — | — | — | — | — | — | — | — | — | — | — |
| 2.25 | — | — | — | — | — | — | — | — | — | — | — |
| 2.75 | — | — | — | — | — | — | — | — | — | — | — |
| 3.25 | — | — | — | — | — | — | — | — | — | — | — |
| 3.75 | — | — | — | — | — | — | — | — | — | — | 0.100 |
| 4.25 | — | — | — | — | — | — | — | 0.033 | 0.067 | 0.233 | 0.633 |
| 4.75 | — | — | 0.100 | 0.033 | 0.033 | 0.067 | 0.133 | 0.200 | 0.200 | 1.033 | 2.600 |

TABLE 4-4-continued

| | | | | | | | | | | | |
|---|---|---|---|---|---|---|---|---|---|---|---|
| 5.25 | 0.033 | 0.033 | 0.033 | 0.067 | 0.033 | 0.067 | 0.233 | 0.333 | 0.333 | 0.533 | 1.467 |
| 5.75 | — | 0.033 | 0.033 | — | — | 0.033 | 0.100 | 0.167 | 0.233 | 0.433 | 0.467 |
| 6.25 | — | — | — | — | 0.067 | 0.033 | 0.067 | 0.233 | 0.300 | 0.167 | 0.133 |
| | | | | | | | | | *1 | | |
| 6.75 | — | 0.033 | — | — | — | 0.067 | 0.033 | 0.067 | — | — | 0.033 |
| 7.25 | — | — | — | — | — | — | — | — | — | 0.033 | — |
| 7.75 | — | — | — | — | — | — | — | — | — | — | — |
| 8.25 | — | — | — | — | — | — | — | — | — | — | — |
| 8.75 | — | — | — | — | — | — | — | — | — | — | — |
| 9.25 | — | — | — | — | — | — | — | — | — | — | — |
| 9.75 | — | — | — | — | — | — | — | — | — | — | — |

| | Charged amount [fC] | | | | | | | | | |
|---|---|---|---|---|---|---|---|---|---|---|
| Particle size [μm] | −1.75 | −1.25 | −0.75 | −0.25 | 0.25 | 0.75 | 1.25 | 1.75 | 2.25 | |
| 0.25 | — | — | — | — | — | — | — | — | — | — |
| 0.75 | — | — | — | — | — | — | — | — | — | — |
| 1.25 | — | — | — | — | 0.033 | — | — | — | — | 0.033 |
| 1.75 | — | — | — | — | — | — | — | — | — | — |
| 2.25 | — | — | — | 0.600 | — | — | — | — | — | 0.600 |
| 2.75 | — | — | 0.333 | 1.933 | — | — | — | — | — | 2.267 |
| 3.25 | 0.067 | 0.467 | 12.400 | 4.267 | — | 0.033 | — | — | — | 17.233 |
| 3.75 | 0.633 | 4.367 | 12.167 | 1.333 | 0.033 | — | — | — | — | 18.633 |
| 4.25 | 2.033 | 9.167 | 8.300 | 1.000 | 0.033 | — | — | — | — | 21.500 |
| 4.75 | 5.667 | 13.533 | 3.667 | 0.700 | 0.033 | — | — | — | — | 28.000 |
| | | *2 | | | | | | | | |
| 5.25 | 2.133 | 1.967 | 0.500 | 0.067 | — | — | — | — | — | 7.833 |
| 5.75 | 0.433 | 0.200 | 0.067 | — | — | — | — | — | — | 2.200 |
| 6.25 | 0.067 | 0.100 | 0.033 | 0.033 | — | — | — | — | — | 1.233 |
| 6.75 | 0.067 | 0.033 | — | — | — | — | — | — | — | 0.333 |
| 7.25 | — | — | — | — | — | — | — | — | — | 0.033 |
| 7.75 | — | — | — | — | — | — | — | — | — | — |
| 8.25 | — | — | — | — | — | — | — | — | — | — |
| 8.75 | — | — | — | — | — | — | — | — | — | — |
| 9.25 | — | — | — | — | — | — | — | — | — | — |
| 9.75 | — | — | — | — | — | — | — | — | — | — |

*1: A1, B1
*2: A2, B2

As can be seen in Table 4-4, the particle size divisional value A1 [μm] and the charged amount divisional value B1 [fC] in the division where there is the largest number proportion of the toner particles, the particle size divisional value A2 [μm] where the particulate toner has the greatest particle size in the particle size distribution indicating that the number proportion of the toner particles is 1% or more and the charged amount divisional value B2 [fC] where there is the largest number proportion of the toner particles when the particle size division is A2 defined above were 4.75, −1.25, 6.25 and −3.25, respectively, and (B2−B1)/(A2−A1) is −1.33, demonstrating that the aforementioned formula 13 is satisfied (see Table 4-6).

Under these conditions, image formation was effected. The resulting printed matter was then evaluated for starvation. The results of evaluation are set forth in Table 4-6 below. Under the conditions of Experimental Example 4-4, no starvation was observed. Thus, a high quality halftone image was obtained.

Experimental Example 4-5

To the toner mother particles 4-B were then added 1.0 wt % of a large particle size silica (Type RX50; produced by NIPPON AEROSIL CO., LTD.), 1.0 wt % of a small particle size silica (Type RX200; produced by NIPPON AEROSIL CO., LTD.) and 0.5 wt % of titanium (STT-30S, produced by TITAN KOGYO KABUSHIKI KAISHA) The mixture was then processed at a rotary speed of 2,000 rpm for 2 minutes using a small-sized stirrer to produce a toner.

Figure 27:
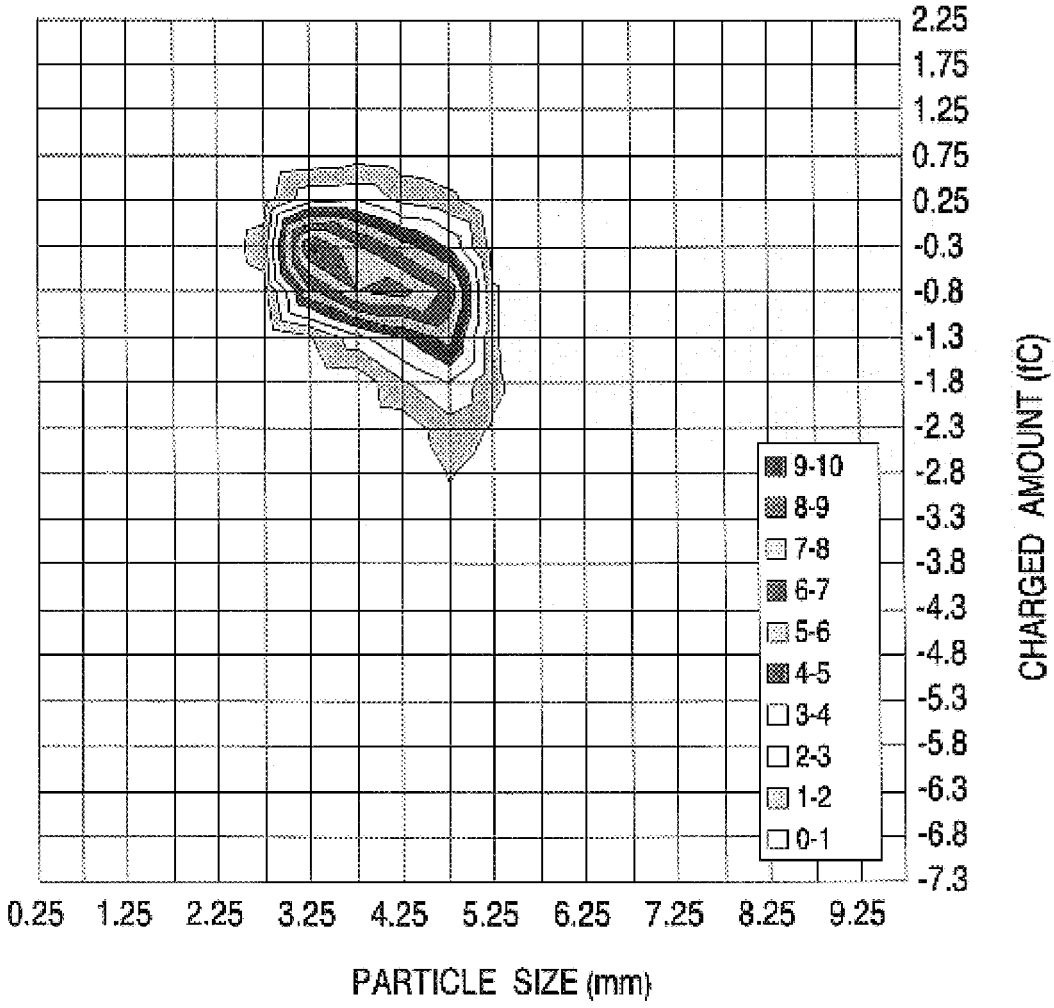
FIG. 27 is a drawing illustrating the particle size-charged amount distribution of Experimental Example 4-5.

The toner thus obtained was then negatively charged in a non-contact process development device similar to that of FIG. 2. The regulating pressure of the regulating blade was 33 gf/cm and the amount of the toner to be conveyed was 0.283 mg/cm$^2$. About 3,000 particles of the toner thus charged were then measured for particle size and charged amount. The measurements are set forth in Table 4-5 and a three-dimensional graph corresponding to these data is shown in FIG. 27.

TABLE 4-5

| | Charged amount [fC] | | | | | | | | | | |
|---|---|---|---|---|---|---|---|---|---|---|---|
| Particle size [μm] | −7.25 | −6.75 | −6.25 | −5.75 | −5.25 | −4.75 | −4.25 | −3.75 | −3.25 | −2.75 | −2.25 |
| 0.25 | — | — | — | — | — | — | — | — | — | — | — |
| 0.75 | — | — | — | — | — | — | — | — | — | — | — |
| 1.25 | — | — | — | — | — | — | — | — | — | — | — |
| 1.75 | — | — | — | — | — | — | — | — | — | — | — |

TABLE 4-5-continued

| | | | | | | | | | | | |
|---|---|---|---|---|---|---|---|---|---|---|---|
| 2.25 | — | — | — | — | — | — | — | — | — | — | — |
| 2.75 | — | — | — | — | — | — | — | — | — | — | — |
| 3.25 | — | — | — | — | — | — | — | — | — | — | — |
| 3.75 | — | — | — | — | — | — | — | — | 0.033 | — | 0.100 |
| 4.25 | — | — | — | — | — | — | 0.033 | — | 0.067 | 0.133 | 0.333 |
| 4.75 | — | — | — | — | 0.067 | 0.100 | 0.167 | 0.333 | 0.733 | 1.067 | 1.567 |
| 5.25 | — | — | 0.033 | 0.033 | 0.100 | 0.133 | 0.100 | 0.300 | 0.333 | 0.600 | 0.867 |
| 5.75 | 0.067 | — | 0.033 | — | 0.067 | 0.033 | 0.067 | 0.200 | 0.167 | 0.067 | 0.267 *2 |
| 6.25 | — | — | — | — | — | 0.033 | 0.100 | 0.033 | 0.133 | 0.067 | 0.033 |
| 6.75 | — | — | — | — | — | — | — | 0.033 | 0.067 | — | — |
| 7.25 | — | — | — | 0.033 | — | — | — | — | 0.033 | — | — |
| 7.75 | — | — | — | — | — | — | — | — | — | — | — |
| 8.25 | — | — | — | — | — | — | — | — | — | — | — |
| 8.75 | — | — | — | — | — | — | — | — | — | — | — |
| 9.25 | — | — | — | — | — | — | — | — | — | — | — |
| 9.75 | — | — | — | — | — | — | — | — | — | — | — |

| | Charged amount [fC] | | | | | | | | | |
|---|---|---|---|---|---|---|---|---|---|---|
| Particle size [μm] | −1.75 | −1.25 | −0.75 | −0.25 | 0.25 | 0.75 | 1.25 | 1.75 | 2.25 | |
| 0.25 | — | — | — | — | — | — | — | — | — | — |
| 0.75 | — | — | — | — | — | — | — | — | — | — |
| 1.25 | — | — | — | — | — | — | — | — | — | — |
| 1.75 | — | — | — | — | — | — | — | — | — | — |
| 2.25 | — | — | 0.267 | 0.400 | 0.167 | — | — | — | — | 0.833 |
| 2.75 | — | 0.033 | 0.667 | 1.433 | 0.467 | 0.033 | — | — | — | 2.633 |
| 3.25 | 0.100 | 0.900 | 5.633 | 9.167 *1 | 2.800 | 0.167 | — | — | — | 18.767 |
| 3.75 | 0.233 | 2.667 | 8.033 | 7.233 | 3.000 | 0.467 | — | — | — | 21.767 |
| 4.25 | 1.900 | 3.967 | 8.333 | 5.533 | 1.767 | 0.400 | 0.067 | — | — | 22.533 |
| 4.75 | 3.033 | 5.400 | 6.700 | 3.967 | 1.267 | 0.200 | 0.033 | 0.033 | — | 24.667 |
| 5.25 | 1.233 | 1.100 | 1.133 | 0.500 | 0.200 | 0.033 | — | — | — | 6.600 |
| 5.75 | 0.167 | 0.033 | 0.067 | — | 0.033 | — | — | — | — | 1.267 |
| 6.25 | 0.033 | 0.067 | 0.067 | 0.033 | — | — | — | — | — | 0.600 |
| 6.75 | — | — | — | 0.033 | — | 0.033 | — | — | — | 0.167 |
| 7.25 | — | — | — | — | — | — | — | — | — | 0.067 |
| 7.75 | — | — | — | — | — | — | — | — | — | — |
| 8.25 | — | — | — | — | — | — | — | — | — | — |
| 8.75 | — | — | — | — | — | — | — | — | — | — |
| 9.25 | — | — | — | — | — | — | — | — | — | — |
| 9.75 | — | — | — | — | — | — | — | — | — | — |

*1: A1, B1
*2: A2, B2

As can be seen in Table 4-5, the particle size divisional value A1 [μm] and the charged amount divisional value B1 [fC] in the division where there is the largest number proportion of the toner particles, the particle size divisional value A2 [μm] where the particulate toner has the greatest particle size in the particle size distribution indicating that the number proportion of the toner particles is 1% or more and the charged amount divisional value B2 [fC] where there is the largest number proportion of the toner particles when the particle size division is A2 defined above were 3.25, −0.25, 5.75 and −2.25, respectively, and (B2−B1)/(A2−A1) is −0.8, demonstrating that the aforementioned formula 13 is not satisfied (see Table 4-6).

Under these conditions, image formation was effected. The resulting printed matter was then evaluated for starvation. The results of evaluation are set forth in Table 4-6 below. Under the conditions of Experimental Example 4-5, starvation occurred, deteriorating the quality of the halftone image.

TABLE 4-6

| | A1 | B1 | A2 | B2 | (B2 − B1)/(A2 − A1) | Results of evaluation |
|---|---|---|---|---|---|---|
| Experimental Example 4-1 | 4.75 | −0.75 | 6.75 | −3.25 | −1.25 | Good |
| Experimental Example 4-2 | 4.75 | −0.75 | 7.25 | −2.25 | −0.6 | Poor |
| Experimental Example 4-3 | 4.75 | −0.25 | 6.75 | −2.75 | −1 | Poor |
| Experimental Example 4-4 | 4.75 | −1.25 | 6.275 | −3.25 | −1.33 | Good |
| Experimental Example 4-5 | 3.25 | −0.25 | 5.75 | −2.25 | −0.8 | Poor |

As a result of the comparison of the foregoing examples and comparative examples, it has been found that it is effective to control the relationship between the distribution of charged amount and the distribution of particle size of toner particles so as to satisfy predetermined relational formulas. Further, it is also effective to control the relationship between the maximum charged amount and the distribution of particle size of toner particles, and the relationship between the minimum charged amount and the distribution of particle size of toner particles.

For example, in the second invention, it is necessary that control be made to satisfy the aforementioned formulas 3 to 5. When the aforementioned formula 3 is satisfied, the dot reproducibility can be enhanced to advantage in particular. In other words, in the case where the aforementioned formula 3 is satisfied, even when the aggregate of toner particles has some dispersion in charged amount with respect to particle size, that is, the particle size of the toner particles are almost the same, there can be present individual toner particles having a great charged amount and a small charged amount. Accordingly, during the reproduction of dot, toner particles having a great charged amount are selectively disposed at the center of the dot and toner particles having a small charged amount are disposed surrounding them. As a result, the repulsion of toner particles by each other can be inhibited, making it possible to obtain a good dot reproducibility.

Further, when the aforementioned formula 4 is satisfied, background stain due to mirror image force of toner with respect to the image carrier can be eliminated to advantage in particular. In other words, in an aggregate of toner particles, strongly charged toner particles which have been charged more than necessary for their particle size have a strong mirror image force with respect to the image carrier and are developed also at the non-image area, causing background stain. This background stain can be transferred, causing a serious problem. However, in the second invention, by satisfying the formula 4, the occurrence of strongly charge toner particles can be inhibited, making it possible to eliminate background stain.

Moreover, when the aforementioned formula 5 is satisfied, the occurrence of fog can be eliminated and the dot reproducibility can be enhanced to advantage in particular. In other words, when the charged amount of oppositely charged toner particles (irregular positively charged toner developed when the toner is negatively charged in this case) is great, negatively charged toner particles are attracted by the oppositely charged toner particles, causing the deformation of dot and deteriorating the dot reproducibility. Further, development is made also at the non-image area, causing fogging. However, in the second invention, by satisfying the formula 5, oppositely charged toner particles (positively charged toner particles) having a small charged amount can be attracted by the negatively charged toner particles. Accordingly, the shape of dot can be kept circle, making it possible to enhance the dot reproducibility. Further, the amount of the toner particles to be attached to the non-image area can be reduced, making it possible to inhibit the occurrence of fog.

Further, for example, In accordance with the developing process of the third invention, the charged amount of toner particles having a relatively great particle size is controlled by satisfying the formula 10. Thus, toner particles having a relatively small charged amount and a great particle can be concentrated to areas on the latent image region to which toner particles can be difficultly attached (areas which are relatively less subject to electric field during development). In other words, the thickness of the toner attached to areas which are less subject to electric field can be raised by bulky large particle size toner particles, making it possible to make uniform development over the entire latent image region.

The third invention is also arrangement such that when the formula 12 is satisfied, sufficiently charged small particle size toner particles are concentrated to areas on the latent image region to which toner particles can be easily attached (areas which are relatively much subject to electric field during development). In this arrangement, the thickness of the toner at these areas can be controlled to make the toner thickness uniform over the entire development region, making it possible to inhibit unevenness in image density.

Figure 22:
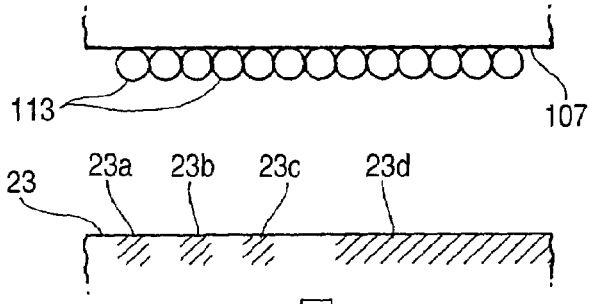
FIG. 22 is a schematic illustration showing the principle of the development step according to the present invention.
Figure 22:
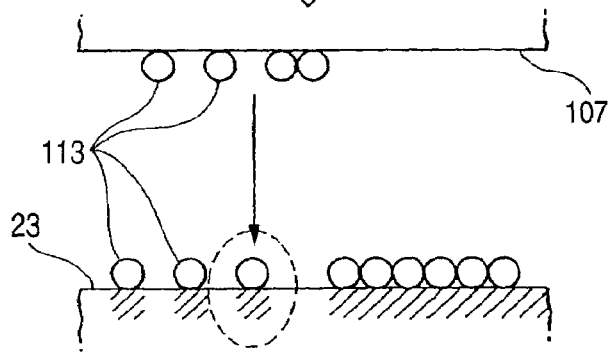

Further, for example, in accordance with the developing process of the fourth invention, when the formula 13 is satisfied, toner particles having a relatively great particle size can be sufficiently charged to have a sufficient flying speed. In this arrangement, it is assured that the toner particles 113 can fly also toward the latent image region 23*c* corresponding to halftone image as shown in FIG. 22 without being swept into the latent image region 23*d* having a high printing duty. Accordingly, the occurrence of starvation can be prevented, making it possible to form a high quality image in the printing of halftone or the like.

While the present invention has been described in detail and with reference to specific embodiments thereof, it will be apparent to one skilled in the art that various changes and modifications can be made therein without departing the spirit and scope thereof.

The present application is based on Japanese Patent Application No. 2003-207987, 2003-207989, 2003-346613 and 2003-346619 filed on Aug. 20, 2003, Aug. 20, 2003, Oct. 6, 2003 and Oct. 6, 2003, respectively, and the contents thereof are incorporated herein by reference.

What is claimed is:

1. A developing process comprising the steps of:

negatively charging toner particles supported on a developer carrier by regulating with a regulating member under pressure so as to obtain negatively charged toner particles; and providing the negatively charged toner particles to an electrostatic latent image formed on an image carrier so as to visualize the latent image as a toner image, wherein, the negatively charged toner particles satisfy formulas (3), (4) and (5) shown below, when being measured by the laser doppler method in an oscillation field in an acoustic alleviation cell to determine individual particle size and charged amount thereof:

$$B > \tfrac{1}{2} \times A \quad (3)$$

$$|B\max| < \tfrac{2}{3} \times A \quad (4)$$

$$B\min \leqq 0.25 \quad (5)$$

wherein A [μm] represents the center value in the particle size distribution; B [fC] represents the width of the charged amount distribution therein; Bmax [fC] represents the maximum value of the charged amount therein; and Bmin [fC] represents the minimum value of the charged amount therein.

2. A developing process comprising the steps of:

positively charging toner particles supported on a developer carrier by regulating with a regulating member under pressure so as to obtain positively charged toner particles; and providing the positively charged toner particles to an electrostatic latent image formed on an image carrier so as to visualize the latent image as a toner image, wherein, the positively charged toner particles satisfy formulas (6), (7) and (8) shown below, when being measured by the laser doppler method in an oscillation field in an acoustic alleviation cell to determine individual particle size and charged amount thereof:

$$B > \tfrac{1}{2} \times A \quad (6)$$

$$B\max < \tfrac{2}{3} \times A \quad (7)$$

$$|B\min| \leqq 0.25 \quad (8)$$

wherein A [μm] represents the center value in the particle size distribution; B [fC] represents the width of the charged amount distribution; Bmax [fC] represents the maximum value of the charged amount therein; and Bmin [fC] represents the minimum value of the charged amount therein.

3. The developing process according to claims 1 or 2, wherein the charged toner particles further satisfy the following formula (9):

$$A\max - A\min < A \quad (9)$$

wherein Amax [μm] represents the maximum value of particle size therein; and Amin [μm] represents the minimum value of particle size therein.

4. An image forming process comprising the step of transferring a toner image visualized on an image carrier by the developing process according to claims 1 or 2.

* * * * *